US012759758B2

(12) United States Patent
Pohlman et al.

(10) Patent No.: US 12,759,758 B2
(45) Date of Patent: Oct. 13, 2026

(54) CONTAINER FORMED FROM TWO IDENTICAL TRAYS WITH ENGAGEMENT, VENTING AND STACKING FEATURES

(71) Applicant: Anchor Packaging, LLC, St. Louis, MO (US)

(72) Inventors: Michael A. Pohlman, Valley Park, MO (US); Michael B. Tyberghein, Roswell, GA (US)

(73) Assignee: Anchor Packaging, LLC, St. Louis, MO (US)

( * ) Notice: Subject to any disclaimer, the term of this patent is extended or adjusted under 35 U.S.C. 154(b) by 283 days.

(21) Appl. No.: 18/355,130

(22) Filed: Jul. 19, 2023

(65) Prior Publication Data

US 2024/0025595 A1 Jan. 25, 2024
US 2024/0294304 A9 Sep. 5, 2024

Related U.S. Application Data

(60) Provisional application No. 63/390,906, filed on Jul. 20, 2022.

(51) Int. Cl.
*B65D 21/02* (2006.01)
*B65D 1/34* (2006.01)
*B65D 81/26* (2006.01)

(52) U.S. Cl.
CPC ..... *B65D 21/0233* (2013.01); *B65D 1/34* (2013.01); *B65D 21/0217* (2013.01);
(Continued)

(58) Field of Classification Search
CPC .. B65D 21/0233; B65D 1/34; B65D 21/0217; B65D 21/0234; B65D 81/263;
(Continued)

(56) References Cited

U.S. PATENT DOCUMENTS 3,028,039 A * 4/1962 Clark ..... A47J 36/064 220/366.1
3,708,086 A 1/1973 Colato
(Continued)

FOREIGN PATENT DOCUMENTS

CA 2765675 C 12/2013
CA 2765677 C 2/2016
(Continued)

OTHER PUBLICATIONS

Partial International Search Report and Provisional Opinion issued for PCT/US2023/070515, dated Oct. 31, 2023 (11 pages).

*Primary Examiner* — Andrew D Perreault
(74) *Attorney, Agent, or Firm* — Armstrong Teasdale LLP

(57) ABSTRACT

A container includes trays having a substantially identical profile. For each tray, the tray includes a rim that includes a proximal segment, a bead segment, and at least one vent channel defined in the proximal segment, the bead segment has an upwardly-extending member and a downwardly-extending member, the upwardly-extending member defines a first cavity, and the downwardly-extending member defines a second cavity. When the trays are engaged to close the container, the upwardly-extending member of the first tray is received in the second cavity of the second tray, the upwardly-extending member of the second tray is received in the second cavity of the first tray, the first and second trays define an interior volume of the container, the proximal segments of the rims of the first and second trays are in face-to-face contact to substantially seal the interior volume, and each vent channel is in communication with the interior volume.

20 Claims, 51 Drawing Sheets

(52) U.S. Cl.
CPC ..... *B65D 21/0234* (2013.01); *B65D 81/263* (2013.01); *B65D 2205/02* (2013.01)

(58) Field of Classification Search
CPC ..... B65D 2205/02; B65D 2543/00027; B65D 2543/0062; B65D 43/0206; B65D 43/0266; B65D 51/1605; B65D 51/1666
See application file for complete search history.

(56) References Cited

U.S. PATENT DOCUMENTS

| | | | |
|---|---|---|---|
| 3,835,281 | A | 9/1974 | Mannix |
| 3,933,295 | A | 1/1976 | Congleton |
| 4,195,746 | A | 4/1980 | Cottrell |
| 4,294,371 | A | 10/1981 | Davis |
| D307,395 | S | 4/1990 | Borst |
| 4,974,738 | A | 12/1990 | Kidd |
| 5,273,174 | A | 12/1993 | Fisher |
| 5,310,070 | A | 5/1994 | Haas |
| 5,353,935 | A | 10/1994 | Yeager et al. |
| 5,356,023 | A | 10/1994 | Krupa |
| 5,878,656 | A | 3/1999 | Fletcher |
| 5,897,011 | A | 4/1999 | Brilliant |
| 5,953,886 | A | 9/1999 | Eppler |
| 6,786,351 | B2 | 9/2004 | Krueger |
| 7,032,773 | B2 | 4/2006 | Dees |
| D536,992 | S | 2/2007 | Garg |
| 7,243,813 | B2 | 7/2007 | Krueger |
| 7,246,714 | B2 | 7/2007 | Garg |
| D570,681 | S | 6/2008 | Hussain |
| 7,549,551 | B2 | 6/2009 | Tyberghein |
| D597,793 | S | 8/2009 | Krueger |
| D603,222 | S | 11/2009 | Krueger |
| D611,303 | S | 3/2010 | Cimmerer |
| 7,685,677 | B2 | 3/2010 | Garg |
| 7,691,301 | B2 | 4/2010 | Tyberghein |
| D638,290 | S | 5/2011 | Cimmerer |
| D640,506 | S | 6/2011 | Garg |
| D649,034 | S | 11/2011 | Cimmerer |
| D649,035 | S | 11/2011 | Riales |
| D649,036 | S | 11/2011 | Cimmerer |
| D649,037 | S | 11/2011 | Cimmerer |
| D649,038 | S | 11/2011 | Cimmerer |
| D649,447 | S | 11/2011 | Cimmerer |
| 8,083,084 | B2 | 12/2011 | Vovan |
| D651,892 | S | 1/2012 | Riales |
| D651,893 | S | 1/2012 | Riales |
| D651,894 | S | 1/2012 | Cimmerer |
| D651,895 | S | 1/2012 | Cimmerer |
| D652,291 | S | 1/2012 | Riales |
| D652,292 | S | 1/2012 | Riales |
| D654,321 | S | 2/2012 | Garg |
| 8,322,553 | B2 * | 12/2012 | Rider, Jr. ..... B65D 43/021 220/366.1 |
| D675,919 | S | 2/2013 | Krueger |
| D678,051 | S | 3/2013 | Krueger |
| D678,763 | S | 3/2013 | Tyberghein |
| D679,585 | S | 4/2013 | Krueger |
| D679,587 | S | 4/2013 | Krueger |
| D682,674 | S | 5/2013 | Krueger |
| D689,334 | S | 9/2013 | Krueger |
| D689,363 | S | 9/2013 | Sundy |
| D691,038 | S | 10/2013 | Tyberghein |
| 8,561,823 | B1 | 10/2013 | Krupa |
| D696,111 | S | 12/2013 | Sundy |
| D707,120 | S | 6/2014 | Tyberghein |
| D711,220 | S | 8/2014 | Tyberghein |
| 8,875,927 | B2 | 11/2014 | Pohlman |
| 8,967,408 | B2 | 3/2015 | Tyberghein |
| D741,166 | S | 10/2015 | Tyberghein |
| D742,223 | S | 11/2015 | Tyberghein |
| 9,278,787 | B2 | 3/2016 | Garg |
| 9,475,621 | B1 | 10/2016 | Krueger |
| 9,580,219 | B2 | 2/2017 | Cimmerer |
| 9,656,785 | B2 | 5/2017 | Cimmerer |
| D795,651 | S | 8/2017 | Cimmerer |
| 9,796,511 | B2 | 10/2017 | Cimmerer |
| 9,926,111 | B2 | 3/2018 | Krueger |
| D814,293 | S | 4/2018 | Tyberghein |
| D838,850 | S | 1/2019 | Neubauer |
| D846,464 | S | 4/2019 | Zhao |
| 10,358,271 | B2 | 7/2019 | Pohlman |
| D860,846 | S | 9/2019 | Wang Lee |
| D862,158 | S | 10/2019 | Silsby |
| 10,435,204 | B2 | 10/2019 | Stein |
| 10,450,112 | B2 | 10/2019 | Cimmerer |
| 10,494,155 | B2 | 12/2019 | Snedden |
| D872,599 | S | 1/2020 | Krueger |
| D874,945 | S | 2/2020 | Krueger |
| 10,723,521 | B2 | 7/2020 | Magana |
| 10,836,542 | B2 | 11/2020 | Stein |
| D907,481 | S | 1/2021 | Krueger |
| D907,995 | S | 1/2021 | Krueger |
| D910,436 | S | 2/2021 | Krueger |
| D910,437 | S | 2/2021 | Krueger |
| D910,438 | S | 2/2021 | Krueger |
| D911,163 | S | 2/2021 | Krueger |
| D911,836 | S | 3/2021 | Krueger |
| D914,518 | S | 3/2021 | Krueger |
| D915,192 | S | 4/2021 | Krueger |
| D919,424 | S | 5/2021 | Abrol |
| 10,994,898 | B2 | 5/2021 | Snedden |
| 11,117,720 | B2 | 9/2021 | Pohlman |
| 2002/0175164 | A1 | 11/2002 | Dees et al. |
| 2004/0089658 | A1 | 5/2004 | Sarnoff |
| 2004/0144781 | A1 * | 7/2004 | Dees ..... B65D 43/0204 220/4.24 |
| 2006/0157483 | A1 | 7/2006 | Evans et al. |
| 2007/0114231 | A1 | 5/2007 | Blythe et al. |
| 2007/0164019 | A1 | 7/2007 | Gartz |
| 2008/0023364 | A1 | 1/2008 | Krueger |
| 2008/0023882 | A1 | 1/2008 | Garg |
| 2008/0237228 | A1 | 10/2008 | Chou |
| 2009/0065514 | A1 | 3/2009 | Vovan |
| 2009/0179039 | A1 | 7/2009 | Cimmerer |
| 2010/0181323 | A1 | 7/2010 | Thaler |
| 2010/0320210 | A1 | 12/2010 | Cimmerer |
| 2019/0344936 | A1 | 11/2019 | Pohlman |
| 2021/0362914 | A1 | 11/2021 | Krueger |
| 2021/0362921 | A1 | 11/2021 | Krueger |

FOREIGN PATENT DOCUMENTS

| | | | |
|---|---|---|---|
| CA | 2934294 | C | 5/2018 |
| CA | 2934299 | C | 2/2021 |
| CN | 106314988 | B | 1/2017 |
| CN | 108688968 | B | 10/2018 |
| CN | 108861029 | B | 11/2018 |

* cited by examiner

CONTAINER FORMED FROM TWO IDENTICAL TRAYS WITH ENGAGEMENT, VENTING AND STACKING FEATURES

CROSS-REFERENCE TO RELATED APPLICATION

This application claims priority to U.S. Provisional Patent Application No. 63/390,906, filed Jul. 20, 2022, the disclosure of which is hereby incorporated herein by reference in its entirety.

FIELD

The present disclosure relates to a container formed from two trays having substantially identical profiles, and more particularly, to trays that have substantially identical profiles and include engagement features that enable the trays to form a closed container, venting features that enable venting steam and minimizing liquid leakage from the closed container, denesting features that enable ease of grasping the trays individually when stacked, and/or complementing stacking features that enable stacking multiple containers formed from pairs of the trays on top of one another.

BACKGROUND

Containers that include a base and a lid are commonly used in the food services and restaurant industry to package prepared or take-out foods. The base and the lid typically have different profiles and configurations based on the desired use of the container. Containers that include different bases and lids create a significant volume footprint for establishments that are often limited in space. The different bases and lids also create an inventory burden as it is difficult to track the different bases and lids to ensure that an equal ratio of lids to bases are available. The number of containers available for use may be depleted when lids or bases required to complete a container are damaged or otherwise removed from the pool of bases or lids. The footprint and inventory burdens are exacerbated by the fact that establishment frequently package foods in differently sized and/or shaped containers. Accordingly, it would be desirable to reduce storage space and optimize inventory through the use of more convenient packaging material.

A solution to these problems is the use of a pair container components that have identical or substantially identical profiles to form a food container. Typically, to form the container, the identical pair of container components are inverted (or rotated 180°) relative to one another and engaged to form a closed container. While the use of identical pairs of container components may provide a solution to the above-described problems, other difficulties may exist related to storage of these components and/or use of the container form by the identical components. For example, when stored, the individual container components may form a nested stack and it may be difficult to separate the components individually from the stack. Stacking multiple containers may also be difficult as the containers may be susceptible to lateral movement relative to the other containers in the stack (e.g., during transport). Hot foods stored in the containers may release steam that can make the food soggy from collected moisture if not vented from the food storage container. It would be desirable to include features in the identical container components that provide relief to at least some of these problems. However, it is a difficult task to provide such features as these relate to multiple different orientations of the identical container components, and the features need to align when the containers are inverted relative to each other and/or in a same orientation.

Accordingly, there exists a need for a container components having substantially identical profiles used to form a food storage container that can also be stored easily, stacked efficiently, and used to accommodate a variety of food textures, temperatures, and tastes.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. These statements are to be read in this light, and not as admissions of prior art.

BRIEF SUMMARY

Various aspects described herein provide a container that includes a first tray and a second tray, wherein each tray has a substantially identical profile. The first tray is releasably engageable with the second tray when the second tray is inverted relative to the first tray.

In one of such aspects, for each tray of the container, the tray includes a cover portion, a peripheral rim, and a sidewall extending between and coupling the cover portion and the rim, the rim includes a proximal segment and a bead segment, the proximal segment extends outwardly from the sidewall to the bead segment, the bead segment includes an upwardly-extending member and a downwardly-extending member, the upwardly-extending member defines a first cavity and includes an upper bead spaced above the proximal segment, and the downwardly-extending member defines a second cavity and includes a lower bead spaced below the proximal segment. When the first tray engages the second tray inverted relative to the first tray, the upwardly-extending member of the bead segment of the first tray is received in the second cavity of the bead segment of the second tray and engages the downwardly-extending member of the bead segment of the second tray, and the upwardly-extending member of the bead segment of the second tray is received in the second cavity of the bead segment of the first tray and engages the downwardly-extending member of the bead segment of the first tray. When the first tray and the second tray are stacked in a same orientation, movement of the first tray and the second tray relative to one another is limited by at least one of: i) the upper bead of the bead segment of the first tray engaging the rim of the second tray, and ii) the lower bead of the bead segment of the second tray engaging the rim of the first tray.

In another of such aspects, for each tray of the container, the tray includes a cover portion, a peripheral rim, and a sidewall extending between and coupling the cover portion and the rim, the rim includes a proximal segment, a bead segment, and a distal segment, the proximal segment extends outwardly from the sidewall to the bead segment, the distal segment extends outwardly from the bead segment opposite the proximal segment, the bead segment includes an upwardly-extending member and a downwardly-extending member, the upwardly-extending member of the bead segment includes a first inner wall extending upwardly from the proximal segment to an upper bead and a first outer wall extending downwardly from the upper bead to the distal segment, wherein the first inner wall, the upper bead, and the first outer wall define a first cavity, wherein a greater distance is defined between the first inner wall and the first outer wall proximate the upper bead than a distance defined between the first inner wall and the first outer wall proximate an opening to the first cavity, and the downwardly-extending member of the bead segment includes a second inner wall extending downwardly from the proximal segment to a lower bead and a second outer wall extending upwardly from the lower bead to the distal segment, wherein the second inner wall, the lower bead, and the second outer wall define a second cavity, wherein a greater distance is defined between the second inner wall and the second outer wall proximate the lower bead than a distance defined between the second inner wall and the second outer wall proximate an opening to the second cavity. When the first tray engages the second tray inverted relative to the first tray, the upper bead, the first inner wall, and the first outer wall of the upwardly-extending member of the bead segment of the first tray are received in the second cavity of the bead segment of the second tray and the first inner wall of the upwardly-extending member of the first tray engages the second inner wall of the downwardly-extending member of the second tray by friction, and the upper bead, the first inner wall, and the first outer wall of the upwardly-extending member of the bead segment of the second tray are received in the second cavity of the bead segment of the first tray and the first inner wall of the upwardly-extending member of the second tray engages the second inner wall of the downwardly-extending member of the first tray by friction.

In another of such aspects, for each tray of the container, the tray includes a cover portion, a peripheral rim, and a sidewall extending between and coupling the cover portion and the rim, the rim includes a proximal segment and a bead segment, the proximal segment extends outwardly from the sidewall to the bead segment, the bead segment includes an upwardly-extending member and a downwardly-extending member, the upwardly-extending member defines a first cavity, the downwardly-extending member defines a second cavity, and the sidewall includes at least one outwardly-extending denesting lug formed adjacent the proximal segment of the rim. When the first tray engages the second tray inverted relative to the first tray, the upwardly-extending member of the bead segment of the first tray is received in the second cavity of the bead segment of the second tray and engages the downwardly-extending member of the bead segment of the second tray, and the upwardly-extending member of the bead segment of the second tray is received in the second cavity of the bead segment of the first tray and engages the downwardly-extending member of the bead segment of the first tray. When the first tray and the second tray are stacked in a same orientation, the at least one denesting lug of the second tray engages the rim of the first tray to limit movement of the first tray and the second tray relative to one another.

In another of such aspects, for each tray of the container, the tray includes a cover portion, a peripheral rim, and a sidewall extending between and coupling the cover portion and the rim, the rim includes a proximal segment and a bead segment, the proximal segment extends outwardly from the sidewall to the bead segment, the rim includes at least one vent channel defined in the proximal segment, and the bead segment has an upwardly-extending member and a downwardly-extending member, wherein the upwardly-extending member defines a first cavity and the downwardly-extending member defines a second cavity. When the first tray engages the second tray inverted relative to the first tray, the upwardly-extending member of the bead segment of the first tray is received in the second cavity of the bead segment of the second tray and engages the downwardly-extending member of the bead segment of the second tray, the upwardly-extending member of the bead segment of the second tray is received in the second cavity of the bead segment of the first tray and engages the downwardly-extending member of the bead segment of the first tray, the sidewalls and the cover portions of the first and second trays define an interior volume of the container, the proximal segments of the rims of the first and second trays are in face-to-face contact to substantially seal the interior volume, and each of the at least one vent channels of the first and second trays is in communication with the interior volume.

In another of such aspects, for each tray of the container, the tray includes a cover portion, a peripheral rim, and a sidewall extending between and coupling the cover portion and the rim, the cover portion includes a first stacking member and a second stacking member each located proximate an outer edge of the cover portion, the first and second stacking members each have a U-shape profile, the rim includes a proximal segment and a bead segment, the proximal segment extends outwardly from the sidewall to the bead segment, and the bead segment has an upwardly-extending member and a downwardly-extending member, wherein the upwardly-extending member defines a first cavity and the downwardly-extending member defines a second cavity. When the first tray engages the second tray inverted relative to the first tray, the upwardly-extending member of the bead segment of the first tray is received in the second cavity of the bead segment of the second tray and engages the downwardly-extending member of the bead segment of the second tray, and the upwardly-extending member of the bead segment of the second tray is received in the second cavity of the bead segment of the first tray and engages the downwardly-extending member of the bead segment of the first tray. When the second tray is inverted relative to the first tray and the cover portion of the second tray is stacked on the cover portion of the first tray, the first stacking member of the second tray is engageable with the second stacking member of the first tray and the first stacking member of the first tray is engageable with the second stacking member of the second tray to limit movement of the first tray and the second tray relative to one another.

In another aspect, a pair of containers is provided. Each container includes a first tray and a second tray, wherein each tray has a substantially identical profile. The first tray is releasably engageable with the second tray when the second tray is inverted relative to the first tray. For each tray of each container, the tray includes a cover portion, a peripheral rim, and a sidewall extending between and coupling the cover portion and the rim, the cover portion includes a first stacking member and a second stacking member each located proximate an outer edge of the cover portion, the first and second stacking members each have a U-shape profile, the rim includes a proximal segment and a bead segment, the proximal segment extends outwardly from the sidewall to the bead segment, and the bead segment has an upwardly-extending member and a downwardly-extending member, wherein the upwardly-extending member defines a first cavity and the downwardly-extending member defines a second cavity. For each container, when the first tray engages the second tray inverted relative to the first tray the upwardly-extending member of the bead segment of the first tray is received in the second cavity of the bead segment of the second tray and engages the downwardly-extending member of the bead segment of the second tray, and the upwardly-extending member of the bead segment of the second tray is received in the second cavity of the bead segment of the first tray and engages the downwardly-extending member of the bead segment of the first tray. When a first container of the pair of containers is stacked on a second container of the pair of containers, the first stacking member of the first tray of the first container is engageable with the second stacking member of the second tray of the second container and the first stacking member of the second tray of the second container is engageable with the second stacking member of the first tray of the first container to limit movement of the first container and the second container relative to one another.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference numerals used throughout the drawings indicate corresponding parts.

DETAILED DESCRIPTION

Figure 1:
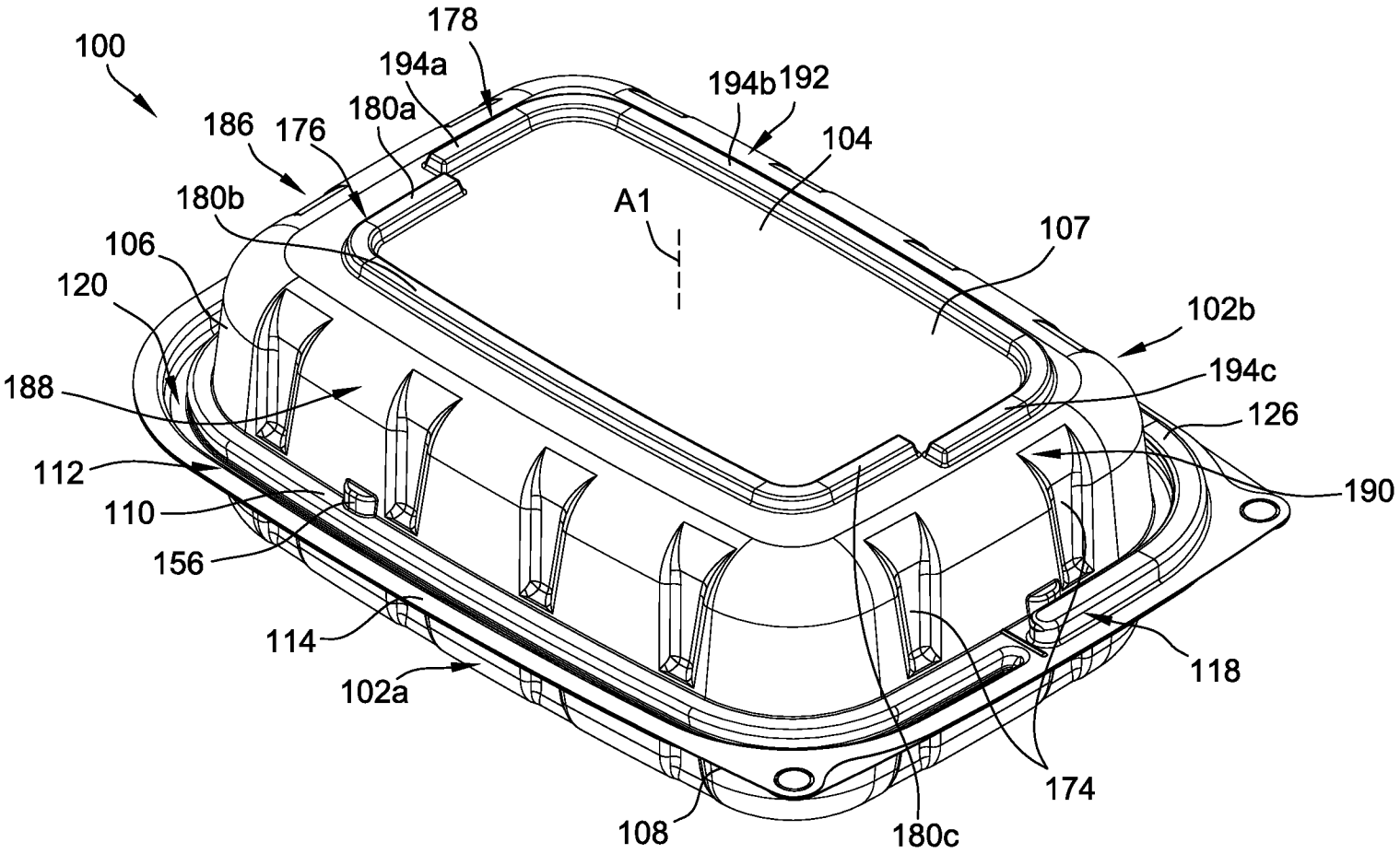
FIG. 1 is a perspective view of an example container formed of trays having a substantially identical profile, shown in a closed configuration.

Embodiments described herein relate to containers formed from a pair of trays having a substantially identical profile. The containers described herein may be suitable for use in various applications such as, for example, storing food of a variety of textures, temperatures, and tastes. The containers described herein are not limited to food storage applications, and may be suitable for use in other applications, such as those where storage of items in a container is desired or useful.

As used herein, the phrase "substantially identical profile" refers to a same overall footprint and outer profile. Trays having a substantially identical profile may have some differences. For example, trays that have different depths or trays that have different contours or areas of curvature at discrete regions may have a substantially identical profile. Trays having a substantially identical profile may have the same elements and components (e.g., denesting features, stacking features, venting features, etc.) at different locations.

As used herein, the term "tray" refers to a shell component of a container that may be used as a base or a lid of the container. Accordingly, the terms "tray," "component," "shell component," "base," "lid," and the like may be used interchangeably. A tray as described herein is not limited to the inclusion or exclusion of any element, feature, or component unless express description to that effect is provided herein.

Advantages provided by embodiments described herein may include, but are not limited to: (i) efficient storage and stacking of containers and/or trays that form the containers, (ii) simplified assembly of the trays and inventory management, (iii) reduced entrapped moisture within the container with minimal liquid leakage from the container, (iv) reduced negative impact of entrapped moisture in the container on food texture and/or taste, (v) secure stacking of multiple containers when in use, (vi) improved balance of a container on a surface; and/or (vii) enable easy separation of trays from one another when multiple trays are stacked. Advantages will become more apparent to those skilled in the art from the following description of example embodiments.

Referring now to the drawings, FIGS. 1-8 depict an example container 100 that may be suitable for use in storage applications, such as storage of a food product. The container 100 includes a first tray 102*a* and a second tray 102*b*. In the orientation shown in FIGS. 1-8, the first tray 102*a* forms a lid of the container 100, and the second tray 102*b* forms a base of the container 100. The container 100 is not limited to any particular orientation, and the first tray 102*a* and the second tray 102*b* may alternatively form the lid or the base, and more broadly, any shell component of the container. Directional terms used to describe spatial relation between the first tray 102*a* and the second tray 102*b*, as well as spatial relation between elements and components of the trays 102*a* and 102*b*, are used solely for convenience of description. For example, the terms "horizontally," "vertically," "outer," "peripheral," "outwardly," "upper," "inner," "inwardly," "upwardly," "downwardly," and similar or other directional terms are not limiting with regard to a particular orientation of the container 100 and the elements and features described herein. The spatial relation between elements and components of the container 100 and the trays 102*a* and 102*b* may be described with reference to a central axis $A_1$ of the container 100.

Figure 12:
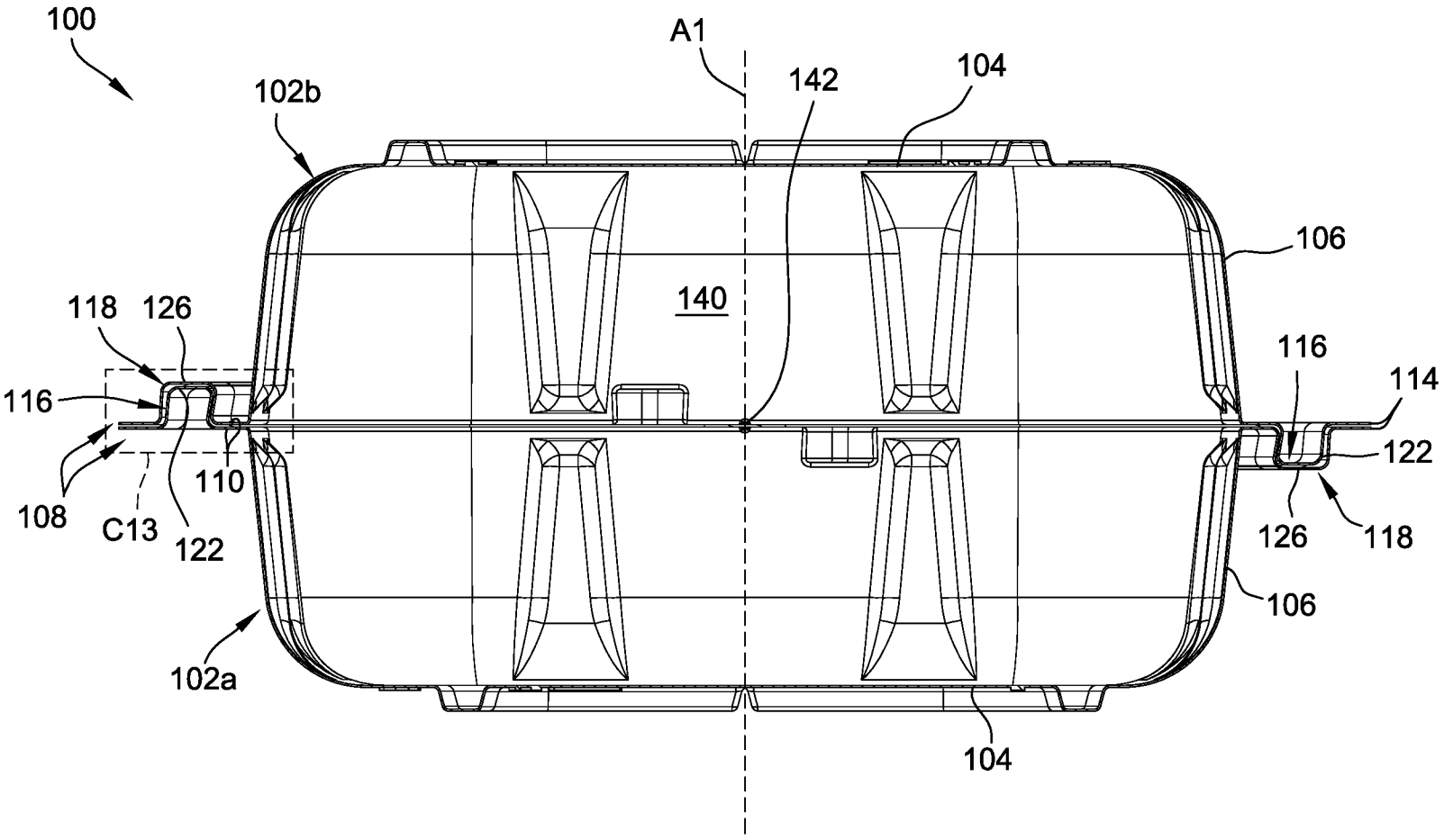
FIG. 12 is a cross-section of the container of FIGS. 1-8, taken along line 12-12 in FIGS. 1 and 2.

The first tray 102*a* and the second tray 102*b* are releasably engageable with each other to selectively provide the container 100 in the closed configuration (FIGS. 1-7), in which the trays 102*a* and 102*b* are engaged, and an open configuration (FIG. 8), in which the trays 102*a* and 102*b* are released from each other. FIG. 12 is a cross section of the container 100 taken along line 12-12 shown in FIGS. 2 and 3, and depicts engagement between the trays 102*a* and 102*b* when the container is in the closed configuration. Engagement between the trays 102*a* and 102*b* to close the container 100 will be described below.

The first tray 102*a* and the second tray 102*b* have substantially the same outer profile and overall footprint, and will thus be described as having a substantially identical profile. Express reference herein to an element or component of the first tray 102*a* is equally applicable to the second tray 102*b*, and vice versa, unless expressly stated otherwise or the context of the description clearly indicates otherwise. Corresponding reference numerals are used to describe corresponding elements and features that are included in each tray 102*a* and 102*b*. Differences may exist between the substantially identically-profiled first and second trays 102*a* and 102*b*. Some differences that may exist between the trays 102*a* and 102*b* may be described herein.

Figure 9:
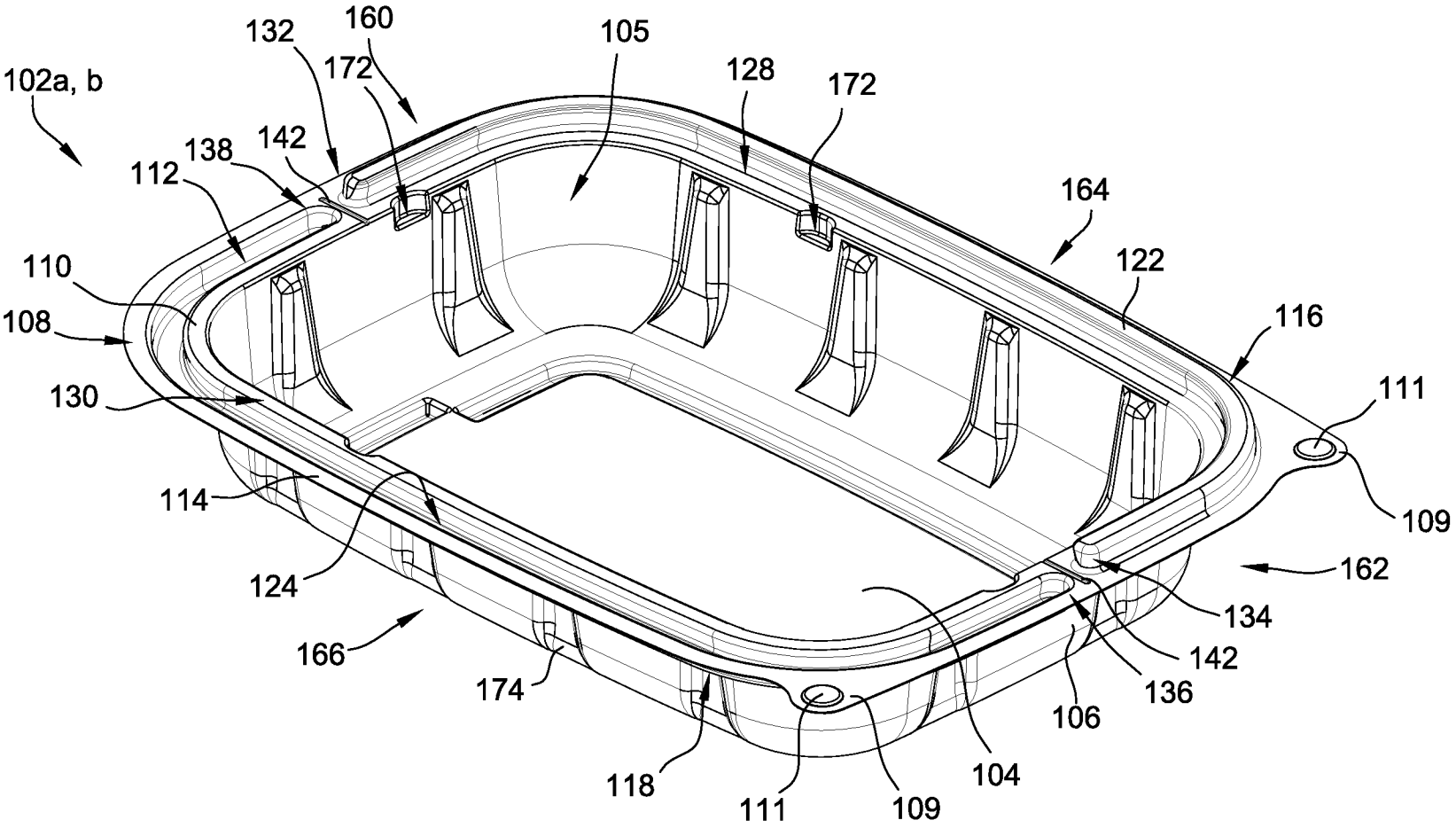
FIG. 9 is an isolated perspective of each tray used to form the container of FIGS. 1-8.
Figure 10:
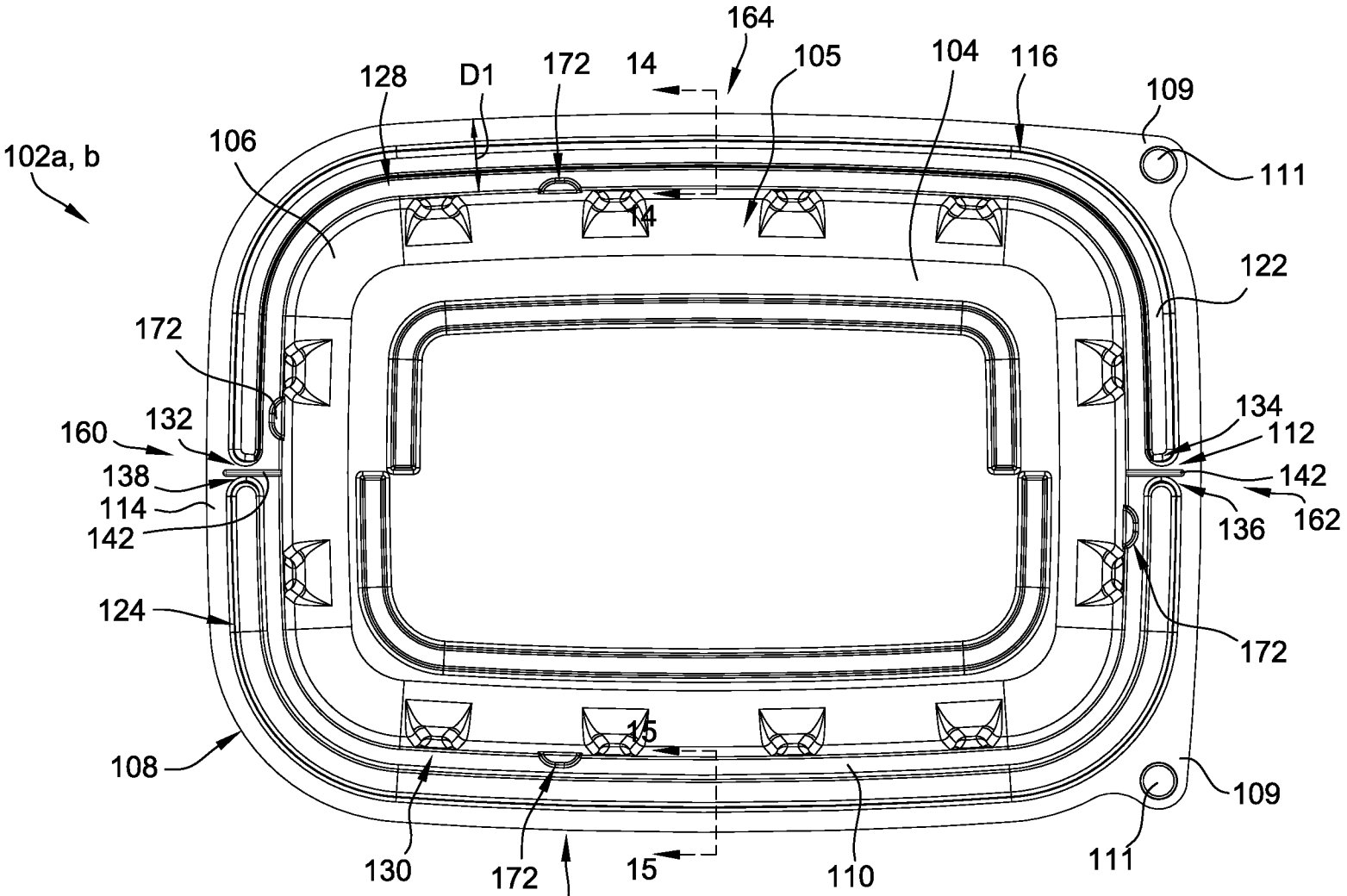
FIG. 10 is a top plan view of the tray of FIG. 9.
Figure 11:
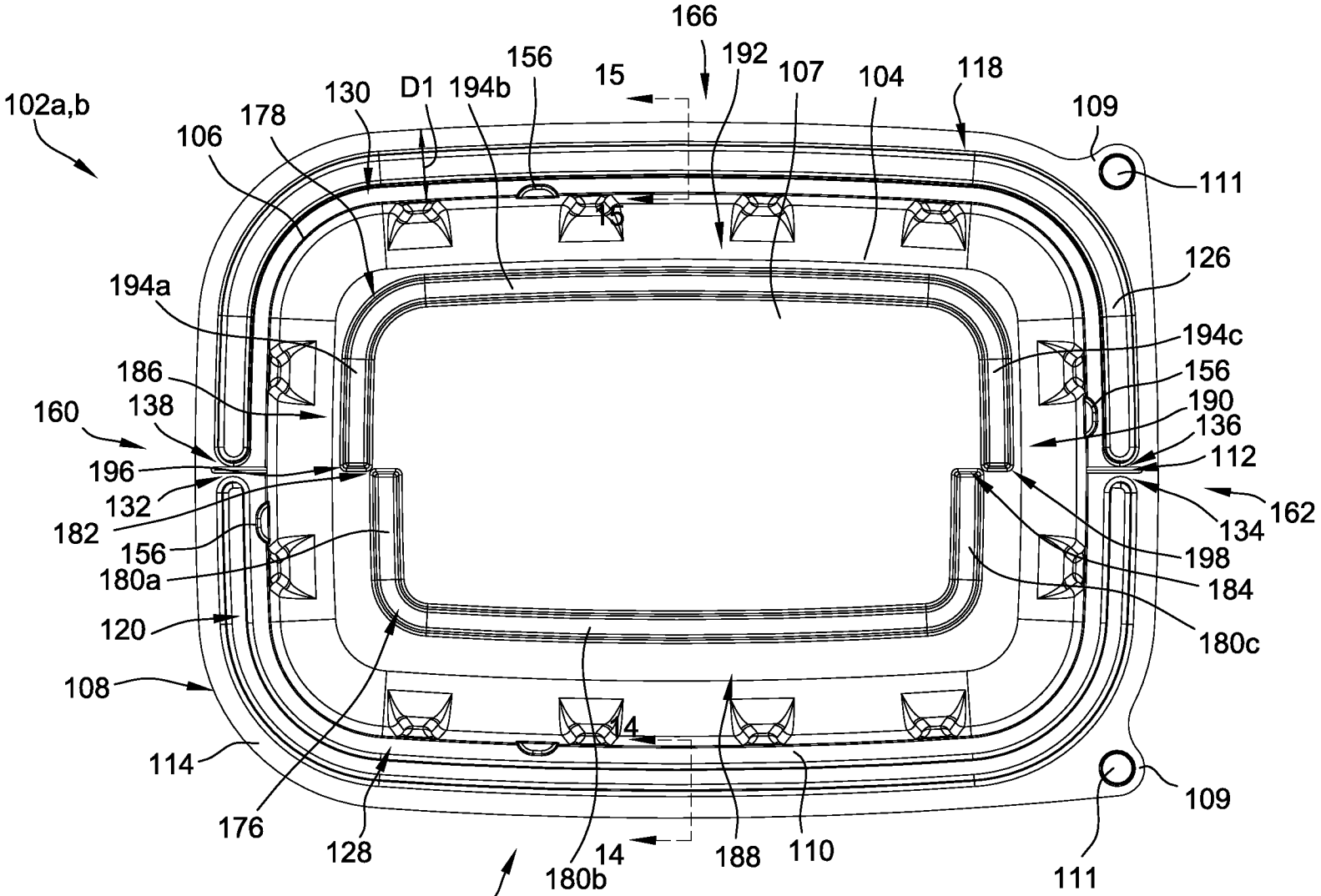
FIG. 11 is a bottom plan view of the tray of FIG. 9.

The container 100 shown in FIGS. 1-8 will be described with additional reference to FIGS. 9-11 which depict various isolated views of the substantially identically-profiled trays 102*a* and 102*b*. For convenience, the first tray 102*a* and the second tray 102*b* will be referred to as the tray 102*a/b* where common features and elements are being described. The tray shown in isolation in FIGS. 9-11 is generally indicated at 102*a/b* accordingly. The first tray 102*a* and the second 102*b* will be referred to separately where reference to tray 102*a* and 102*b* individually is appropriate (e.g., when describing engagement or stacking of the trays 102*a* and 102*b*). Directional terms used to describe elements of the tray 102*a/b* are made with reference to the orientation of the tray 102*a/b* shown in FIGS. 9-11. The tray 102*a/b* is not limited to any particular orientation.

As shown in FIGS. 9-11, the tray 102*a/b* is an oblong shape in the illustrated example, which forms an oblong shape of the container 100 as shown in FIGS. 1-8. The tray 102*a/b* may have any shape depending on a desired shape of the container 100. For example, the tray 102*a/b* may have a square shape, a circular shape, an oval shape, a rectangular shape, a triangular shape, or any other suitable shape.

The tray 102*a/b* is made of any suitable material. For example, the tray 102*a/b* may be made of resins or plastic materials including, but not limited to, polyethylene, polypropylene, polyvinyl chloride or polyethylene terephthalate ("PET"). The tray 102*a/b* may be thermoformed, blow-molded, or injection molded, or may be made using any other suitable technique. The tray 102*a/b* may be transparent or translucent, and may be colored or dyed in either instance.

The tray 102*a/b* includes a cover portion 104, a sidewall 106, and a peripheral rim 108. The sidewall 106 extends between and couples the cover portion 104 and the peripheral rim 108. The sidewall 106 and the cover portion 104 define an interior 105 of the tray 102*a/b*. The peripheral rim 108 extends along a periphery of the tray 102*a/b* and envelops the interior 105. A shape of the rim 108 and the interior 105 complements the shape of the tray 102*a/b*. The cover portion 104 is substantially flat or planar in extent across the sidewall 106 in the illustrated example. The cover portion 104 also includes stacking members 176 and 178 that extend outwardly from an outer surface 107 of the cover portion. The stacking members 176 and 178 will be described in more detail below. The cover portion 104 may be contoured (e.g., dome-shaped) or have other non-planar features (e.g., raised features and/or indented features) in addition to or in the alternative to the stacking member 176 and 178 in some examples.

In the illustrated example, the sidewall 106 includes at least one wall indentation 174 that forms a recess in the sidewall 106. The wall indentation(s) 174 may facilitate improved structural stability of tray 102*a/b* and/or the container 100, thereby allowing tray 102*a/b* and/or the container 100 to be constructed from a lighter weight material (e.g., resins or plastics as described above). The wall indentation (s) 174 may vary in size, shape, and number. In some embodiments, wall indentations 174 may be equally spaced at regular intervals along the sidewall 106 (as illustrated in the FIG. 1). The wall indentations 174 may be spaced differently from the spacing between the wall indentations shown the illustrated example. In other embodiments, the sidewall 106 may not include wall indentations.

The cover portion 104 and/or the sidewall 106 may, in some examples, include vents (not shown) that allow heat and/or moisture-entrained air (e.g., steam) to exit the container 100. The vents may be formed as through-holes in the cover portion 104 and/or the sidewall or partially perforated portions in the cover portion and/or the sidewall. Vents may only be included in one of the first tray 102*a* and the second tray 102*b*. For example, vents may be included in the tray 102*a* or tray 102*b* that is designated for use as the lid of the container 100 and not included in the tray 102*a* or tray 102*b* that is designated for use as the base of the container 100.

A height of the sidewall 106, measured as a distance between the cover portion 104 and the rim 108, defines a depth of the tray 102*a/b*. The height of the sidewall 106, and depth of the tray 102*a/b*, may vary based on the intended use of the container 100. In some examples, the height of the sidewall 106 of the first tray 102*a* may be different from the height of the sidewall 106 of the second tray 102*b*, such that the first tray 102*a* and the second tray 102*b* have different depths.

The rim 108 extends outwardly from the sidewall 106 a radial distance $D_1$ (shown in FIGS. 10 and 11). The rim 108 includes a proximal segment 110, a bead segment 112, and a distal segment 114. The proximal segment 110 extends outwardly from the sidewall 106 to the bead segment 112, the bead segment 112 extends outwardly from the proximal segment 110 to the distal segment 114, and the distal segment 114 extends outwardly from the bead segment 112 and terminates at a peripheral edge of the rim 108. Collectively, a radial distance extended by the proximal segment 110, the bead segment 112, and the distal segment 114 is approximately equal to the radial distance $D_1$ of the rim 108. In the illustrated example, the proximal segment 110 and the distal segment 114 are substantially flat or planar. When the container 100 is closed, the rims 108 of the trays 102*a* and 102*b* are at least partially in face-to-face contact. For example, the proximal segments 110, the bead segments 112, and/or the distal segments 114 of the trays 102*a* and 102*b* are respectively in face-to-face contact when the trays are engaged and the container 100 is closed.

In the example embodiment, the tray 102*a/b* includes at least one tab 109 extending outwardly from the peripheral edge of the rim 108. That is, the tab(s) 109 extend outwardly from the distal segment 114 to a greater radial distance measured from the sidewall 106 than the radial distance $D_1$ of the rim 108. In the illustrated example, the tray 102*a/b* includes two tabs 109. The tabs 109 extend outwardly from the distal segment 114 at opposing corners of the tray adjacent an end 162. One of the tabs 109 is located at the intersection of the end 162 and a first side 164 of the tray 102*a/b*, and the other of the tabs 109 is located at the intersection of the end 162 and a second side 164 of the tray 102*a/b*. Any number of tabs 109 may be included, and the tab(s) 109 may be included at any other suitable location along the rim 108.

Figure 2:
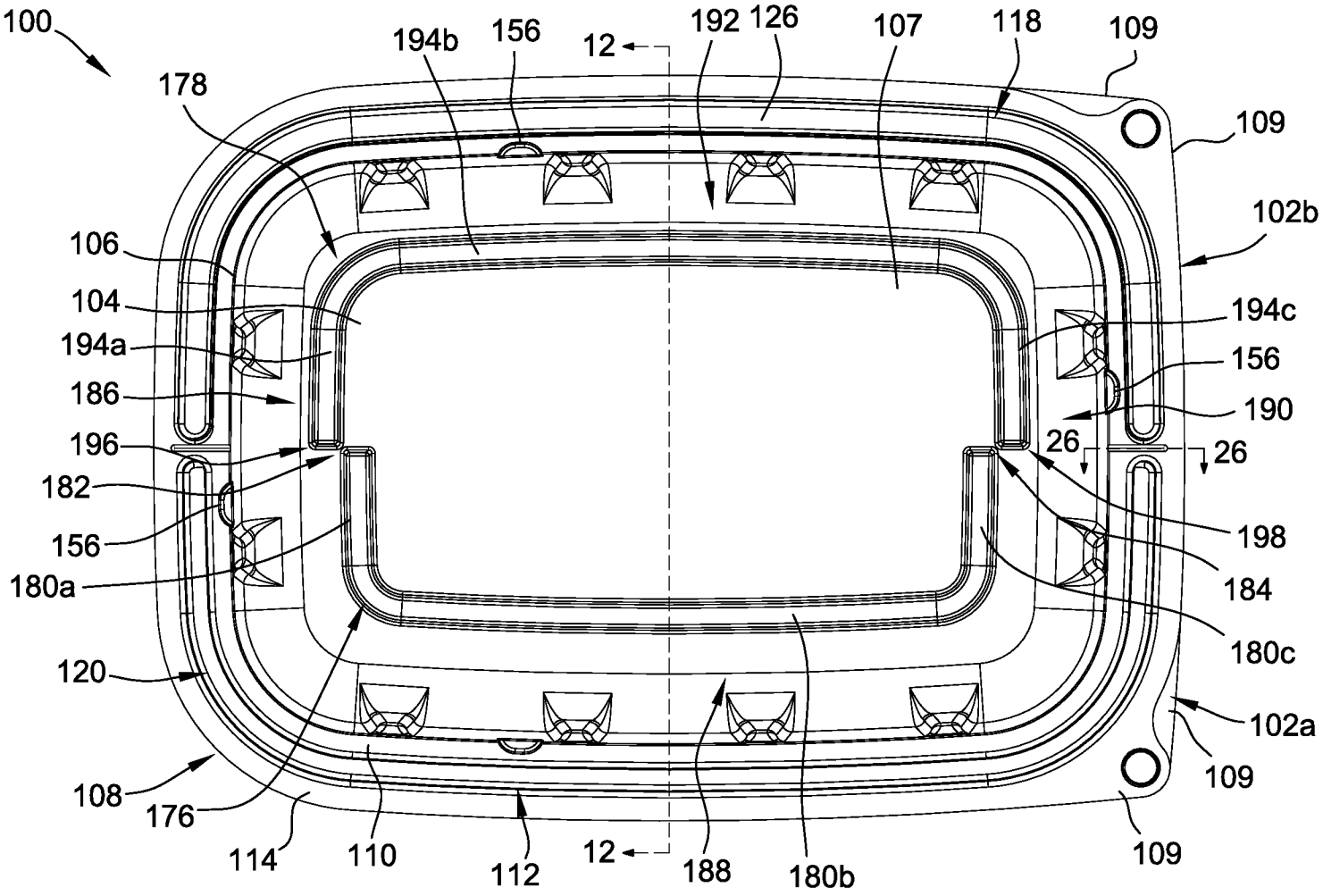
FIG. 2 is a top plan view of the container of FIG. 1.
Figure 3:
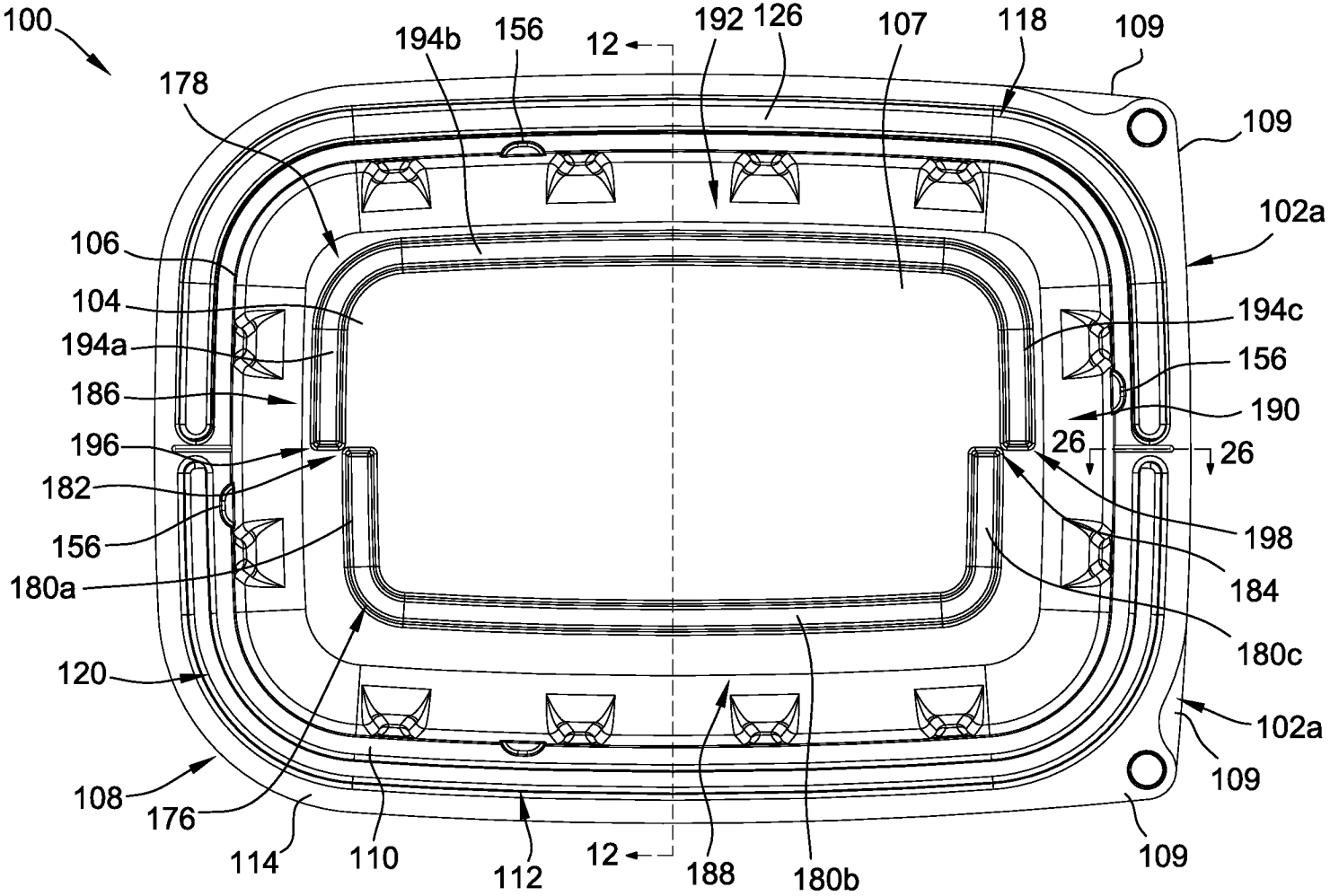
FIG. 3 is a bottom plan view of the container of FIG. 1.
Figure 4:
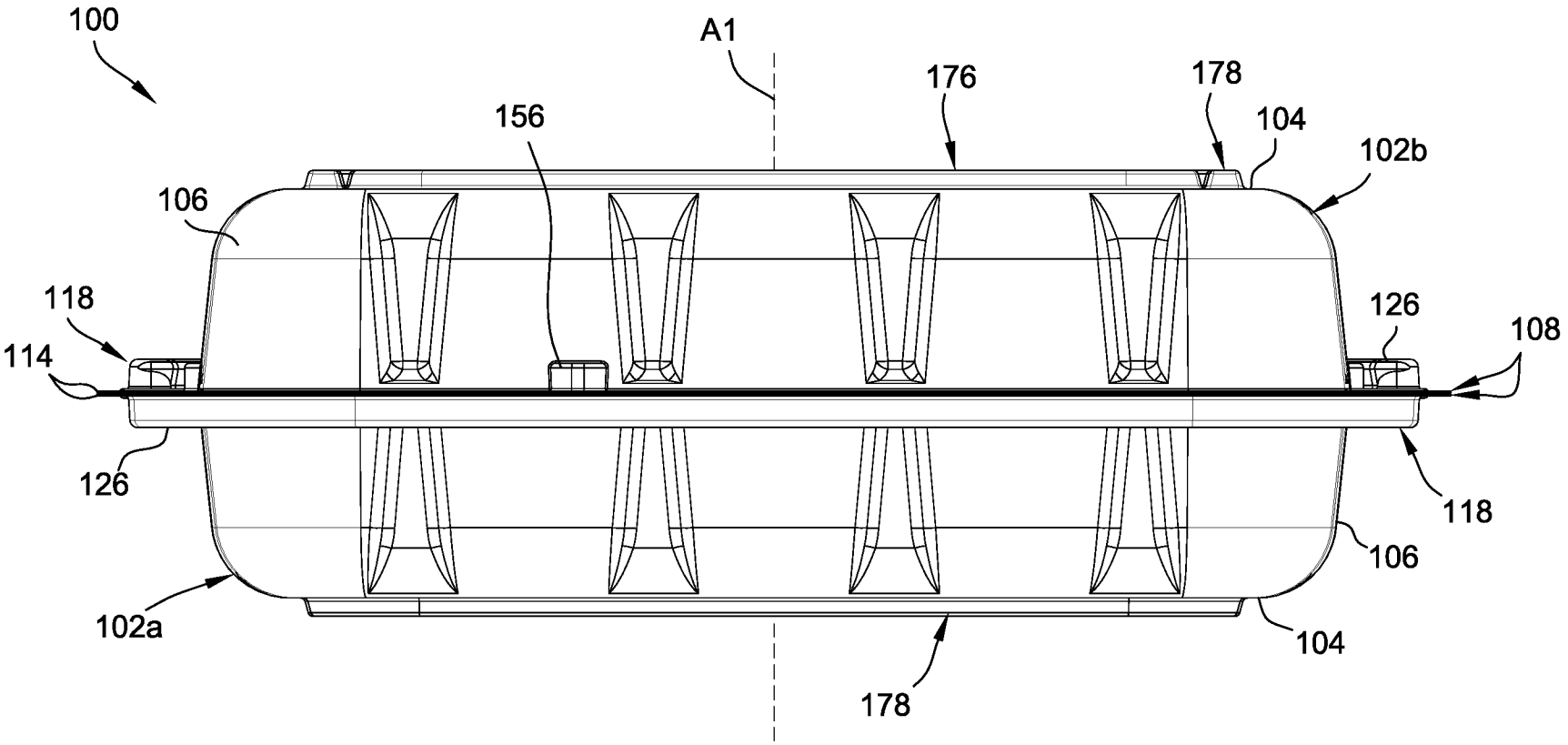
FIG. 4 is a front elevation view of the container of FIG. 1.
Figure 5:
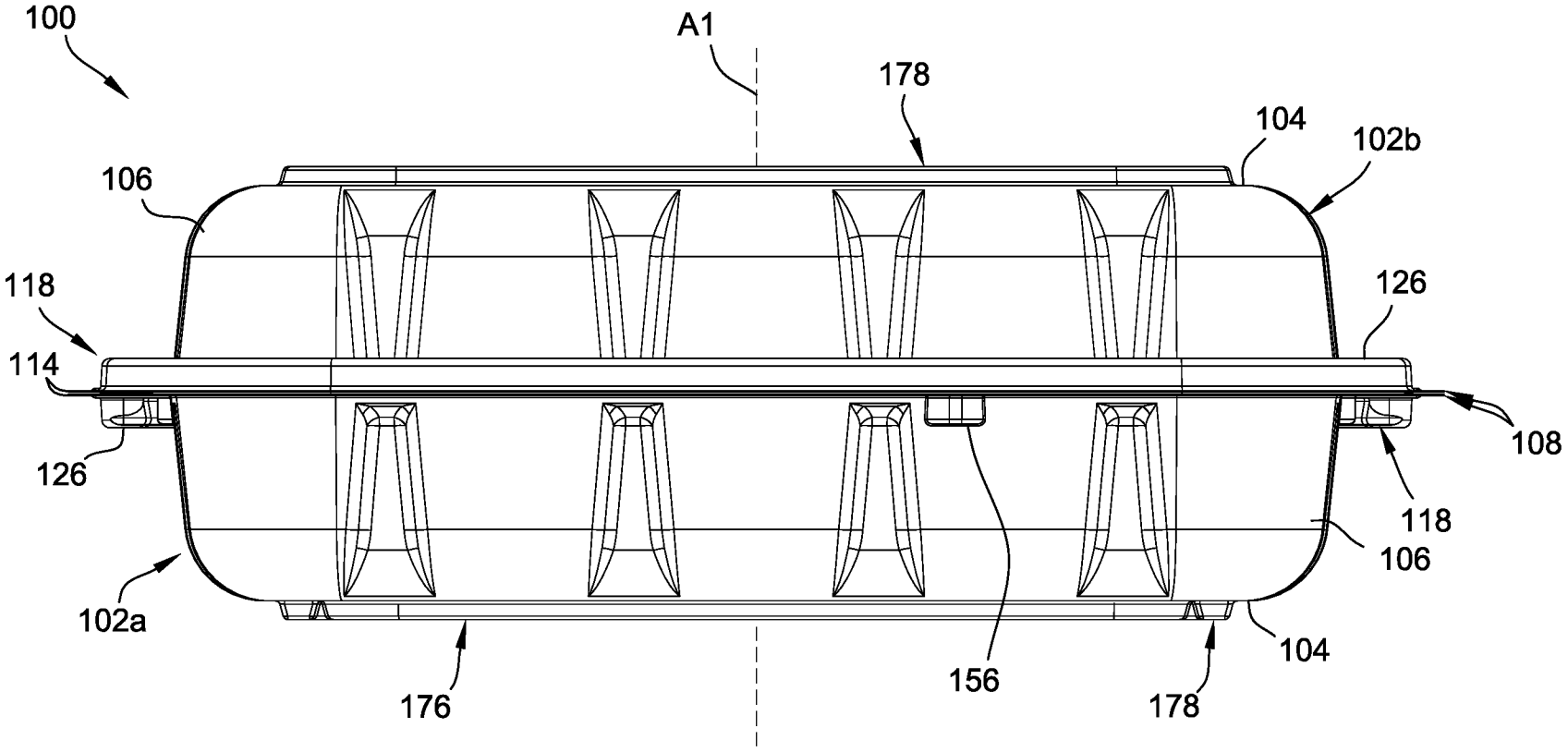
FIG. 5 is a rear elevation view of the container of FIG. 1.
Figure 6:
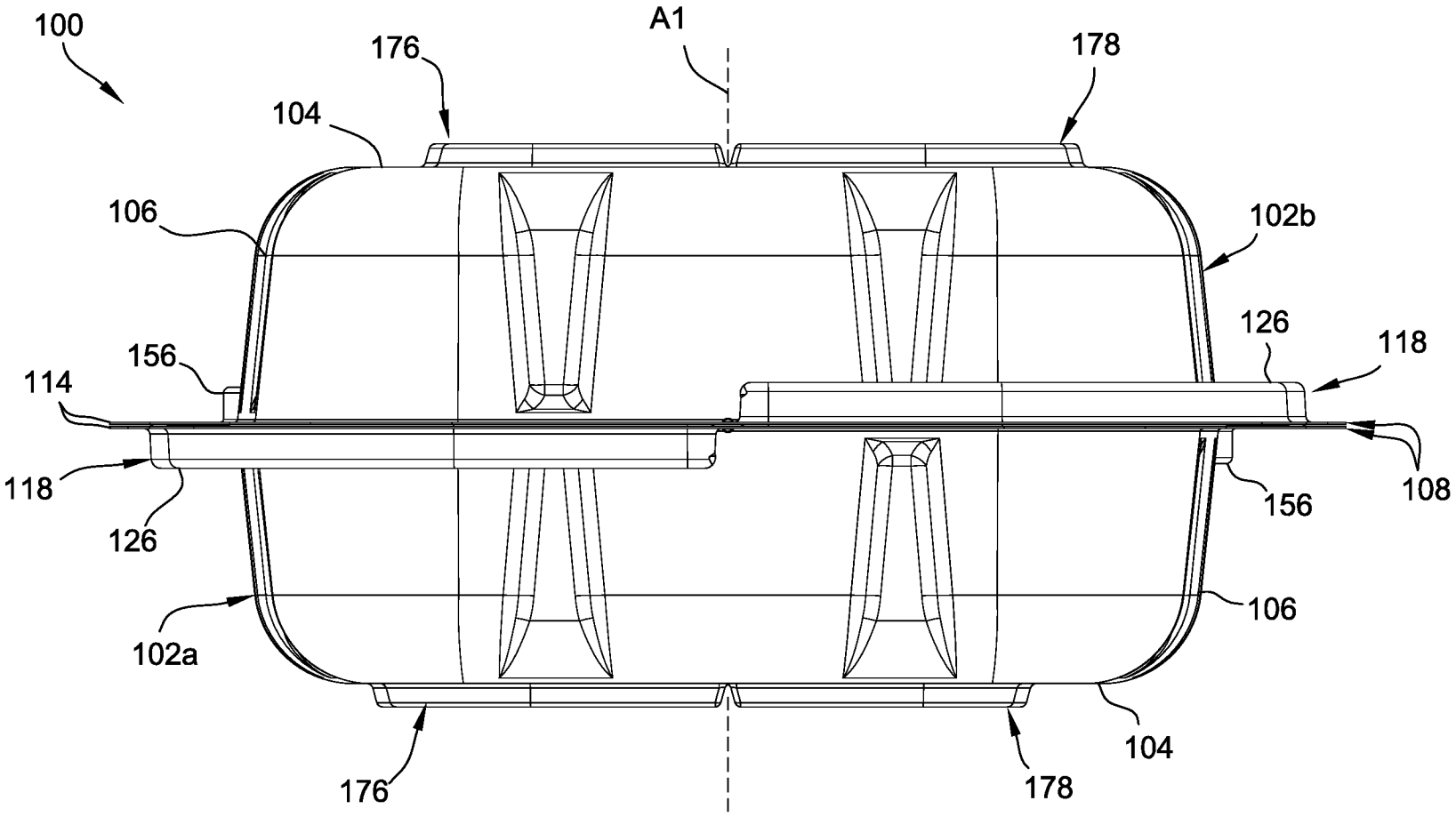
FIG. 6 is a right side elevation view of the container of FIG. 1.
Figure 7:
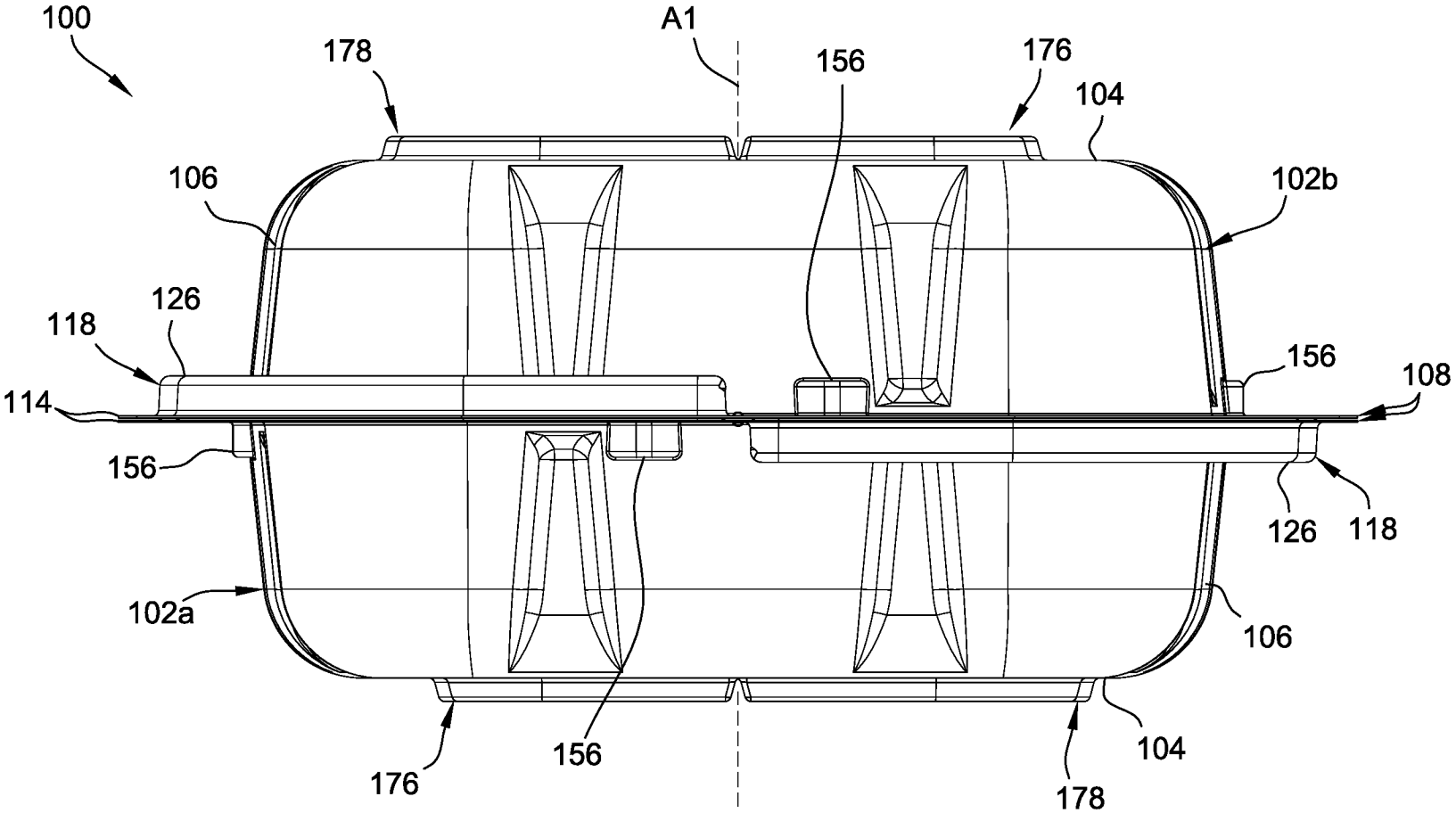
FIG. 7 is a left side elevation view of the container of FIG. 1.
Figure 8:
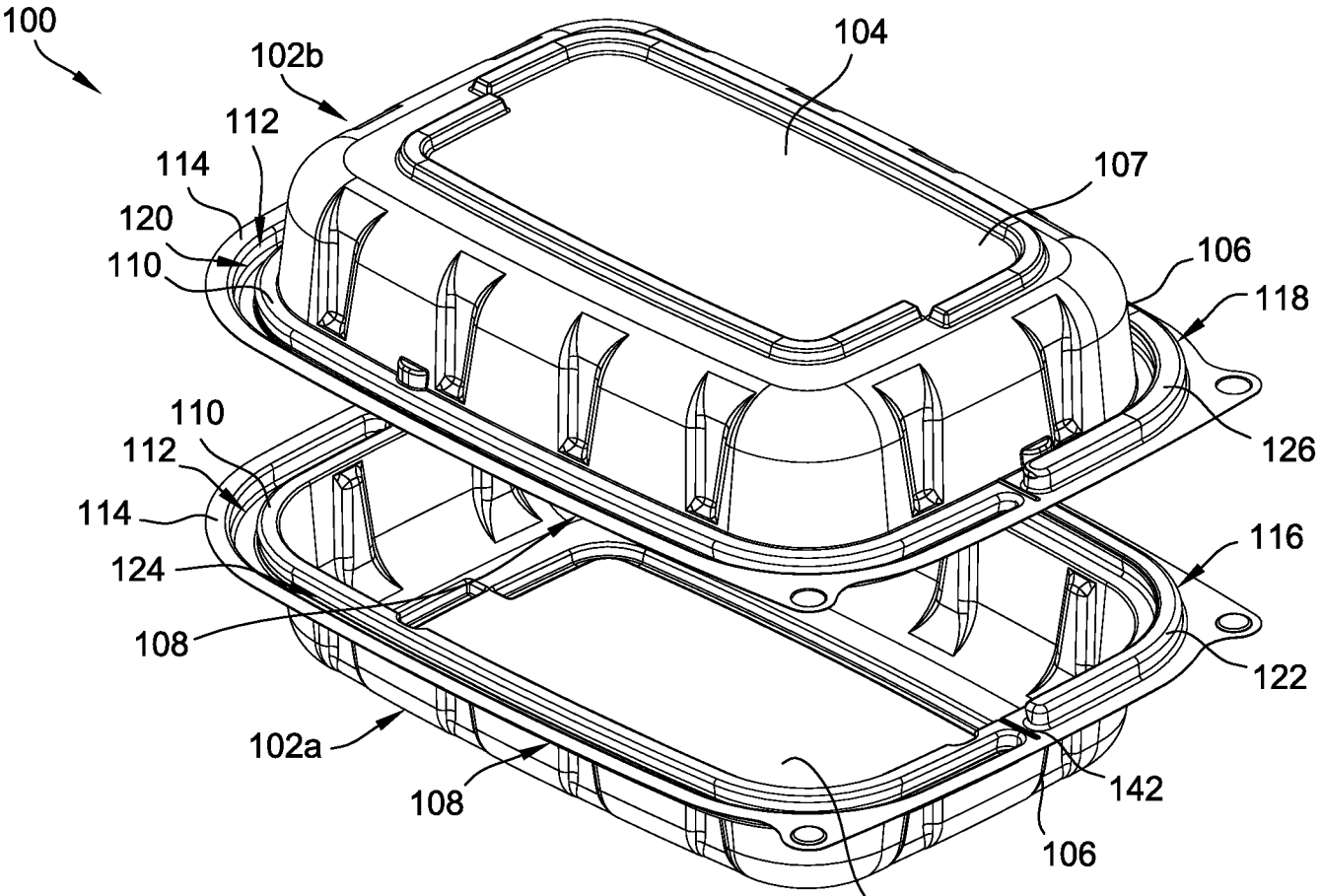
FIG. 8 is a perspective view of the container of FIG. 1 in an open configuration.

The tabs 109 may facilitate releasing the engaged trays 102*a* and 102*b* from each other to open the container 100. As shown in FIGS. 1-3, when the trays 102*a* and 102*b* are engaged to close the container 100, the tabs 109 at least partially overlap one another. Each tab 109 may include a feature 111 that facilitates separating the overlapping tabs 109 when the trays 102*a* and 102*b* are engaged. For example, the feature 111 may include an upwardly-extending button that maintains separation between the overlapping tabs 109 when the trays 102*a* and 102*b* are engaged to enable a user to peel the overlapping tabs 109 apart. Additionally and/or alternatively, the feature 111 may include a grip that is externally oriented and accessible to a user when the trays 102*a* and 102*b* are engaged to enable a user to peel the overlapping tabs 109 apart. For example, the feature 111 may include a different texture and/or material as the remainder of the tab 109 and the tray 102*a/b*.

In the illustrated example, each tab 109 of the tray 102*a/b* has a recessed portion that does not complement the recessed portion of the other tab 109. As shown in FIGS. 9-11, the tab 109 located at the intersection of the first side 164 and the end 162 has a recessed portion along the end 162, and the tab 109 located at the intersection of the second side 166 and the end 162 has a recessed portion along the second side 166. The non-complementing locations of the recessed portions of the tabs 109 are such that, when the trays 102*a* and 102*b* are engaged, the overlapping tabs 109 include offset (i.e., exposed or non-overlapping) portions (shown in FIGS. 1-3). The offset portions of the overlapping tabs 109 may enable a user to more easily peel the overlapping portions of the tabs 109 apart.

The bead segment 112 of the rim 108 of the tray 102*a/b* facilitates frictional engagement between the first tray 102*a* and the second tray 102*b* to releasably seal the container 100 in the closed configuration. The bead segment 112 includes an upwardly-extending member 116 and a downwardly-extending member 118. The upwardly-extending member 116 defines a first cavity 120 and includes an upper bead 122. The upper bead 122 is spaced above (e.g., raised relative to) the proximal segment 110 and the distal segment 114. The distance that the upper bead 122 is spaced above the proximal segment 110 and the distal segment 114 may be referred to as a height $H_1$ of the upper bead 122 (shown in FIG. 14). The downwardly-extending member 118 defines a second cavity 124 and includes a lower bead 126. The lower bead 126 is spaced below (e.g., lowered relative to) the proximal segment 110 and the distal segment 114. The distance that the lower bead 126 is spaced below the proximal segment 110 and the distal segment 114 may be referred to as a height $H_2$ of the lower bead 126 (shown in FIG. 15).

The upwardly-extending member 116 and the downwardly-extending member 118 of the tray 102*a/b* each extend along the bead segment 112 of the rim 108 to envelop a substantial portion of the proximal segment 110. The upwardly-extending member 116 and the downwardly-extending member 118 may each have a substantially constant dimension or cross-sectional profile along their respective extent. For example, the height $H_1$ of the upper bead 122 may be substantially constant across the extent of the upwardly-extending member 116 along the rim 108 and the height $H_2$ of the upper bead 126 may be substantially constant across the extent of the downwardly-extending member 118 along the rim 108. A radial distance (or thickness) profile of each of the upwardly-extending member 116 and the downwardly-extending member 118 may also be substantially constant across their respective extent along the rim 108. The upwardly-extending member 116 extends along the rim 108 to envelop a first portion 128 of the proximal segment 110 and the downwardly-extending member 118 extends along the rim 108 to envelop a second portion 130 of the proximal segment 110. Suitably, the upwardly extending-member 116 and the downwardly-extending member 118 extend along the bead segment 112 of the rim 108 an approximately equal distance such that the first portion 128 and the second portion 130 of the proximal segment 110 are approximately the same distance along the rim 108. In some examples, the upwardly-extending member 116 and the downwardly-extending member 118 extend different distances along the bead segment 112, such that the first portion 128 has a greater distance than the second portion 130 of the proximal segment 110, or the second portion 130 has a greater distance than the first portion 128 of the proximal segment 110.

The upwardly-extending member 116 extends between a first end 132 and a second end 134. The downwardly-extending member 118 extends between a first end 136 and a second end 138. In the illustrated example, the first end 132 of the upwardly-extending member 116 is located proximate the second end 138 of the downwardly-extending member 118 at a first end 160 of the tray 102*a/b*, and the second end 134 of the upwardly-extending member 116 is located proximate the first end 136 of the downwardly-extending member 118 at a second end 162 of the tray 102*a/b*. The upwardly-extending member 116 may terminate in extent at the first end 132 prior to reaching the second end 138 of the downwardly-extending member 118, such that a gap is defined therebetween. Similarly, the upwardly-extending member 116 may terminate in extent at the second end 134 prior to reaching the first end 136 of the downwardly-extending member 118, such that a gap is defined therebetween. The bead segment 112 may be substantially flat or planar at the gap between the first end 132 of the upwardly-extending member 116 and the second end 138 of the downwardly-extending member 118, and at the gap between the second end 134 of the upwardly-extending member 116 and the first end 136 of the downwardly-extending member 118. Alternatively, as described in more detail below, a vent channel 142 may be defined in the bead segment 112 at the gaps between the first end 132 of the upwardly-extending member 116 and the second end 138 of the downwardly-extending member 118 and between the second end 134 of the upwardly-extending member 116 and the first end 136 of the downwardly-extending member 118. In other examples, the first end 132 of the upwardly-extending member 116 may be located adjacent the second end 138 of the downwardly-extending member 118, such that no gap is defined therebetween. Additionally and/or alternatively, the second end 134 of the upwardly-extending member 116 may be located adjacent the first end 136 of the downwardly-extending member 118, such that no gap is defined therebetween.

The distance defined by the gaps between the ends of the upwardly-extending member 116 and the downwardly-extending member 118 may vary depending on the distance that the upwardly-extending member 116 and the downwardly-extending member 118 extend along the bead segment 112 of the rim 108. In the illustrated example, the upwardly-extending member 116 and the downwardly-extending member 118 each extend along approximately half of the distance of the bead segment 112, forming complementing U-shapes as shown in FIGS. 10 and 11 for example. The gaps between the ends of the upwardly-extending member 116 and the downwardly-extending member 118 are relatively short in distance in this example. In other examples, the upwardly-extending member 116 and/or the downwardly-extending member 118 may extend a relatively smaller distance than the illustrated example, such that the gaps between the ends of the upwardly-extending member 116 and the downwardly-extending member 118 are relatively longer in distance. For example, the upwardly-extending member 116 and the downwardly-extending member 118 may each extend across the opposite sides 164 and 166 of the tray 102*a/b*, respectively, and the gaps extend substantially across the opposite ends 160 and 162 of the tray 102*a/b*.

In the illustrated example, the upwardly-extending member 116 extends continuously (e.g., uninterrupted) between the first end 132 and the second end 134, and the downwardly-extending member 118 extends continuously (e.g., uninterrupted) between the first end 136 and the second end 138. Alternatively stated, the dimension or cross-sectional profile (e.g., the height $H_1$ of the upper bead 122) is substantially constant as the upwardly-extending member 116 extends between the first end 132 and the second end 134, and the dimension or cross-sectional profile (e.g., the height $H_2$ of the lower bead 126) is substantially constant as the downwardly-extending member 118 extends between the first end 136 and the second end 138. In other examples, the upwardly-extending member 116 and the downwardly-extending member 118 may include discontinuities along their respective extents. The discontinuities in the upwardly-extending member 116 and the downwardly-extending member 118 may be locations where the upper bead 122 and the lower bead 126, respectively, are spaced at relatively greater or smaller distances from the proximal segment 110 and the distal segment 112, such that the respective heights $H_1$ and $H_2$ are taller or shorter at these locations. The discontinuities may additionally and/or alternatively be discrete locations along the bead segment 112 where the upwardly-extending member 116 and the downwardly-extending member 118 temporarily terminate in extent and the bead segment 112 is substantially flat or planar. In examples where such discontinuities exist, the discontinuities in the upwardly-extending member 116 may suitably complement the discontinuities in the downwardly-extending member 118 to enable sealing engagement between the upwardly-extending member 116 and the downwardly-extending member 118. Alternatively, discontinuities may exist that provide spacing between the upwardly-extending member 116 and the downwardly-extending member 118, such as where vent channels 142 extend at least partially across a radial extent of the upwardly-extending member 116 and/or downwardly-extending member 118, described in further detail below.

As shown in FIGS. 1-8, the second tray 102*b* is inverted (e.g., rotated 180°) relative to the first tray 102*a* to enable engagement between the trays 102*a* and 102*b*. FIG. 12 depicts engagement between the trays 102*a* and 102*b* to close the container 100 in greater detail. As shown, the second cavity 124 and the upwardly-extending member 116 are suitably sized and shaped such that, when the first tray 102*a* engages the inverted second tray 102*b*, the upwardly-extending member 116 of the bead segment 112 of the first tray 102*a* is received in the second cavity 124 of the bead segment 112 of the second tray 102*b*, and the upwardly-extending member 116 of the bead segment 112 of the second tray 102*b* is received in the second cavity 124 of the bead segment 112 of the first tray 102*a*. When the first tray 102*a* engages the inverted second tray 102*b*, the upwardly-extending member 116 of the first tray 102*a* engages the downwardly-extending member 118 of the second tray 102*b* in the second cavity 124 of the second tray by friction, and the upwardly extending member 116 of the second tray 102*b* engages the downwardly-extending member 118 of the first tray 102*a* in the second cavity 124 of the first tray by friction. The frictional engagement between the upwardly-extending members 116 and the downwardly-extending members 118 when the trays 102*a* and 102*b* are engaged is suitably sufficient to maintain the container 100 in the closed configuration, while enabling the trays 102*a* and 102*b* to be released from each other to open the container when desired by application of an external force (e.g., a pulling force) on one or both of the trays 102*a* and 102*b*.

Figure 13:
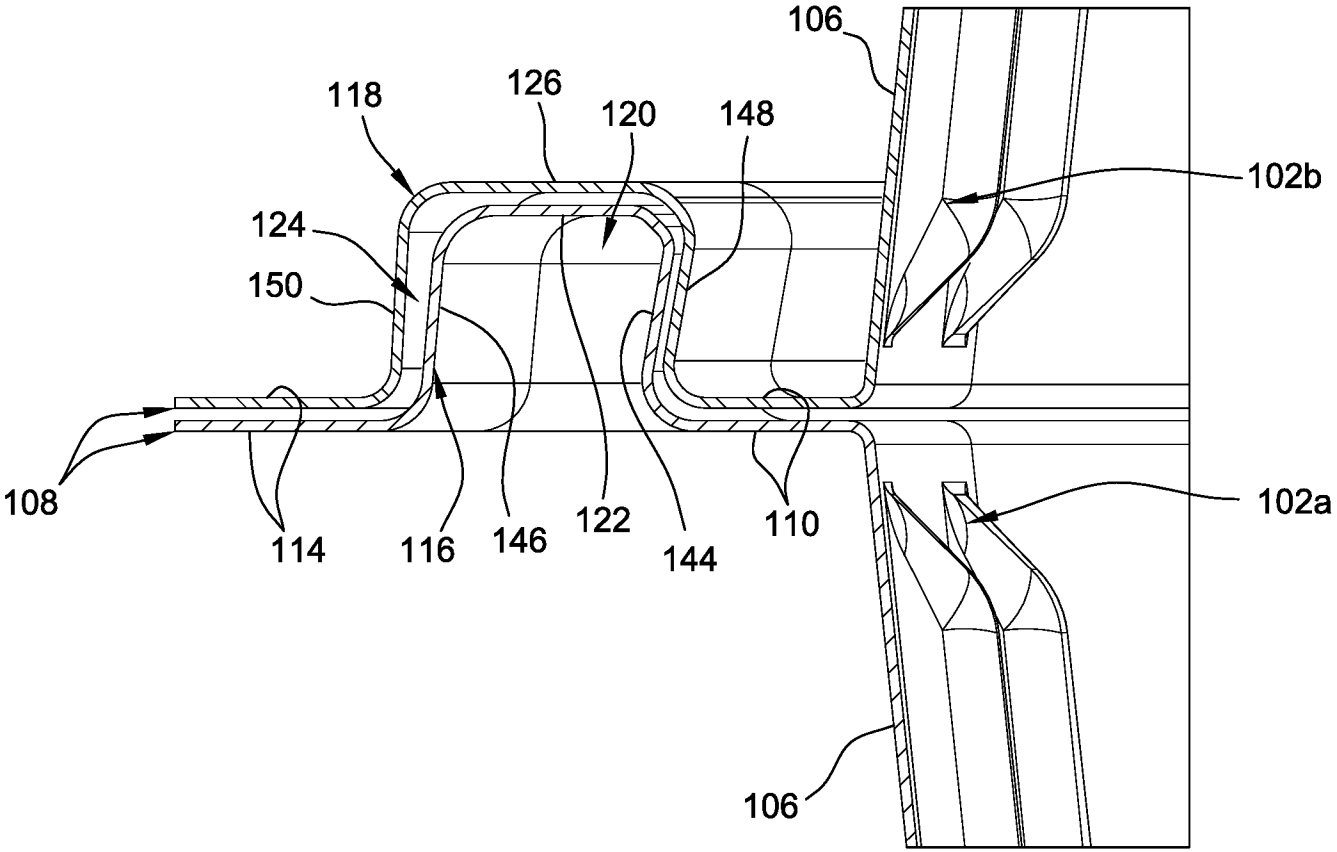
FIG. 13 is a magnified view of section $C_{13}$ in FIG. 12.
Figure 14:
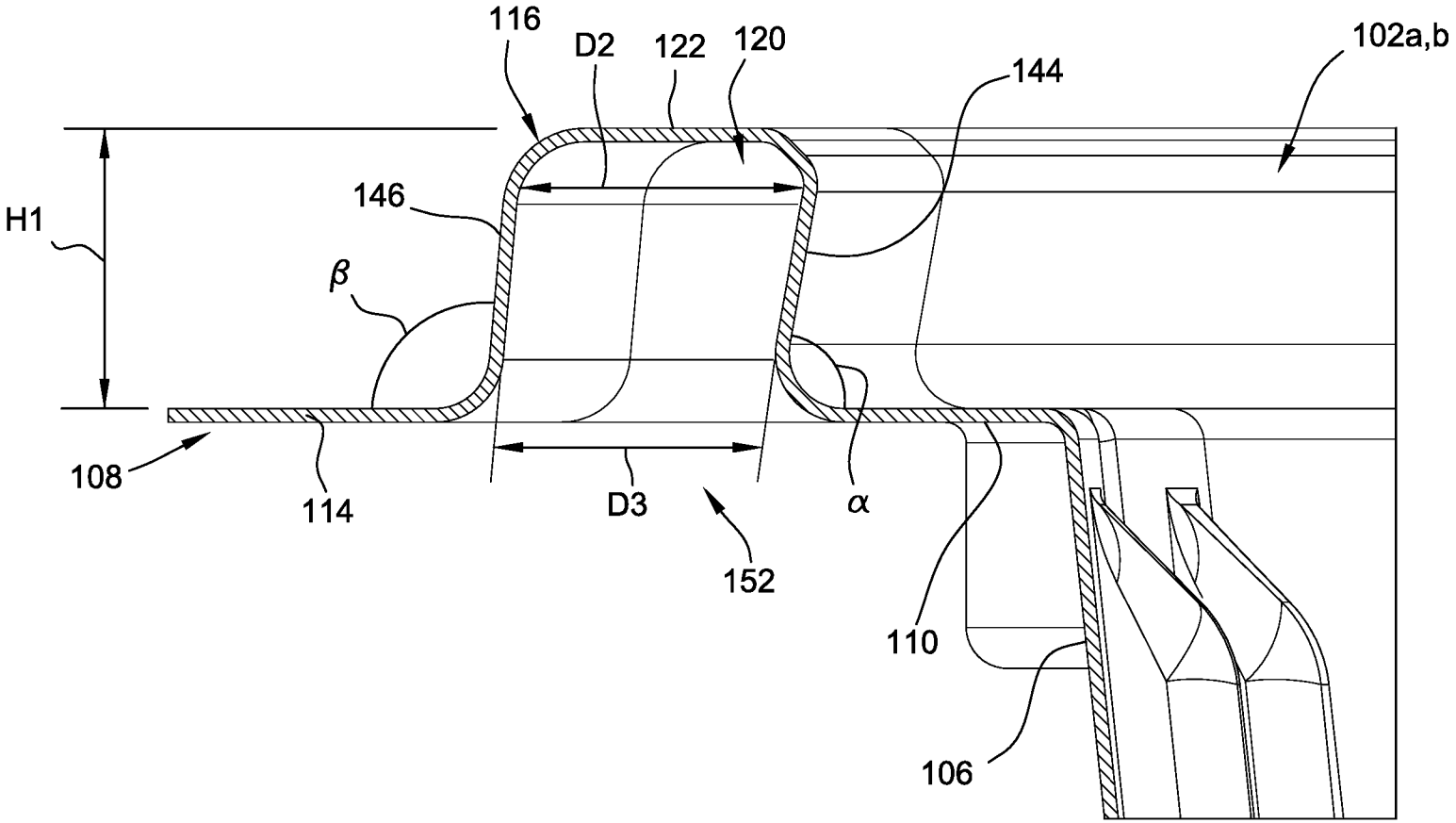
FIG. 14 is a cross-section of a rim of the tray of FIGS. 9-11, taken along line 14-14 in FIGS. 10 and 11.
Figure 15:
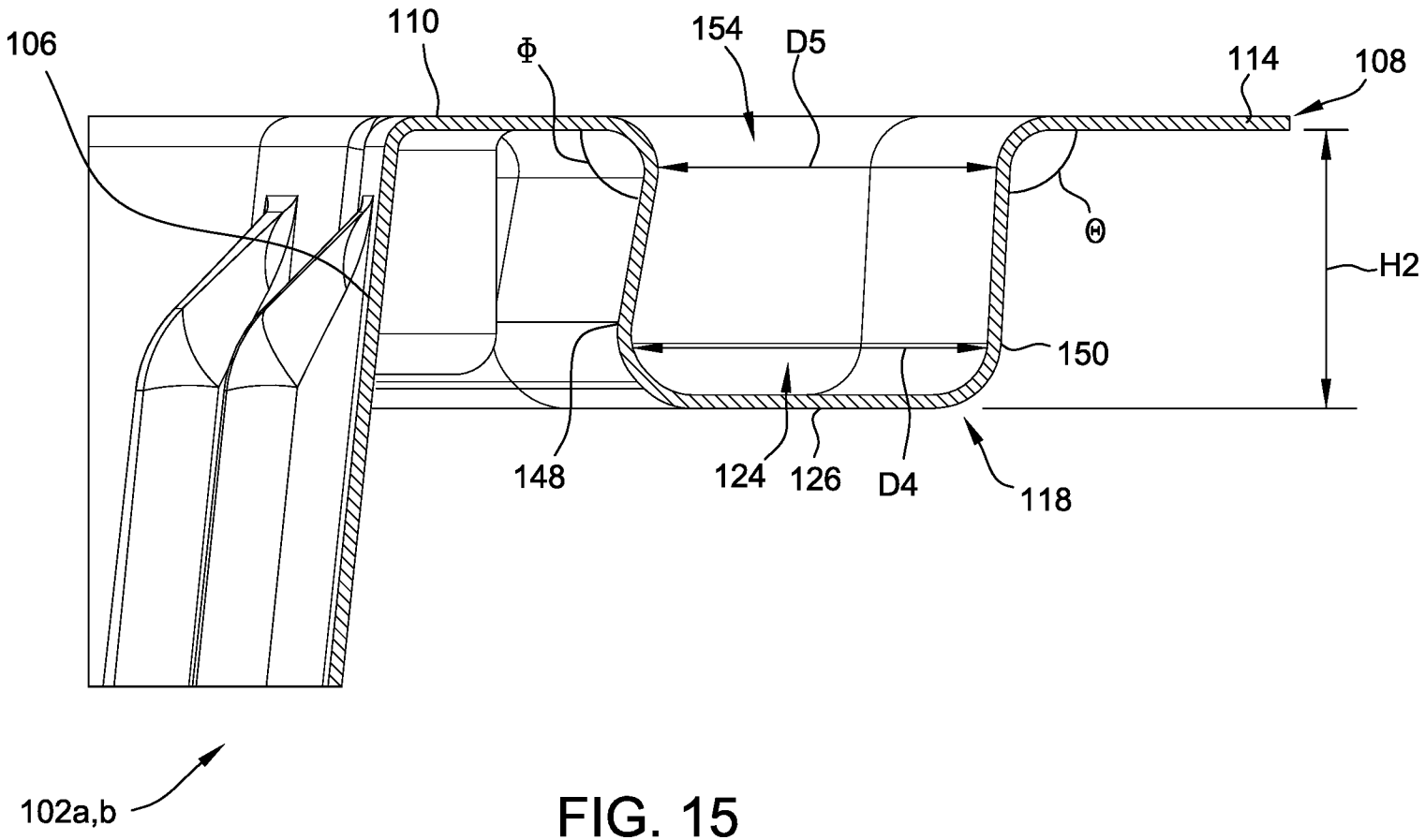
FIG. 15 is another cross-section of the rim of the tray of FIGS. 9-11, taken along line 15-15 in FIGS. 10 and 11.
Figure 16:
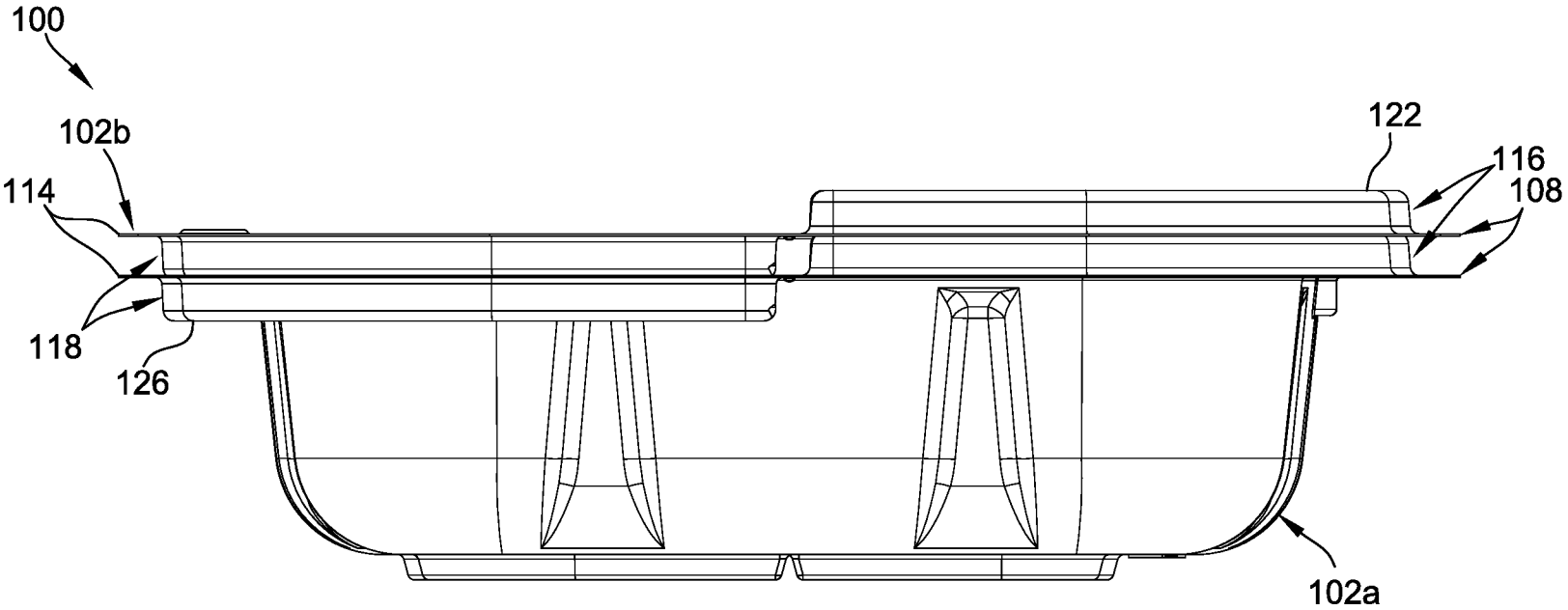
FIG. 16 is a right side elevation view of the container of FIGS. 1-8, with the trays of the container stacked in a same orientation.
Figure 17:
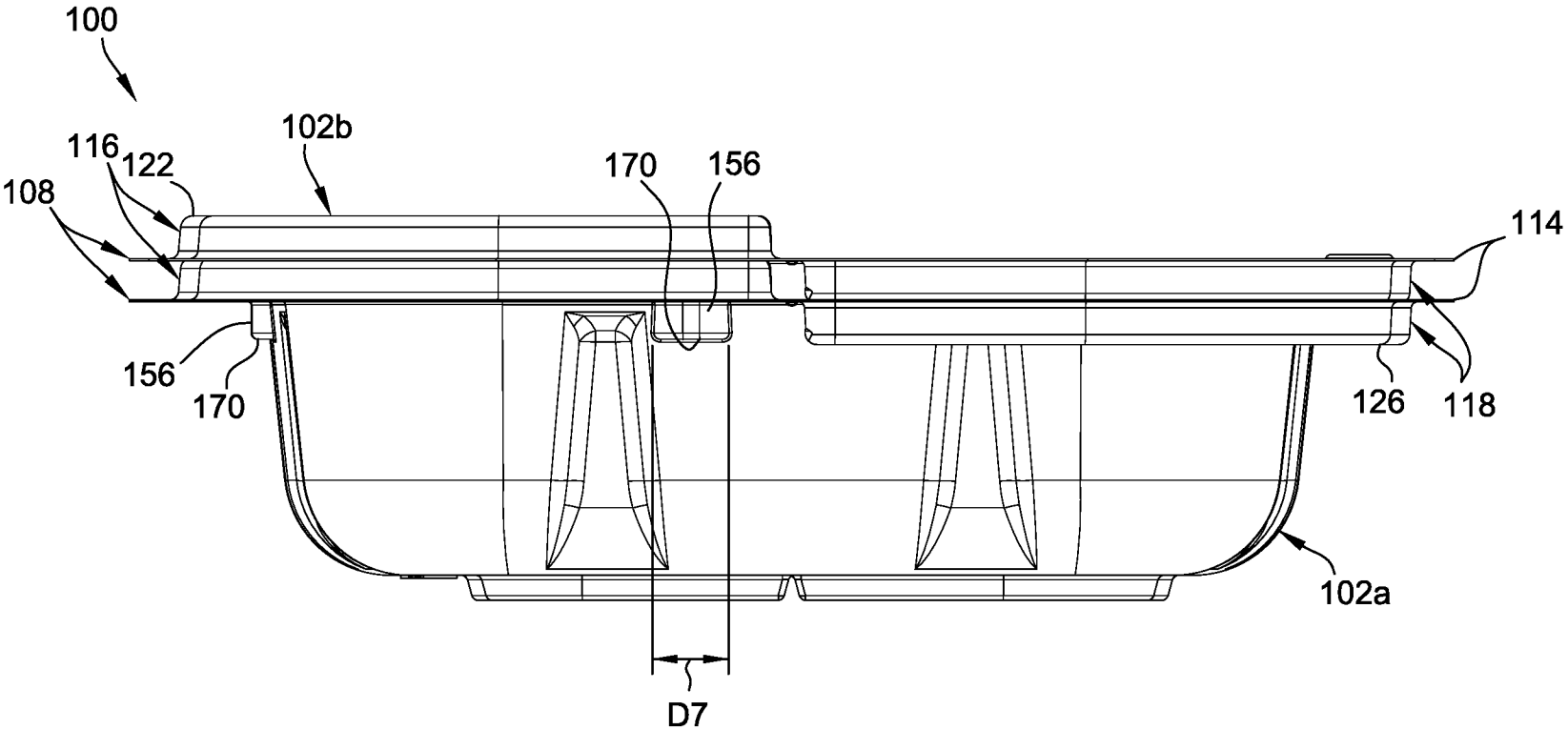
FIG. 17 is a right side elevation view of the trays of the container stacked in the same orientation.
Figure 18:
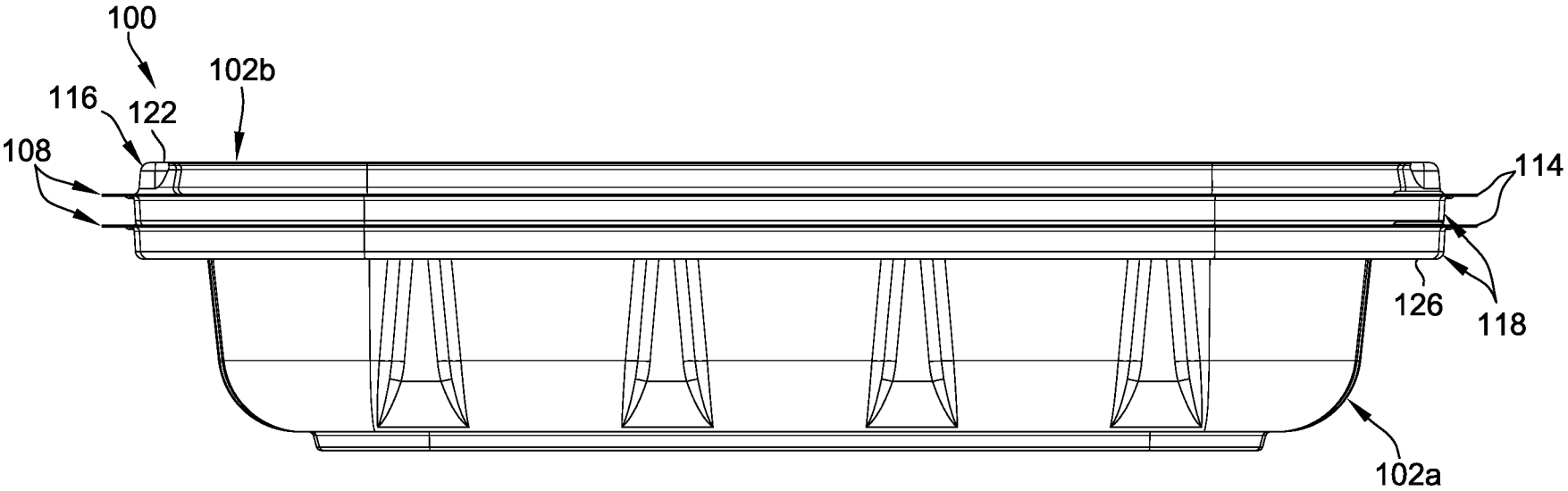
FIG. 18 is a front elevation view of the trays of the container stacked in the same orientation.
Figure 19:
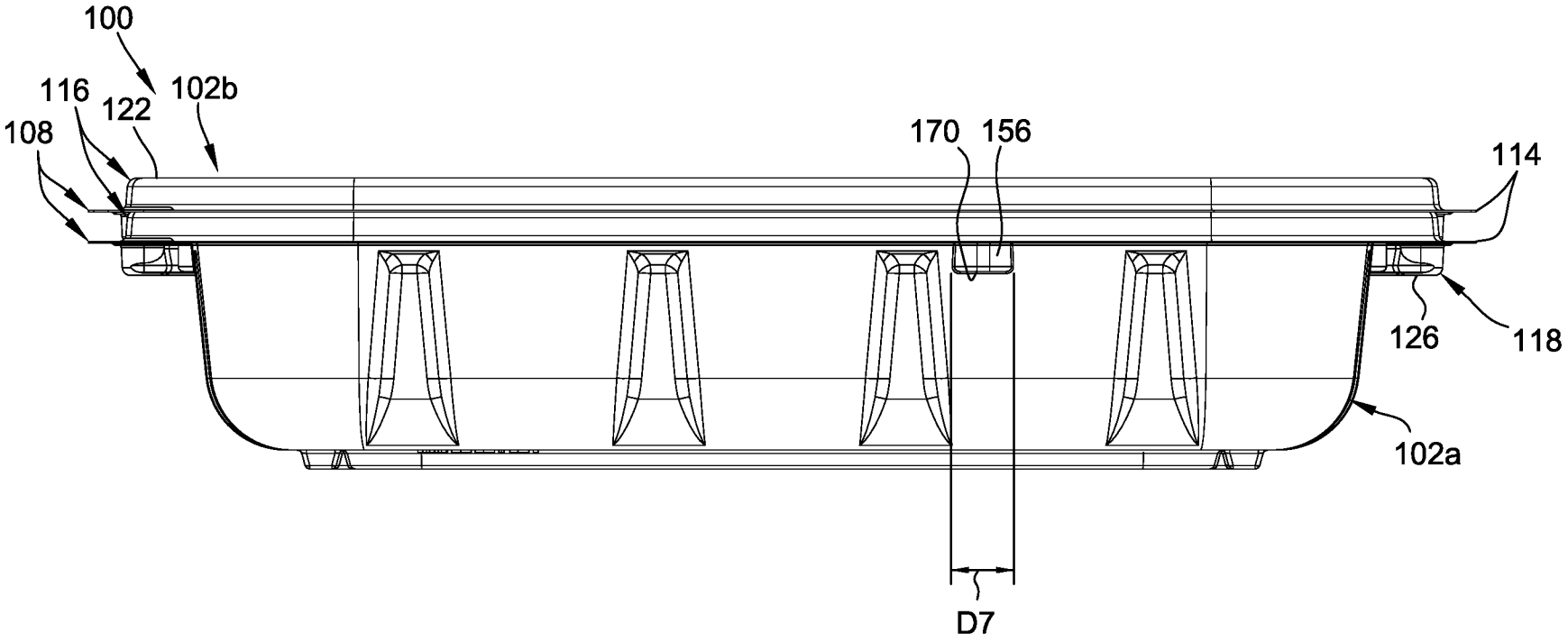
FIG. 19 is a rear elevation view of the trays of the container stacked in the same orientation.

Reference will now be made to FIGS. 13-15, which depict the cross-sectional profiles of the upwardly-extending member 116 and the downwardly-extending member 118 of the tray 102*a/b* in greater detail. FIG. 13 is a magnified view of section $C_{13}$ in FIG. 12, and depicts, in greater detail, the engagement between the upwardly-extending member 116 of the first tray 102*a* and the downwardly-extending member 118 of the inverted second tray 102*b* in the second cavity 124 of the second tray when the trays 102*a* and 102*b* are engaged. FIG. 14 is a cross-section of the rim 108 of the tray 102*a/b*, taken along line 14-14 in FIGS. 10 and 11, and depicts a cross-sectional profile of the upwardly-extending member 116 of the bead segment 112. FIG. 15 is a cross-section of the rim 108 of the tray 102*a/b*, taken along line 15-15 in FIGS. 10 and 11, and depicts a cross-sectional profile of the downwardly-extending member 118 of the bead segment 112. The cross-sectional profiles of the upwardly-extending member 116 and the downwardly-extending member 118 shown in FIGS. 14 and 15 are substantially constant across their respective extent in this example. The details of the engagement between the upwardly-extending member 116 of the first tray 102*a* and the downwardly-extending member 118 of the second tray 102*b* shown in and described with reference to FIG. 13 are equally applicable to the engagement between the upwardly-extending member 116 of the second tray 102*b* and the downwardly-extending member 118 of the first tray 102*a* in the second cavity 124 of the first tray when the trays 102*a* and 102*b* are engaged.

As shown in FIGS. 13 and 14, the upwardly-extending member 116 includes a first inner wall 144 and a first outer wall 146. The first inner wall 144 extends upwardly from the proximal segment 110 to the upper bead 122. The first outer wall 146 extends downwardly from the upper bead 122 to the distal segment 114. The first inner wall 144, the upper bead 122, and the first outer wall 146 define the first cavity 120. A maximum radial distance $D_2$ between the first inner wall 144 and the first outer wall 146 is defined proximate the upper bead 122. An opening 152 to the first cavity 120 is defined opposite the upper bead 122 between the first inner wall 144 and the first outer wall 146. A minimum radial distance $D_3$ between the first inner wall 144 and the first outer wall 146 is defined proximate the opening 152. The maximum radial distance $D_2$ defined proximate the upper bead 122 is suitably greater than the minimum radial distance $D_3$ defined proximate the opening 152 to facilitate denesting of the first tray 102*a* and the second tray 102*b* when the trays are stacked in a same orientation, described below.

The upper bead 122 is spaced above the proximal segment 110 and the distal segment 114 at the height $H_1$. In the illustrated example, the proximal segment 110 and the distal segment are each flat and substantially co-planar. As such, the first inner wall 144 extends upwardly from the proximal segment 110 to the height $H_1$ of the upper bead 122 approximately the same distance that the first outer wall 146 extends downwardly from the height $H_1$ of the upper bead 122 to the distal segment 114. In other examples, the proximal segment 110 may be raised or lowered relative to the distal segment 114, such that the proximal segment 110 and the distal segment 114 are not co-planar and the first inner wall 144 and the first outer wall 146 extend different distances. In these examples, the height $H_1$ of the upper bead 122 may be measured as the shorter of the distances that the upper bead is spaced above the proximal segment 110 and the distal segment 114. In some examples, the proximal segment 110 and/or the distal segment 114 may not be flat or planar, and the height $H_1$ of the upper bead 122 may also be suitably described relative to an imaginary horizontal plane that extends across the rim 108 in these examples.

The first inner wall 144 of the upwardly-extending member 116 extends upwardly from the proximal segment 110 to the upper bead 122 at an angle $\alpha$, relative to the flat or planar proximal segment 110. The first outer wall 146 extends downwardly from the upper bead 122 to the distal segment 114 at an angle $\beta$, relative to the flat or planar distal segment 114. The angles $\alpha$, $\beta$ will be described herein relative to the planar extent of the proximal segment 110 and the distal segment 114, but in some examples the proximal segment and/or the distal segment may not be planar (or flat). The angles $\alpha$, $\beta$ may also suitably be described relative to an imaginary horizontal plane that extends across the rim 108. In the illustrated embodiment, the angle $\alpha$ is an oblique angle, such that the first inner wall 144 extends toward the sidewall 106 as the first inner wall 144 extends upwardly to the upper bead 122. The angle $\beta$ may be approximately 90° such that the first outer wall 146 extends substantially vertically between the upper bead 122 and the distal segment 114. As such, the distance between the first inner wall 144 and the first outer wall 146 tapers from the maximum radial distance $D_2$ defined proximate the upper bead 122 to the minimum radial distance $D_3$ defined proximate the opening 152. In other examples, the angle $\alpha$ may be approximately 90°, such that the first inner wall 144 extends substantially vertically, and the angle $\beta$ may be an oblique angle, such that the first outer wall 146 extends toward the sidewall 106 as the first outer wall 146 extends downwardly from the upper bead 122 and such that the distance between the first inner wall 144 and the first outer wall 146 tapers from the maximum radial distance $D_2$ defined proximate the upper bead 122 to the minimum radial distance $D_3$ defined proximate the opening 152.

In some examples, the angles $\alpha$, $\beta$ may each be oblique angles. For example, the angles $\alpha$, $\beta$ may each be acute angles or one of the angles $\alpha$, $\beta$ may be an acute angle while one of the angles $\alpha$, $\beta$ is an obtuse angle. In one example, the angle $\alpha$ may be an acute angle, such that the first inner wall 144 extends toward the sidewall 106 as the first inner wall 144 extends upwardly to the upper bead 122, and the angle $\beta$ may be an acute angle, such that the first outer wall 146 extends toward the sidewall 106 as the first outer wall 146 extends downwardly from the upper bead 122. In an alternative example, the angle $\beta$ may be an obtuse angle slightly greater than 90°, such that the first outer wall 146 extends away from the sidewall 106 as the first outer wall 146 extends downwardly from the upper bead 122, and the angle $\alpha$ may be an acute angle. In another example, the angle $\beta$ may be an acute angle and the angle $\alpha$ may be an obtuse angle, such that the first inner wall 144 extends away from the sidewall 106 as the first inner wall extends upwardly to the upper bead 122. Suitably, in examples where one of the angles α, β is an acute angle while one of the angles α, β is an obtuse angle, the angle that is acute has a greater deviation from 90° than the angle that is obtuse, such that the maximum radial distance $D_2$ is defined proximate the upper bead 122.

The angle α and/or β may be any suitable acute angle such that the maximum radial distance $D_2$ is defined proximate the upper bead 122. For example, the oblique angle α and/or β may be between 1° to 60°, such as between 1° to 50°, between 1° to 45°, between 1° to 30°, between 1° to 20°, between 1° to 10°, between 5° to 60°, between 5° to 50°, between 5° to 45°, between 5° to 30°, between 5° to 20°, between 5° to 10°, between 10° to 60°, between 10° to 50°, between 10° to 45°, between 10° to 30°, between 10° to 20°, between 20° to 60°, between 20° to 50°, between 20° to 40°, between 20° to 30°, between 30° to 60°, between 30° to 50°, between 30° to 40°, between 40° to 60°, between 40° to 50°, or between 50° to 60°. In various examples, the oblique angle α and/or β may be about 5°, about 10°, about 15°, about 20°, about 25°, about 30°, about 35°, about 40°, about 45°, about 50°, about 55°, or about 60°. In some examples, the oblique angle α and/or β may be an acute angle that is greater than 60°.

As described above, in some examples, one of the angles α, β may be an acute angle while one of the angles α, β is an obtuse angle. In these examples, the acute angle α or β may suitably be selected from the ranges and example acute angle values described above. The obtuse angle α or β may be between greater than 90° to 110°, such as greater than 90° to 105°, greater than 90° to 100°, greater than 90° to 95°, from 95° to 110°, from 95° to 105°, from 95° to 100°, from 100° to 110°, from 100° to 105°, or from 105° to 110°. In various examples, the obtuse angle α or β may be greater than 90°, such as about 95°, about 100°, about 105°, or about 110°. The obtuse angle α or β may be any suitable value with the proviso that the angle α or β that is acute has a greater deviation from 90° than the angle α or β that is obtuse, such that the maximum radial distance $D_2$ is defined proximate the upper bead 122.

As shown in FIG. 14, the upwardly-extending member 116 may have radius edges at the intersections between the proximal segment 110 and the first inner wall 144 and/or between the distal segment 114 and the first outer wall 146, which may provide a minimal (e.g., negligible) increase in distance from the minimum radial distance $D_3$ immediately adjacent the opening 152. The upper bead 122 may also have radius edges adjacent the first inner wall 144 and/or the first outer wall 146, which may provide a minimal decrease in distance from the maximum radial distance $D_2$ immediately adjacent the upper bead 122. In other examples, the intersection between the proximal segment 110 and the first inner wall 144 and/or the intersection between the distal segment 114 and the first outer wall 146 may be substantially angular. Additionally and/or alternatively, the upper bead 122 may have angular edges adjacent the first inner wall 144 and/or the first outer wall 146.

As shown in FIGS. 13 and 15, the downwardly-extending member 118 includes a second inner wall 148 and a second outer wall 150. The tray 102*b* is inverted for engagement with the tray 102*a* in FIG. 13, and thus the downwardly-extending member 118 is shown inverted between FIGS. 13 and 15. The downwardly-extending member 118 will be described relative to the orientation shown in FIG. 15. Directional terms are not limiting with regard to a particular orientation of the tray 102*a/b* and the elements and features described herein. The second inner wall 148 extends downwardly from the proximal segment 110 to the lower bead 126. The second outer wall 150 extends upwardly from the lower bead 126 to the distal segment 114. The second inner wall 148, the lower bead 126, and the second outer wall 150 define the second cavity 124. A maximum radial distance $D_4$ between the second inner wall 148 and the second outer wall 150 is defined proximate the lower bead 126. An opening 154 to the second cavity 124 is defined opposite the lower bead 126 between the second inner wall 148 and the second outer wall 150. A minimum radial distance $D_5$ between the second inner wall 148 and the second outer wall 150 is defined proximate the opening 154. The maximum radial distance $D_4$ defined proximate the lower bead 126 is suitably greater than the minimum radial distance $D_5$ defined proximate the opening 154 to facilitate denesting of the first tray 102*a* and the second tray 102*b* when the trays are stacked in a same orientation, described below.

The lower bead 126 is below above the proximal segment 110 and the distal segment 114 at the height $H_2$. In the illustrated example, the proximal segment 110 and the distal segment are each flat and substantially co-planar. As such, the second inner wall 148 extends downwardly from the proximal segment 110 to the height $H_2$ of the lower bead 126 approximately the same distance that the second outer wall 150 extends upwardly from the height $H_2$ of the lower bead 126 to the distal segment 114. In other examples, the proximal segment 110 may be raised relative to or lowered relative to the distal segment 114, such that the proximal segment 110 and the distal segment 114 are not co-planar and the second inner wall 148 and the second outer wall 150 extend different distances. In these examples, the height $H_2$ of the lower bead 126 may be measured as the shorter of the distances that the lower bead is spaced below the proximal segment 110 and the distal segment 114. In some examples, the proximal segment 110 and/or the distal segment 114 may not be flat or planar, and the height $H_2$ of the lower bead 126 may also be suitably described relative to an imaginary horizontal plane that extends across the rim 108 in these examples.

The second inner wall 148 of the downwardly-extending member 118 extends downwardly from the proximal segment 110 to the lower bead 126 at an angle φ, relative to the flat or planar proximal segment 110. The second outer wall 150 extends upwardly from the lower bead 126 to the distal segment 114 at an angle θ, relative to the flat or planar distal segment 114. Like the angles α, β, the angles φ, θ will be described herein relative to the planar extent of the proximal segment 110 and the distal segment 114, but in some examples the proximal segment and/or the distal segment may not be planar (or flat), and the angles φ, θ may also suitably be described relative to an imaginary horizontal plane that extends across the rim 108. In the illustrated embodiment, the angle φ is an oblique angle, such that the second inner wall 148 extends toward the sidewall 106 as the second inner wall 148 extends downwardly toward the lower bead 126. The angle θ is approximately 90° such that the second outer wall 150 extends substantially vertically between the lower bead 126 and the distal segment 114. As such, the distance between the second inner wall 148 and the second outer wall 150 tapers from the maximum radial distance $D_4$ proximate the lower bead 126 to the minimum radial distance $D_5$ proximate the opening 154. In other examples, the angle φ may be approximately 90°, such that the second inner wall 148 extends substantially vertically, and the angle θ may be an oblique angle, such that the second outer wall 150 extends toward the sidewall 106 as the second outer wall 150 extends upwardly from the lower bead 126 and such that the distance between the second inner wall 148 and the second outer wall 150 tapers from the maximum radial distance $D_4$ proximate the lower bead 126 to the minimum radial distance $D_5$ proximate the opening 154.

In some examples, the angles φ, θ may each be oblique angles. For example, the angles φ, θ may each be acute angles or one of the angles φ, θ may be an acute angle while one of the angles φ, θ is an obtuse angle. In one example, the angle φ may be an acute angle, such that the second inner wall 148 extends toward the sidewall 106 as the second inner wall 148 extends downwardly toward the lower bead 126, and the angle θ may be an acute angle, such that the second outer wall 150 extends toward the sidewall 106 as the second outer wall 150 extends upwardly from the lower bead 126. In an alternative example, the angle θ may be an obtuse angle slightly greater than 90°, such that the second outer wall 150 extends away from the sidewall 106 as the second outer wall 150 extends upwardly from the lower bead 126, and the angle φ may be an acute angle. In another example, the angle θ may be an acute angle and the angle φ may be an obtuse angle, such that the second inner wall 148 extends away from the sidewall 106 as the second inner wall extends downwardly to the lower bead 126. Suitably, in examples where one of the angles φ, θ is an acute angle while one of the angles φ, θ is an obtuse angle, the angle that is acute has a greater deviation from 90° than the angle that is obtuse, such that the maximum radial distance $D_4$ is defined proximate the lower bead 126.

The angle φ and/or θ may be any suitable acute angle such that the maximum radial distance $D_4$ is defined proximate the lower bead 126. For example, the oblique angle φ and/or θ may be between 1° to 60°, such as between 1° to 50°, between 1° to 45°, between 1° to 30°, between 1° to 20°, between 1° to 10°, between 5° to 60°, between 5° to 50°, between 5° to 45°, between 5° to 30°, between 5° to 20°, between 5° to 10°, between 10° to 60°, between 10° to 50°, between 10° to 45°, between 10° to 30°, between 10° to 20°, between 20° to 60°, between 20° to 50°, between 20° to 40°, between 20° to 30°, between 30° to 60°, between 30° to 50°, between 30° to 40°, between 40° to 60°, between 40° to 50°, or between 50° to 60°. In various examples, the oblique angle φ and/or θ may be about 5°, about 10°, about 15°, about 20°, about 25°, about 30°, about 35°, about 40°, about 45°, about 50°, about 55°, or about 60°. In some examples, the oblique angle φ and/or θ may be an acute angle that is greater than 60°.

As described above, in some examples, one of the angles φ or θ may be an acute angle while one of the angles φ or θ is an obtuse angle. In these examples, the acute angle φ or θ may suitably be selected from the ranges and example acute angle values described above. The obtuse angle φ or θ may be between greater than 90° to 110°, such as greater than 90° to 105°, greater than 90° to 100°, greater than 90° to 95°, from 95° to 110°, from 95° to 105°, from 95° to 100°, from 100° to 110°, from 100° to 105°, or from 105° to 110°. In various examples, the obtuse angle φ or θ may be greater than 90°, such as about 95°, about 100°, about 105°, or about 110°. The obtuse angle φ or θ may be any suitable value with the proviso that the angle φ or θ that is acute has a greater deviation from 90° than the angle φ or θ that is obtuse, such that the maximum radial distance $D_4$ is defined proximate the lower bead 126.

As shown in FIG. 15, the downwardly-extending member 118 may have radius edges at the intersections between the proximal segment 110 and the second inner wall 148 and/or between the distal segment 114 and the second outer wall 150, which may provide a minimal (e.g., negligible) increase in distance from the minimum radial distance $D_5$ immediately adjacent the opening 154. The lower bead 126 may also have radius edges adjacent the second inner wall 148 and/or the second outer wall 150, which may provide a minimal decrease in distance from the maximum radial distance $D_4$ immediately adjacent the lower bead 126. In other examples, the intersection between the proximal segment 110 and the second inner wall 148 and/or the intersection between the distal segment 114 and the second outer wall 150 may be substantially angular. Additionally and/or alternatively, the lower bead 126 may have angular edges adjacent the second inner wall 148 and/or the second outer wall 150.

As shown in FIG. 13, when the first tray 102*a* engages the second tray 102*b* inverted relative to the first tray 102*a*, the upper bead 122, the first inner wall 144, and the first outer wall 146 of the upwardly-extending member 116 of the first tray 102*a* are received in the second cavity 124 of the second tray 102*b*. Similarly, the upper bead 122, the first inner wall 144, and the first outer wall 146 of the upwardly-extending member 116 of the second tray 102*b* are received in the second cavity 124 of the first tray 102*a* when the trays 102*a* and 102*b* are engaged. Suitably, the maximum radial distance $D_2$ (FIG. 14) of the upwardly-extending member 116 is approximately equal to or less than the minimum radial distance $D_5$ (FIG. 15) of the downwardly-extending member 118 to enable the upwardly-extending member 116 to be received in the second cavity 124. In some examples, the maximum radial distance $D_2$ may be slightly greater than the minimum radial distance $D_5$, and the upwardly-extending member 116 may temporarily compress (e.g., in response to an externally applied force to engage the trays 102*a* and 102*b*) to fit within the second cavity 124 through the minimum radial distance $D_5$.

As described above, when the first tray 102*a* engages the inverted second tray 102*b*, the upwardly-extending member 116 of the first tray 102*a* engages the downwardly-extending member 118 of the second tray 102*b* in the second cavity 124 of the second tray by friction, and the upwardly extending member 116 of the second tray 102*b* engages the downwardly-extending member 118 of the first tray 102*a* in the second cavity 124 of the first tray by friction. In the illustrated embodiment, the first inner walls 144 of the upwardly-extending members 116 of the trays 102*a* and 102*b* engage the second inner walls 148 of the downwardly-extending members 118 when received in the respective second cavity 124. It is noted that FIG. 13 depicts a small gap between the first inner wall 144 and the second inner wall 148 of the engaged trays 102*a* and 102*b*, respectively, for convenience of illustration. The upward extent of the first inner walls 144 at the oblique angle α complements the downward extent of the second inner walls 148 at the oblique angle φ to enable the first inner walls 144 to frictionally engage the respective second inner walls 148 in the second cavities 124 and maintain engagement between the trays 102*a* and 102*b*. The maximum radial distance $D_2$ of the upwardly-extending members 116 may be smaller than the maximum radial distance $D_4$ of the downwardly-extending members 118, such that the first outer walls 146 are spaced apart from the second outer walls 150 in the respective second cavities 124. In other examples, the first outer walls 146 may frictionally engage the second outer walls 150 in the respective second cavities 124 (e.g., where the first outer walls 146 extend at an acute angle β and the second outer walls 150 have a complementing extent at an acute angle θ), and the first inner walls 144 may be spaced from the first outer walls 148. In yet other examples, the first inner walls 144 may frictionally engage the second inner walls 148 and the first outer walls 146 may frictionally engage the second outer walls 150 in the respective second cavities 124. Suitably, where the first inner walls 144 and the second inner walls 148 respectively extend at acute angles α, φ to enable frictional engagement, the acute angles α, φ are approximately equal to facilitate the complementing extent of the inner walls in the respective second cavities 124. Additionally and/or alternatively, where the first outer walls 146 and the second outer walls 150 respectively extend at acute angles β, θ to enable frictional engagement, the acute angles β, θ are approximately equal to facilitate the complementing extent of the inner walls in the respective second cavities 124.

With additional reference to FIGS. 12 and 13, when the first tray 102*a* engages the inverted second tray 102*b*, an interior volume 140 of the container 100 is defined by the interior 105 of each tray 102*a* and 102*b*. Face-to-face contact between the rims 108 of the engaged trays 102*a* and 102*b* may substantially seal the interior volume 140 and facilitate preventing stored contents (e.g., liquids) from leaking out of the closed container 100. It is noted that FIG. 13 depicts a small gap between the rims 108 of the engaged trays 102*a* and 102*b* for convenience of illustration. When the trays 102*a* and 102*b* are engaged to close the container 100, the proximal segments 110, the beads 122 and 126, and/or the distal segments 114 of the trays 102*a* and 102*b* are respectively in face-to-face contact. The face-to-face contact between the rims 108 to seal the interior volume 140 may be in addition to the frictional engagement between the first inner wall 144 and the second inner wall 148 and/or between the first outer wall 146 and the second outer wall 150 in the respective second cavity 124. In the illustrated example, the proximal segments 110 of the trays 102*a* and 102*b* are in face-to-face contact when the trays are engaged. The upper beads 122 may additionally and/or alternatively be in face-to-face contact with the lower beads 126 in the respective second cavities when the trays 102*a* and 102*b* are engaged. The distal segments 114 of the trays 102*a* and 102*b* may additionally and/or alternatively be in face-to-face contact when the trays 102*a* and 102*b* are engaged. The heights $H_1$ and $H_2$ of the upper and lower beads 122 and 126 may suitably complement one another to enable the face-to-face contact between the upper beads 122 and the lower beads 126, and the proximal segments 110 and/or the distal segments 114 when the trays 102*a* and 102*b* are engaged.

The tray 102*a/b* may also include at least one vent channel 142 (shown, for example, in FIGS. 8-10) defined in the rim 108. Each vent channel 142 creates a path between the rims 108 of the engaged trays 102*a* and 102*b* that enables heat and moisture-entrained air (e.g., steam) to exit the interior volume 140 of the container 100 when closed. The path created by each vent channel 142 between the engaged rims 108 may be continuous, that is, extends entirely from the interior volume 140 to the peripheral edges of the rims 108. Alternatively, one or more paths created by the vent channel (s) 142 may be discontinuous, that is, the path extends from the interior volume 140 and terminates prior to the peripheral edges of the rims 108 such that the path is substantially sealed at its radial terminus by face-to-face contact between the rims. In the illustrated example, two vent channels 142 are included in the tray 102*a/b*. In other examples, any suitable number of vent channels 142 may be included, such as one vent channel, three vent channels, four vent channels, five vent channels, six vent channels, seven vent channels, eight vent channels, nine vent channels, ten vent channels, or more than ten vent channels. In some examples, the tray 102*a/b* does not include any vent channels 142.

The vent channel(s) 142 are defined at least in the proximal segment 110 of the rim 108 and extend radially from the intersection between the rim 108 and the sidewall 106 toward the peripheral edge of the rim. In particular, each vent channel 142 is defined by a radially-extending groove in an outer surface of the rim 108, that is, in the surface of the rim 108 that engages the rim 108 of the other tray 102*a/b* to close the container 100. Outwardly-extending ridges corresponding to the grooves defining the vent channels 142 are formed on the opposite surface of the rim 108, as shown in FIGS. 1-3 for example. When the container 100 is closed, the vent channel(s) 142 defined by the groove(s) in the rim 108 of each tray 102*a* and 102*b* are in communication with, or fluidly connected to, the interior volume 140. FIG. 12 depicts one vent channel 142 of each tray 102*a* and 102*b* in communication with, or fluidly connected to, the interior volume 140 of the closed container 100. The communication between the interior volume 140 of the closed container 100 and the vent channel(s) defined in the rims 108 of the trays 102*a* and 102*b* allows heat and moisture-entrained air (e.g., steam) to escape the interior volume therethrough.

The vent channel(s) 142 may be defined at any suitable location on the rim 108. In the illustrated example, one of the vent channels 142 is located at the first end 160 of the tray 102*a/b* and the other of the vent channels 142 is located at the second end 162. When the first tray 102*a* engages the inverted second tray 102*b*, the vent channels 142 of the trays at the first ends 160 align with one another and the vent channels 142 of the trays at the second ends 162 align with one another. FIG. 12 depicts the vent channel 142 at the first end 160 of the first tray 102*a* aligned with the vent channel 142 at first end 160 of the inverted second tray 102*b*. Aligning the vent channels 142 of the engaged trays 102*a* and 102*b* may suitably facilitate reducing the depth of the grooves in each rim 108 that define each vent channel 142 while maintaining a sufficient venting area to enable heat and moisture-entrained air (e.g., steam) to exit the container 100. In other examples, the vent channels 142 may be at different locations on the trays 102*a* and 102*b*, such that the vent channels 142 are offset (i.e., not aligned) when the trays are engaged. In yet other examples, only one of the trays 102*a* and 102*b* may include the vent channel(s) 142.

The vent channels 142 may extend radially along the rim 108 any suitable distance. For example, the vent channels 142 may extend the entire radial distance $D_1$ of the rim 108, to create continuous paths through the engaged rims 108. Additionally and/or alternatively, one or more vent channels 142 may terminate at a radial distance less than the radial distance $D_1$ and prior to the peripheral edge of the rim, to create discontinuous paths through the engaged rims 108. In the illustrated example, the vent channels 142 in each tray 102*a/b* terminate prior to the peripheral edge of the rim 108. In examples where the vent channels 142 terminate prior to the peripheral edge of the rim, such as in the illustrated tray 102*a/b*, the vent channels 142 may be defined in the proximal segment 110 and terminate prior to the bead segment 112. In other examples, the vent channels 142 may be defined in the proximal segment 110 and the bead segment 112 and terminate prior to the distal segment 114. In other examples, the vent channels 142 may be defined in proximal segment 110, the bead segment 112, and a portion of the distal segment 114 inboard of the peripheral edge of the rim 108.

In various examples, the vent channels 142 that terminate prior to the peripheral edge of the rim 108 may extend radially along the rim 108 any suitable percentage of the radial distance $D_1$ of the rim to enable the vent channels 142 to function as described. For example, the vent channels 142 may extend a distance of between 10% to 90% of the radial distance $D_1$, such as between 10% to 80% of the radial distance $D_1$, between 10% to 70% of the radial distance $D_1$, between 10% to 60% of the radial distance $D_1$, between 10% to 50% of the radial distance $D_1$, between 10% to 40% of the radial distance $D_1$, between 10% to 30% of the radial distance $D_1$, between 10% to 20% of the radial distance $D_1$, between 20% to 90% of the radial distance $D_1$, between 20% to 80% of the radial distance $D_1$, between 20% to 70% of the radial distance $D_1$, between 20% to 60% of the radial distance $D_1$, between 20% to 50% of the radial distance $D_1$, between 20% to 40% of the radial distance $D_1$, between 20% to 30% of the radial distance $D_1$, between 30% to 90% of the radial distance $D_1$, between 30% to 80% of the radial distance $D_1$, between 30% to 70% of the radial distance $D_1$, between 30% to 60% of the radial distance $D_1$, between 30% to 50% of the radial distance $D_1$, between 30% to 40% of the radial distance $D_1$, between 40% to 90% of the radial distance $D_1$, between 40% to 80% of the radial distance $D_1$, between 40% to 70% of the radial distance $D_1$, between 40% to 60% of the radial distance $D_1$, between 40% to 50% of the radial distance $D_1$, between 50% to 90% of the radial distance $D_1$, between 50% to 80% of the radial distance $D_1$, between 50% to 70% of the radial distance $D_1$, between 50% to 60% of the radial distance $D_1$, between 60% to 90% of the radial distance $D_1$, between 60% to 80% of the radial distance $D_1$, between 60% to 70% of the radial distance $D_1$, between 70% to 90% of the radial distance $D_1$, between 70% to 80% of the radial distance $D_1$, or between 80% to 90% of the radial distance $D_1$. In various examples, the vent channels 142 may extend a distance of about 10%, about 15%, about 20%, about 25%, about 30%, about 35%, about 40%, about 45%, about 50%, about 55%, about 60%, about 65%, about 70%, about 75%, about 80%, about 85%, or about 90% of the radial distance $D_1$. In some examples, the vent channels 142 may extend less than 10% of the radial distance $D_1$ or greater than 90% of the radial distance $D_1$. The vent channels 142 may be coextensive in length or the vent channels 142 may extend different distances along the rim 108.

In the illustrated example, the vent channels 142 are defined in the proximal segment 110 and in at least a portion of the bead segment 112 of the rim 108 of the tray 102*a/b*. In addition, each vent channel 142 extends radially along flat or planar areas of the bead segment 112 between the upwardly-extending member 116 and the downwardly-extending member 118. In particular, the vent channels 142 are defined in at least a portion of the bead segment 112 at the gaps between the ends of the upwardly-extending member 116 and the downwardly-extending member 118. The vent channel 142 at the first end 160 of the tray 102*a/b* extends between the second end 138 of the downwardly-extending member 118 and the first end 132 of the upwardly-extending member 116. The vent channel 142 at the second end 162 of the tray 102*a/b* extends between the first end 136 of the downwardly-extending member 118 and the second end 134 of the upwardly-extending member 116. In some examples, only one of the vent channels 142 may be included and defined in the proximal segment 110 and in at least a portion of the bead segment 112 at the respective gap. In some examples, one or both of the vent channels 142 may be defined in a portion of the distal segment 114 such that the vent channel(s) 142 extend beyond the bead segment 112 at the respective gap.

Figure 26:
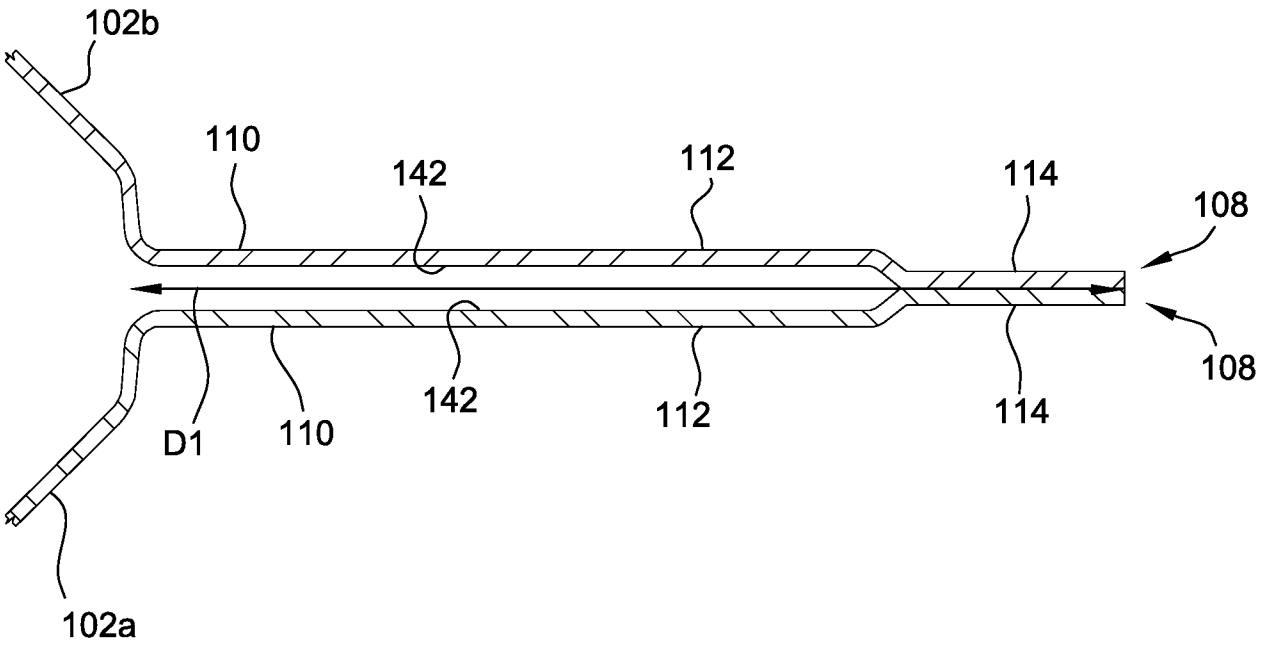
FIG. 26 is a cross-section of the rims of the trays of the container engaged to close the container as shown in FIGS. 1-8, taken along line 26-26 in FIGS. 2 and 3.

In examples where the vent channels 142 are defined in the proximal segment 110 and in a flat or planar portion of the bead segment 112, as in the tray 102*a/b*, the vent channels 142 may suitably terminate prior to the peripheral edge of the rim 108 to reduce or eliminate the propensity of liquid to leak out of the container 100 through the vent channels 142. Otherwise, when the vent channels 142 extend the radial distance $D_1$ across the rim 108 to the peripheral edge, the vent channels 142 create continuous paths between the rims 108 of the engaged trays 102*a* and 102*b* through which liquid may leak out of the closed container 100. Liquid may be particularly likely to leak from the interior volume 140 through continuous paths between the engaged rims 108 when the vent channels 142 are defined across a substantially entirely flat area (e.g., where the vent channels 142 are defined in a flat or planar portion of the bead segment 112). In the illustrated embodiment, the vent channels 142 terminate prior to the peripheral edge of the rim 108 and create discontinuous paths that are substantially sealed at their radial terminus when the trays 102*a* and 102*b* are engaged by face-to-face contact between the rims 108. To illustrate, reference is made to FIG. 26, which is a cross-section of the rims 108 of the engaged trays 102*a* and 102*b* when the container 100 is closed, taken along line 26-26 in FIGS. 2 and 3. As shown in FIG. 26, portions of the rims 108 (e.g., the distal segments 114) of the trays 102*a* and 102*b* that extend radially from the terminus of the vent channels to the peripheral edge of the rim 108 are in face-to-face contact. Suitably, the engagement between the trays 102*a* and 102*b* when the container 100 is closed maintains sufficient face-to-face contact between these radially outer portions of the rims 108 to create a liquid seal therebetween, while also allowing for some separation between the rims 108 to enable heat and moisture-entrained air (e.g., steam) to exit the container 100 through the vent channels 142.

Figure 27:
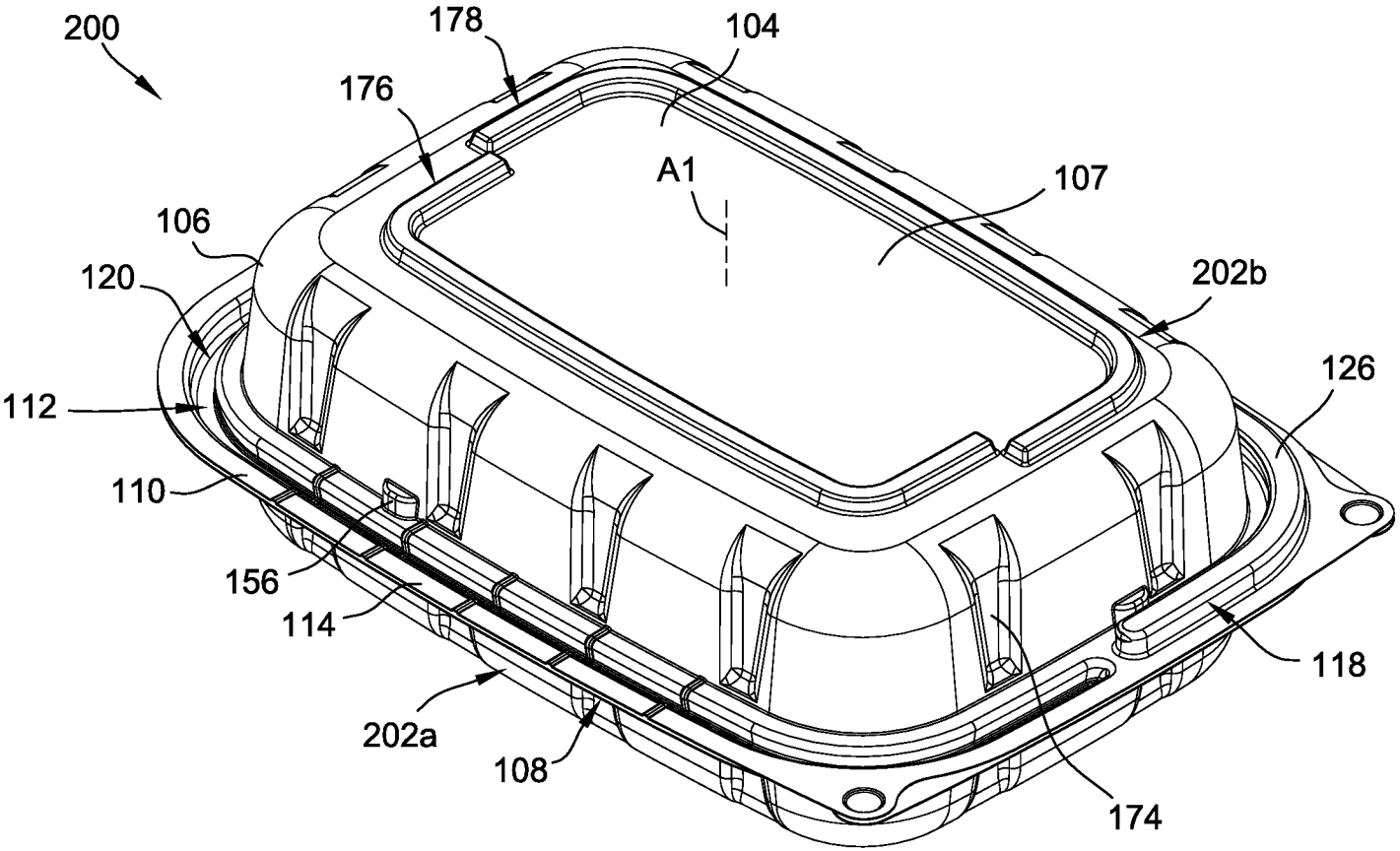
FIG. 27 is a perspective view of another example container formed of trays having a substantially identical profile, shown in a closed configuration.
Figure 28:
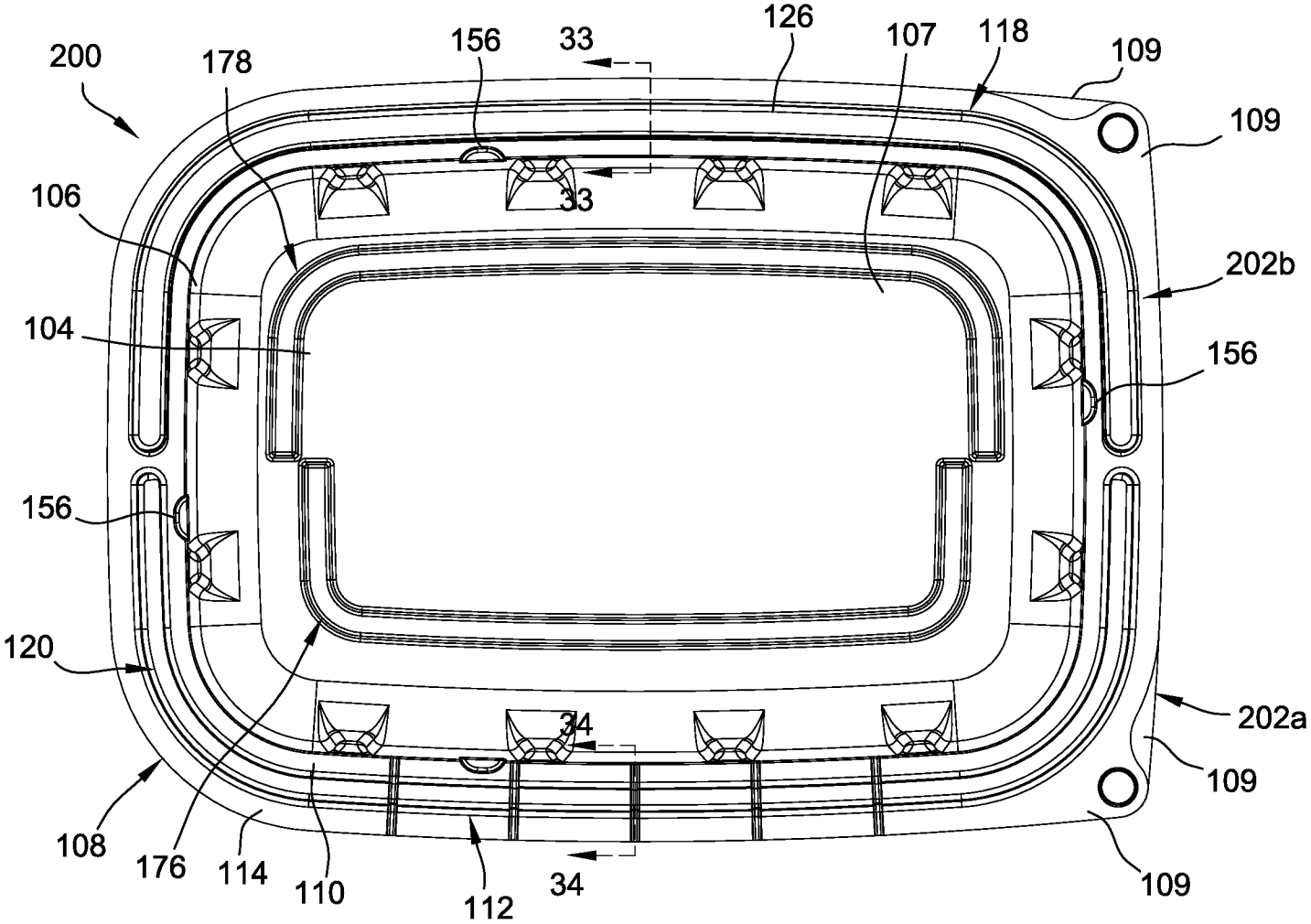
FIG. 28 is a top plan view of the container of FIG. 27.
Figure 29:
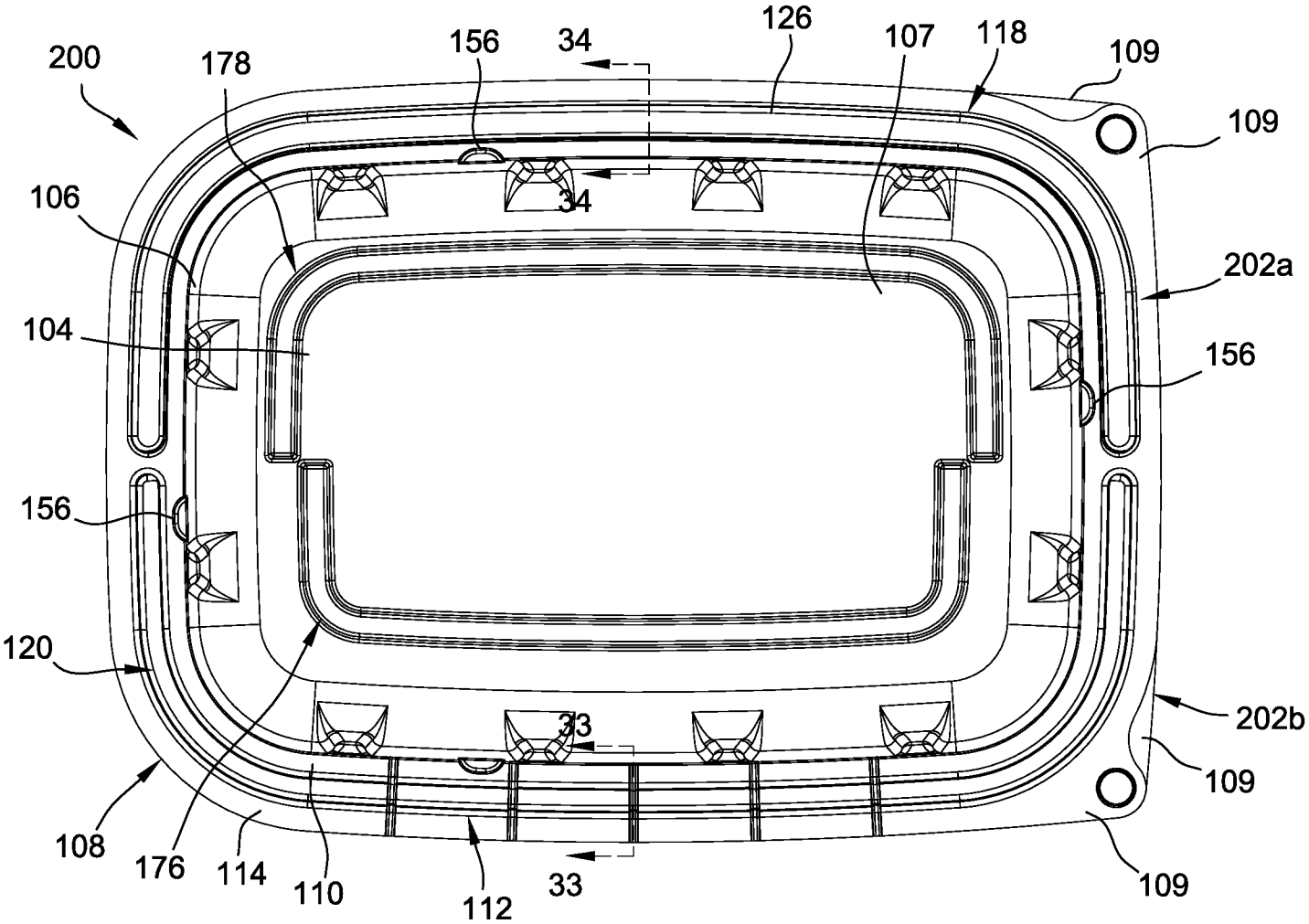
FIG. 29 is a bottom plan view of the container of FIG. 27.
Figure 30:
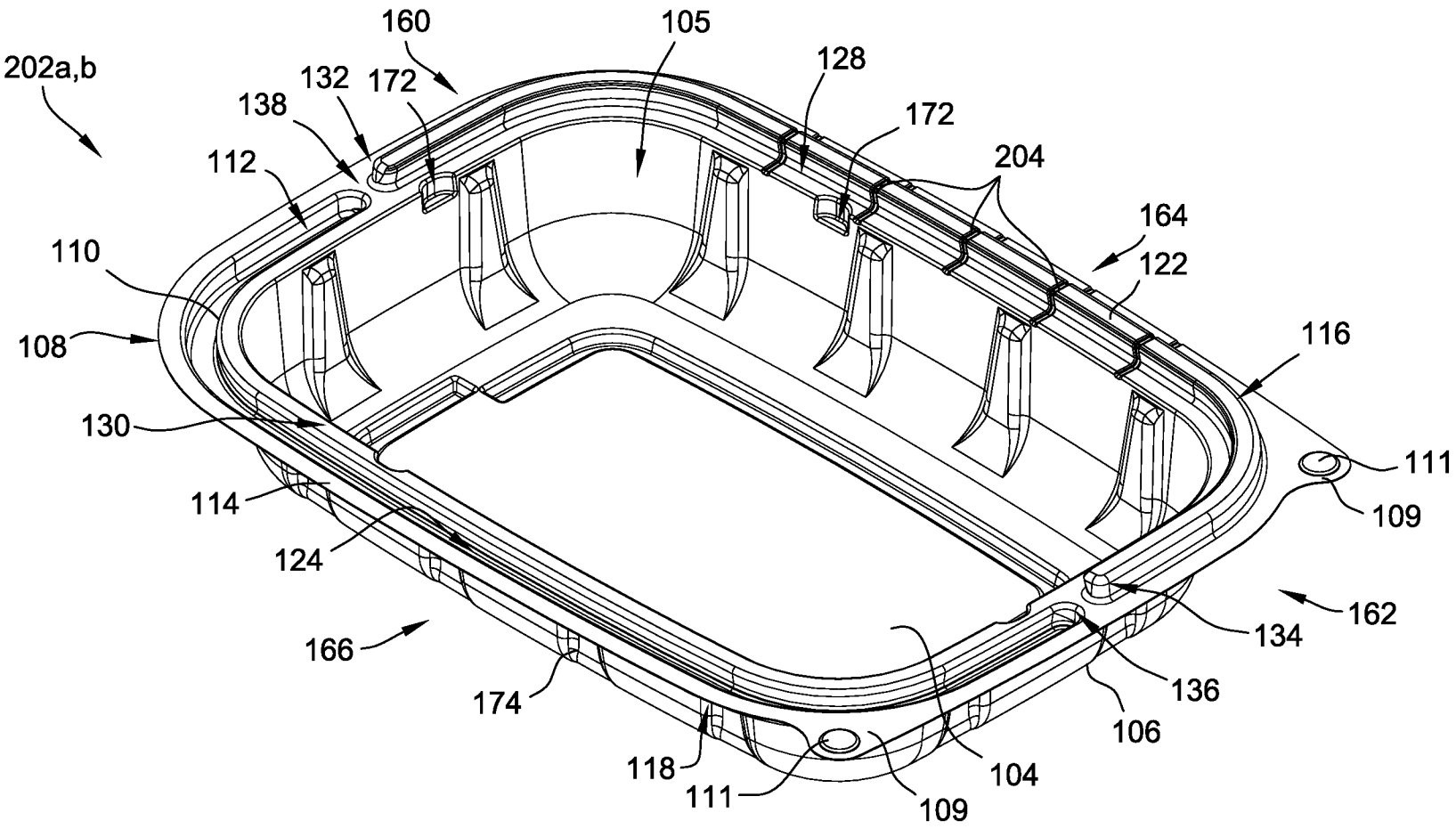
FIG. 30 is an isolated perspective of each tray used to form the container of FIGS. 27-29.
Figure 31:
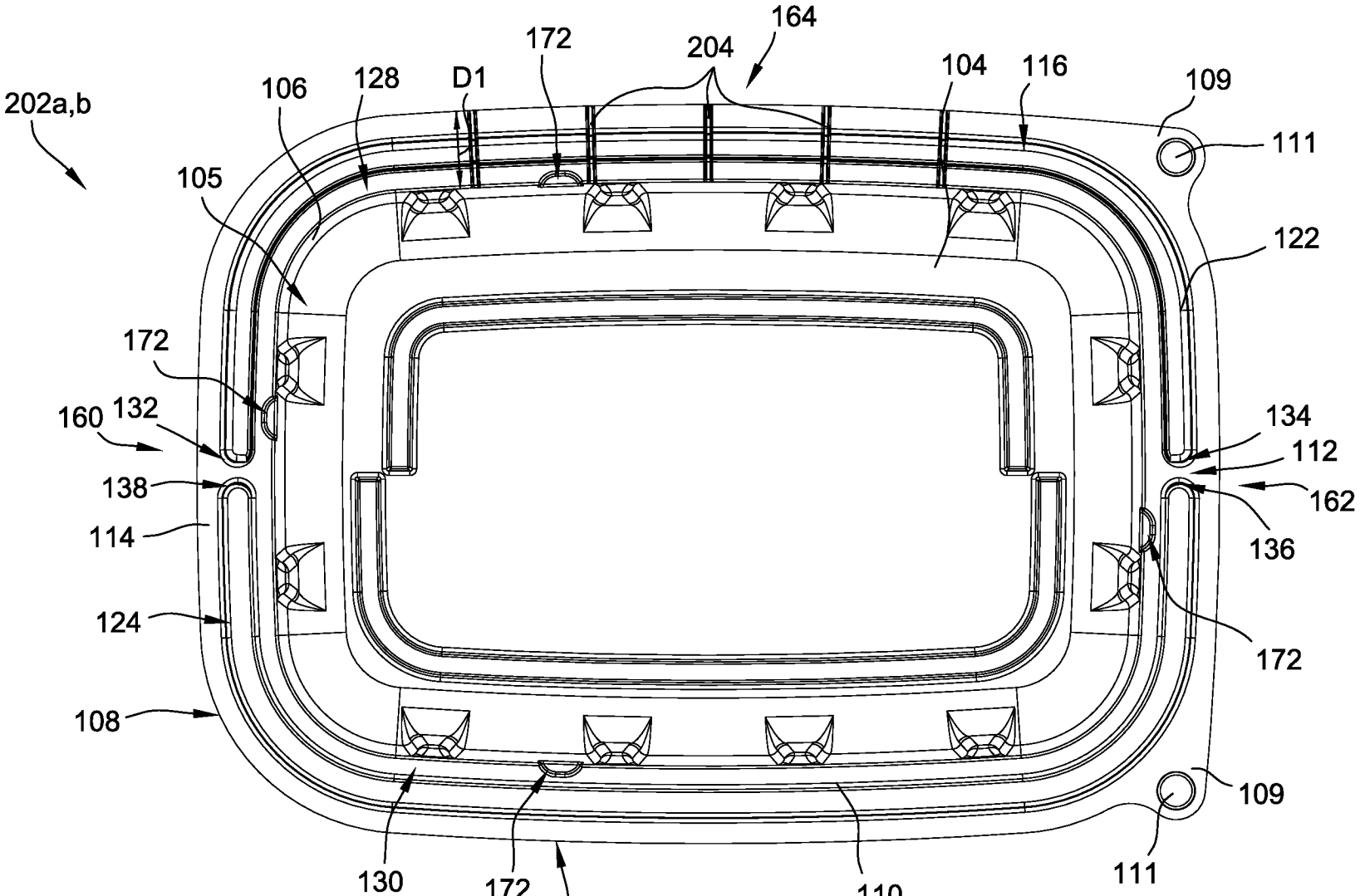
FIG. 31 is a top plan view of the tray of FIG. 30.
Figure 32:
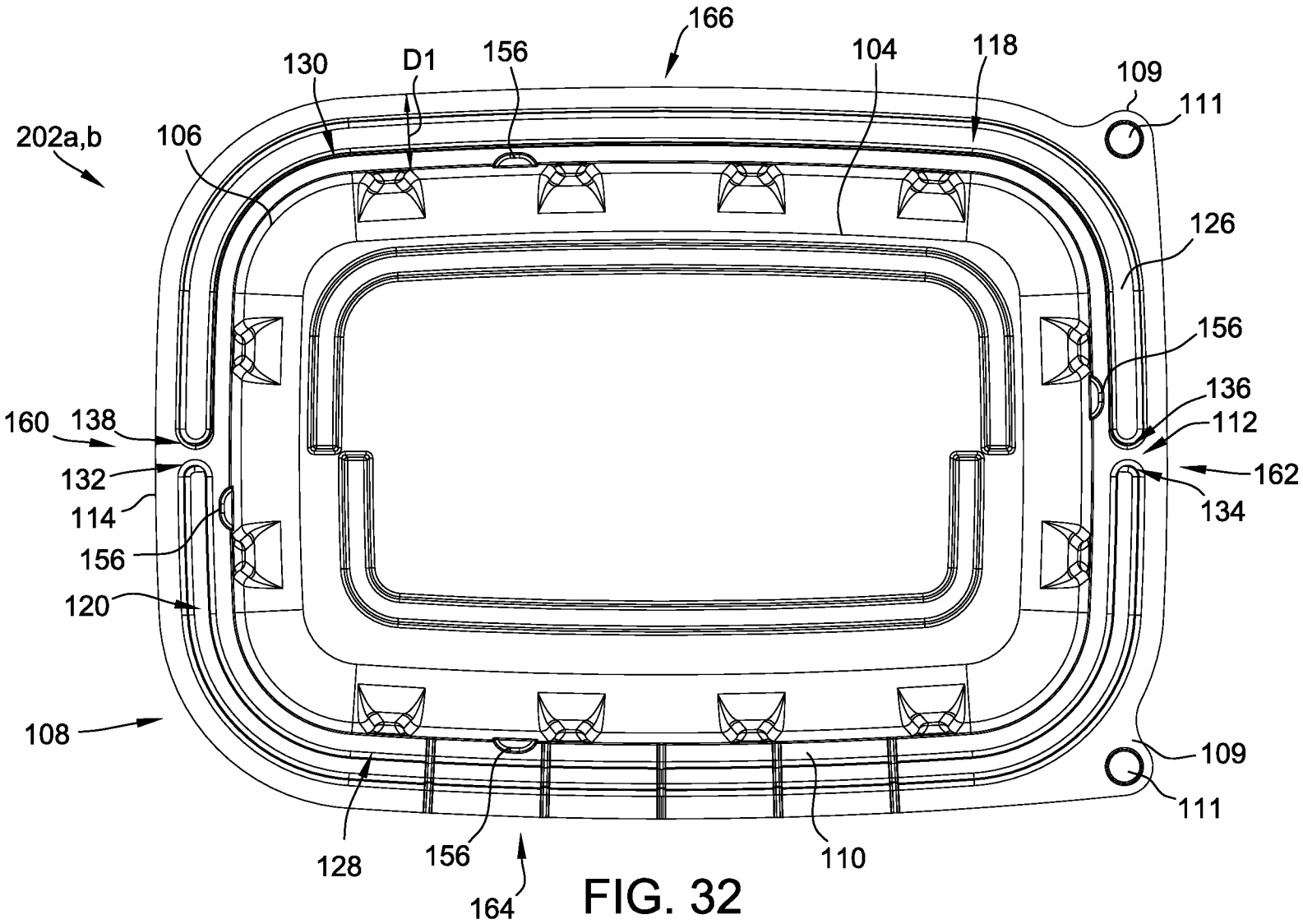
FIG. 32 is a bottom plan view of the tray of FIG. 30.

Referring now to FIGS. 27-29, another example container 200 is shown having vent channels formed at different locations than the vent channels of the container 100. The container 200, like the container 100 described above, is formed from a pair of trays 202*a* and 202*b* having a substantially identical profile. The first tray 202*a* engages with the second tray 202*b* inverted relative to the first tray to form the container 100 in the closed configuration shown in FIGS. 27-29. FIGS. 30-32 depict various isolated views of the substantially identically-profiled trays 202*a* and 202*b*. For convenience, the first tray 202*a* and the second tray 202*b* will be referred to as the tray 202*a/b* where common features and elements are being described. The tray 202*a/b* has similar elements and components as described above for the tray 102*a/b* used to form the container 100. Corresponding reference numerals are used to describe corresponding elements and features of the tray 202*a/b* and the container 200 that are included in the tray 102*a*/102*b* and the container 100 described above with reference to FIGS. 1-26.

In this example, the tray 202*a/b* includes vent channels 204 defined in the rim 108 and located at the first side 164 of the tray 202*a/b*. Like the vent channels 142 described above, each vent channel 204 is defined by a radially-extending groove in an outer surface of the rim 108. In particular, the vent channels 204 are defined by grooves that extend from the sidewall 106 and radially along the rim 108. In the illustrated example, the vent channels 204 of the tray 202*a/b* extend the radial distance $D_1$ of the rim 108, across the proximal segment 110, the upwardly-extending member 116, and the distal segment 114. In some examples, the vent channels 204 may terminate prior to the peripheral edge of the rim 108. For example, the vent channels 204 may be defined in the proximal segment 110 and at least a portion of the upwardly-extending member 116, and terminate prior to the distal segment 114. In other examples, the vent channels 204 may be defined in the proximal segment 110, the upwardly-extending member 116, and a portion of the distal segment 114 radially inboard of the peripheral edge of the rim 108.

In the example tray 202*a/b*, five vent channels 204 are included. Each of the five vent channels 204 is located at the first side 164 of the tray 202*a/b* and is defined in the proximal segment 110, the upwardly-extending member 116, and the distal segment 114. More or fewer vent channels 204 may be included in the tray 202*a/b*. Additionally and/or alternatively, some of the vent channels 204 may be defined at other locations on the rim 108 (such as at the first end 160 or the second end 162 of the tray 202*a/b*, between ends of the upwardly-extending member 116 and the downwardly-extending member 118 as described above for the vent channels 142). While each of the vent channels 204 is coextensive in length, that is, each extends the radial distance $D_1$ of the rim 108, some of the vent channels 204 may be shorter in extent and terminate prior to the peripheral edge of the rim 108.

Figure 33:
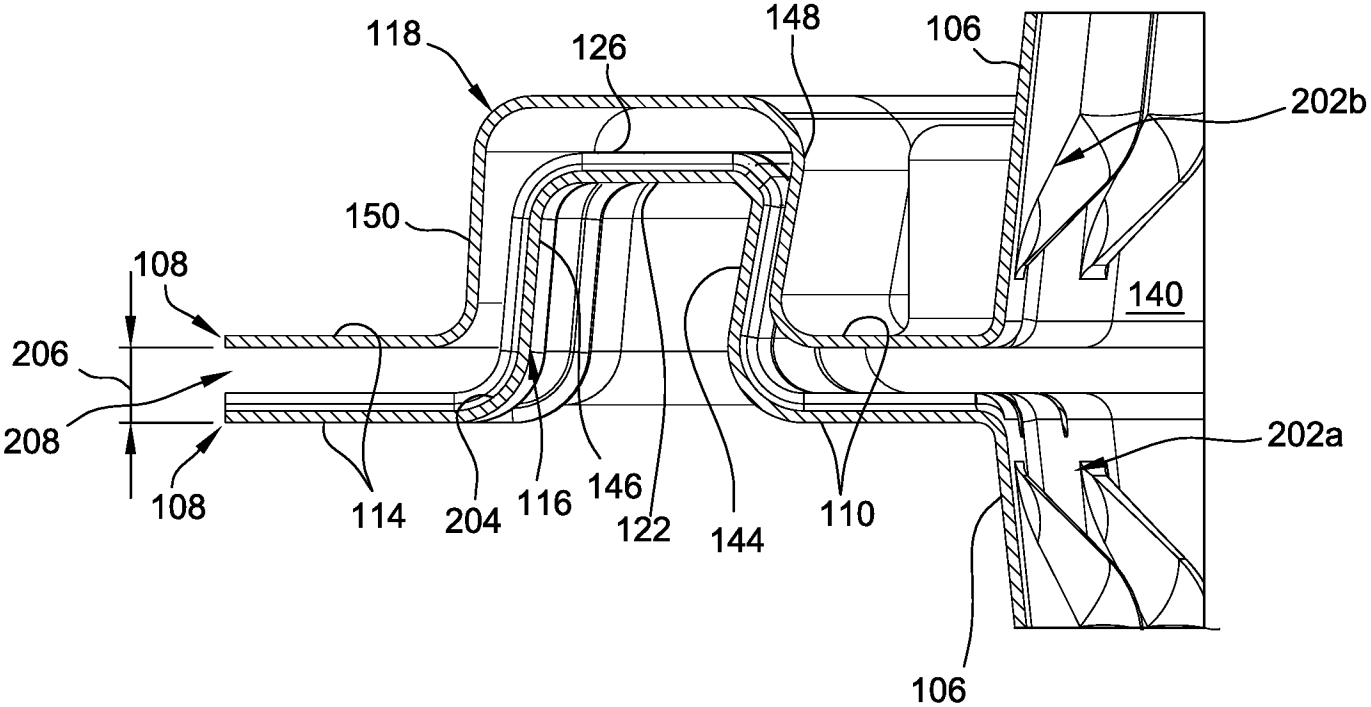
FIG. 33 is a cross-section of engaged rims of the trays to close the container of FIGS. 27-29, taken along line 33-33 in FIGS. 28 and 29.
Figure 34:
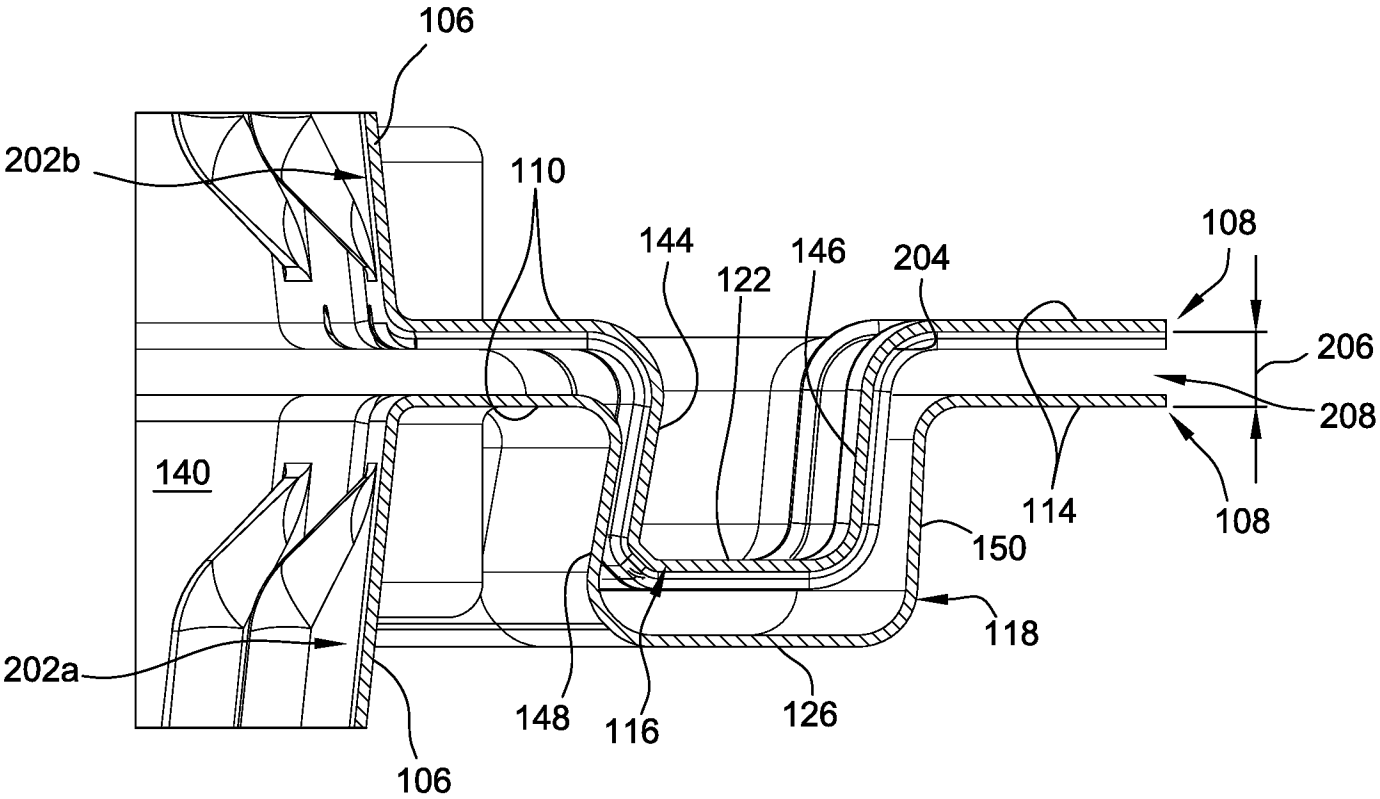
FIG. 34 is another cross-section of engaged rims of the trays to close the container of FIGS. 27-29, taken along line 34-34 in FIGS. 28 and 29.

When the first tray 202*a* engages the inverted second tray 202*b* to close the container 200 (shown in FIGS. 27-29), the vent channels 204 are in communication with the interior volume 140 of the container 200 (shown in FIGS. 33 and 34). Each of the vent channels 204, which extend the radial distance $D_1$ in the example tray 202*a/b*, creates a continuous path (shown in FIGS. 33 and 34) from the interior volume 140 that extends through the engaged rims 108 of the trays 202*a* and 202*b* to the periphery of the closed container 200. Further, when the container 200 is closed, the vent channels 204 defined in the rim 108 of the first tray 202*a* are located on the opposite side of the container 200 than the vent channels 204 defined in the rim 108 of the second tray 202*b*. This is indicated in FIGS. 28 and 29, which show the ridges corresponding to grooves that define the vent channels 204 only extending on one side of the container 200 when viewed from the top and the bottom. As such, the vent channels 204 of the first tray 202*a* do not align with the vent channels 204 of the second tray 202*b* when the trays are engaged to close the container 200.

FIGS. 33 and 34 are cross-sections depicting the vent channels 204 extending the radial distance $D_1$ across the rims 108 and the continuous paths that the vent channels 204 create through the rims 108 of the trays 202*a* and 202*b* when engaged. FIG. 33 is a cross-section of the rims 108 of the engaged trays 202*a* and 202*b*, taken along line 33-33 in FIGS. 28 and 29, and depicts a continuous path that a vent channel 204 of the first tray 202*a* creates through the engaged rims 108. FIG. 34 is a cross-section of the rims 108 of the engaged trays 202*a* and 202*b*, taken along line 34-34 in FIGS. 28 and 29, and depicts a continuous path that a vent channel 204 of the second tray 202*b* creates through the engaged rims 108. As shown in FIGS. 33 and 34, the vent channels 204 define the continuous paths from the interior volume 140 of the closed container 200 to the periphery of the engaged rims 108. In particular, the vent channels 204 define a gap distance 206 between the proximal segments 110, the upper and lower beads 122 and 126, and the distal segments 114 of the trays 202*a* and 202*b*. The gap distance 206 may be constant or may vary along the radial extent of the vent channel 204. The gap distance 206 may also vary between vent channels 204. Suitably, for each vent channel 204, the gap distance 206 exists along the entire extent of the vent channel 204 to create the continuous path from the interior volume, between the engaged rims 108, and to the periphery of the container 200 and enable heat and moisture to exit the closed container 200.

The vent channels 204 that are defined in the upwardly-extending member 116 may suitably extend the radial distance $D_1$ of the rim 108 and create the continuous paths between the rims 108 of the engaged trays 202*a* and 202*b* while also facilitating reducing or eliminating the propensity of liquid to leak out of the container 200 through these paths. As shown in FIGS. 33 and 34, the vent channels 204 define openings 208 at the periphery of the container 200, through which heat and moisture-entrained air (e.g., steam) may exit the closed container 200 via the continuous paths created by the vent channels 204 through the engaged rims 108. In extending across the upwardly-extending members 116 of the trays 202*a* and 202*b*, each path created by a vent channel 204 is a tortuous path through which liquid must flow prior to reaching the openings 208. In particular, liquid from the interior volume 140 must travel across an upward extent of the upwardly-extending member 116 prior to reaching the distal segment 114 and the opening 208, which limits the ability of liquid to leak out of the container 200. Heat and moisture-entrained air (e.g., steam), however, are still able to flow through the paths created by the vent channels 204, thus enabling suitable venting of the container 200.

Figure 35:
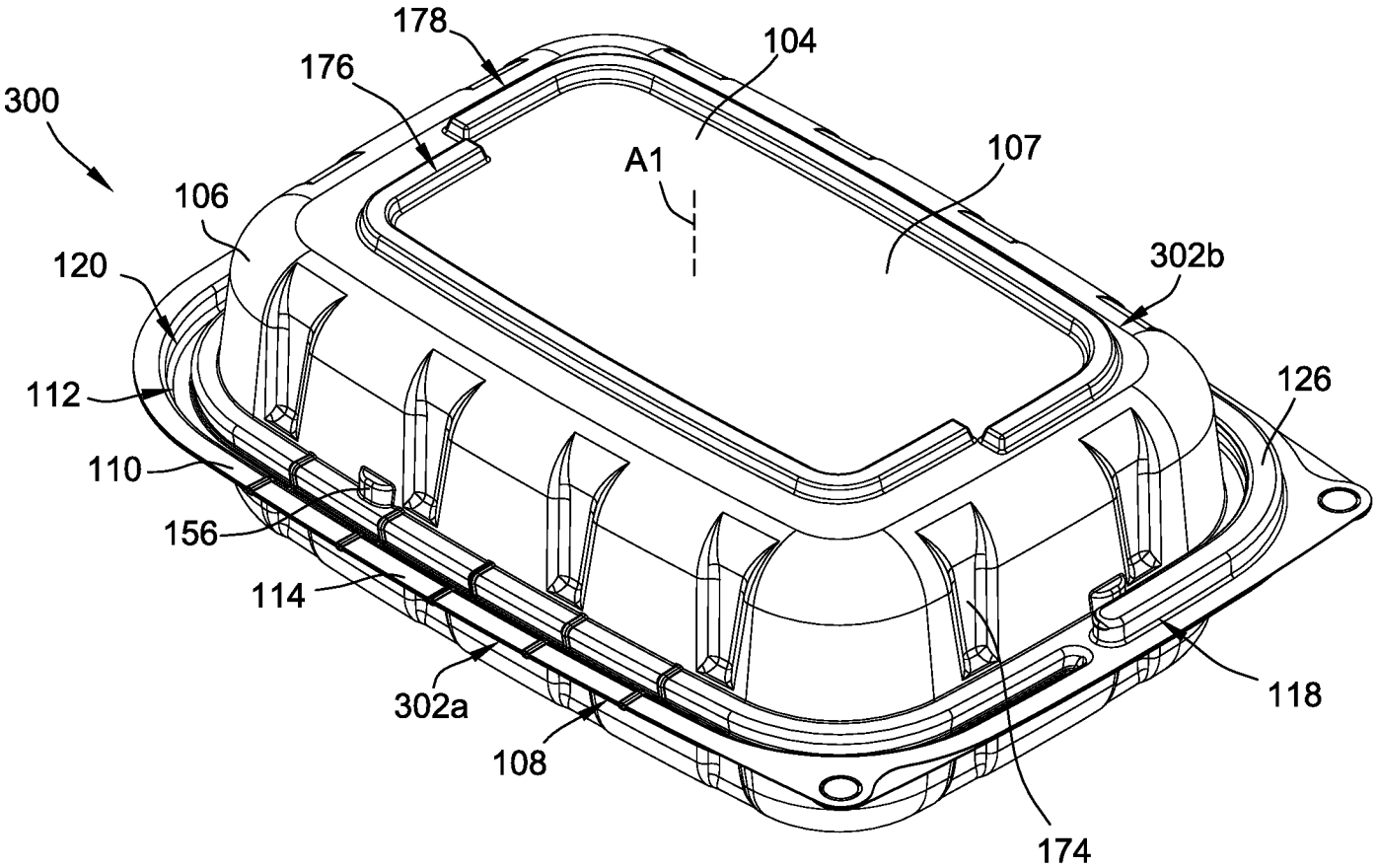
FIG. 35 is a perspective view of another example container formed of trays having a substantially identical profile, shown in a closed configuration.
Figure 36:
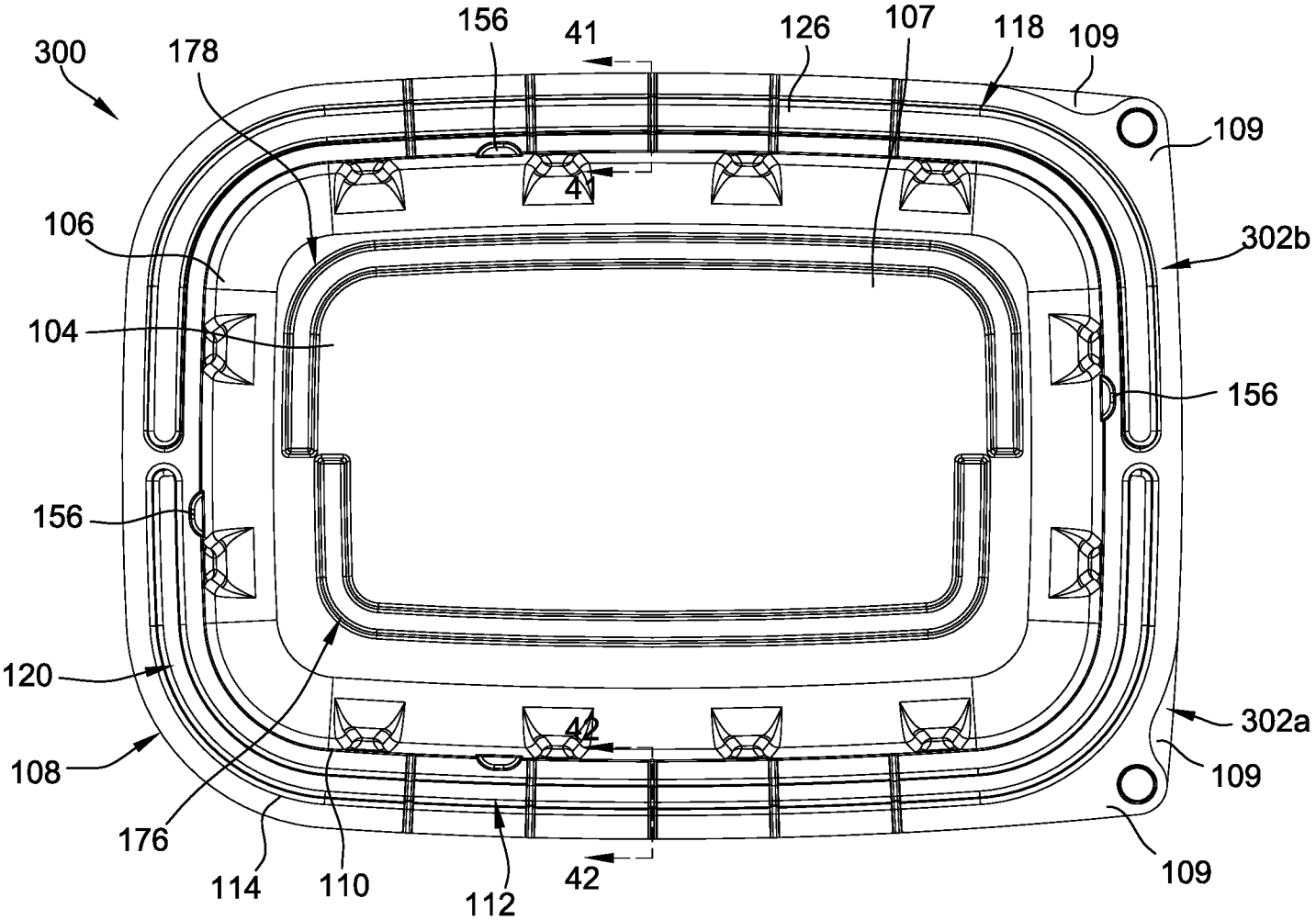
FIG. 36 is a top plan view of the container of FIG. 35.
Figure 37:
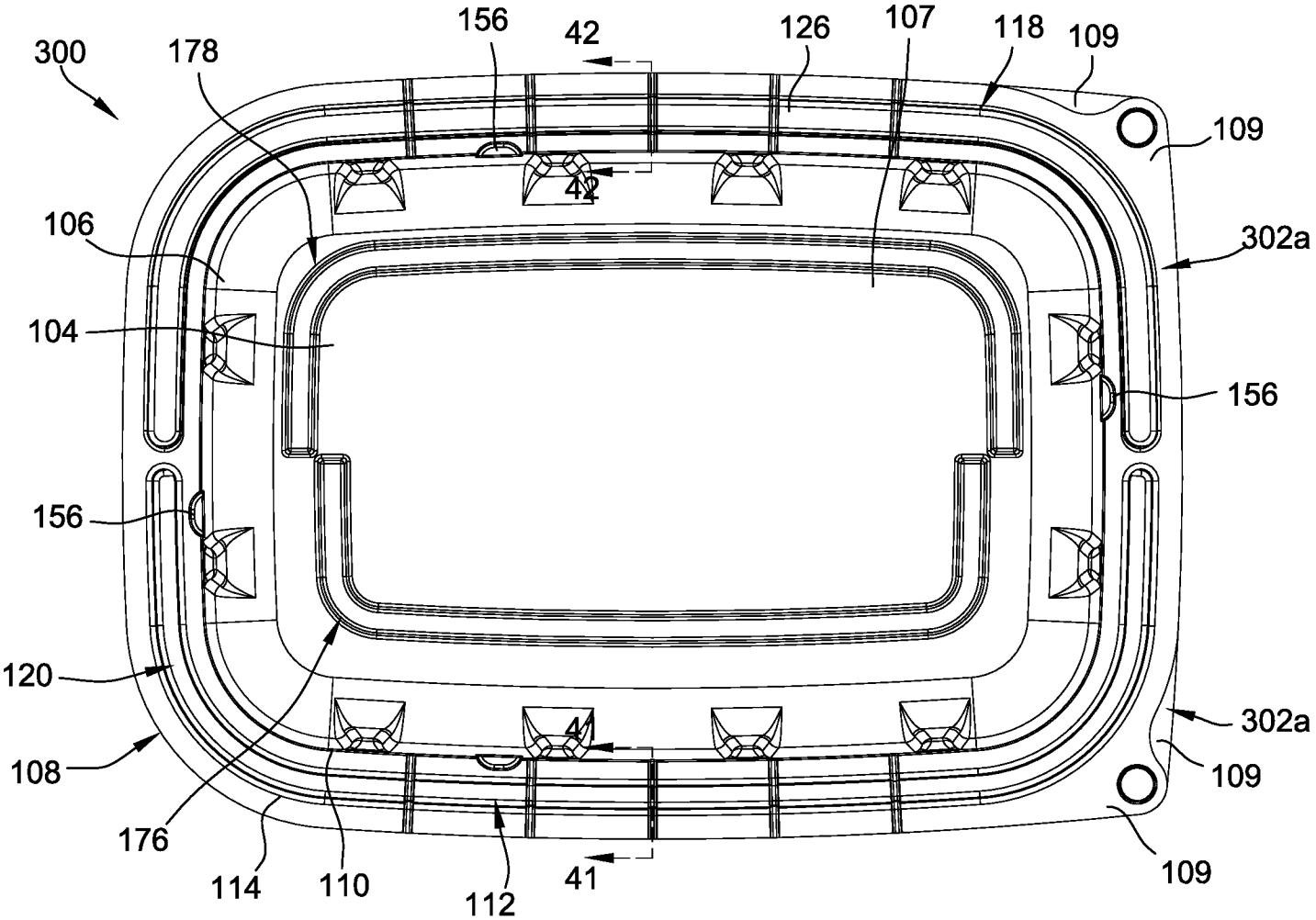
FIG. 37 is a bottom plan view of the container of FIG. 35.
Figure 38:
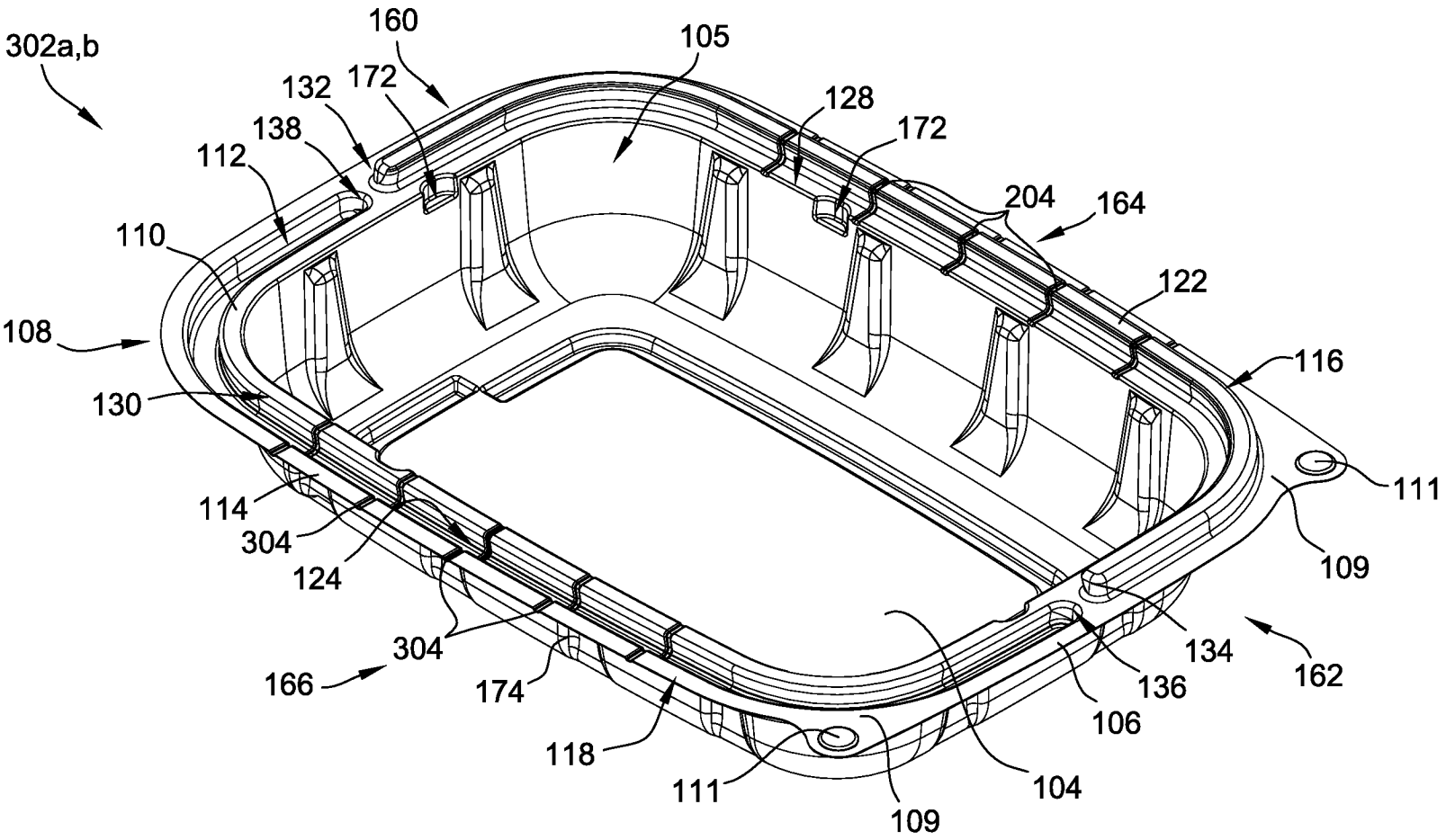
FIG. 38 is an isolated perspective of each tray used to form the container of FIGS. 35-37.
Figure 39:
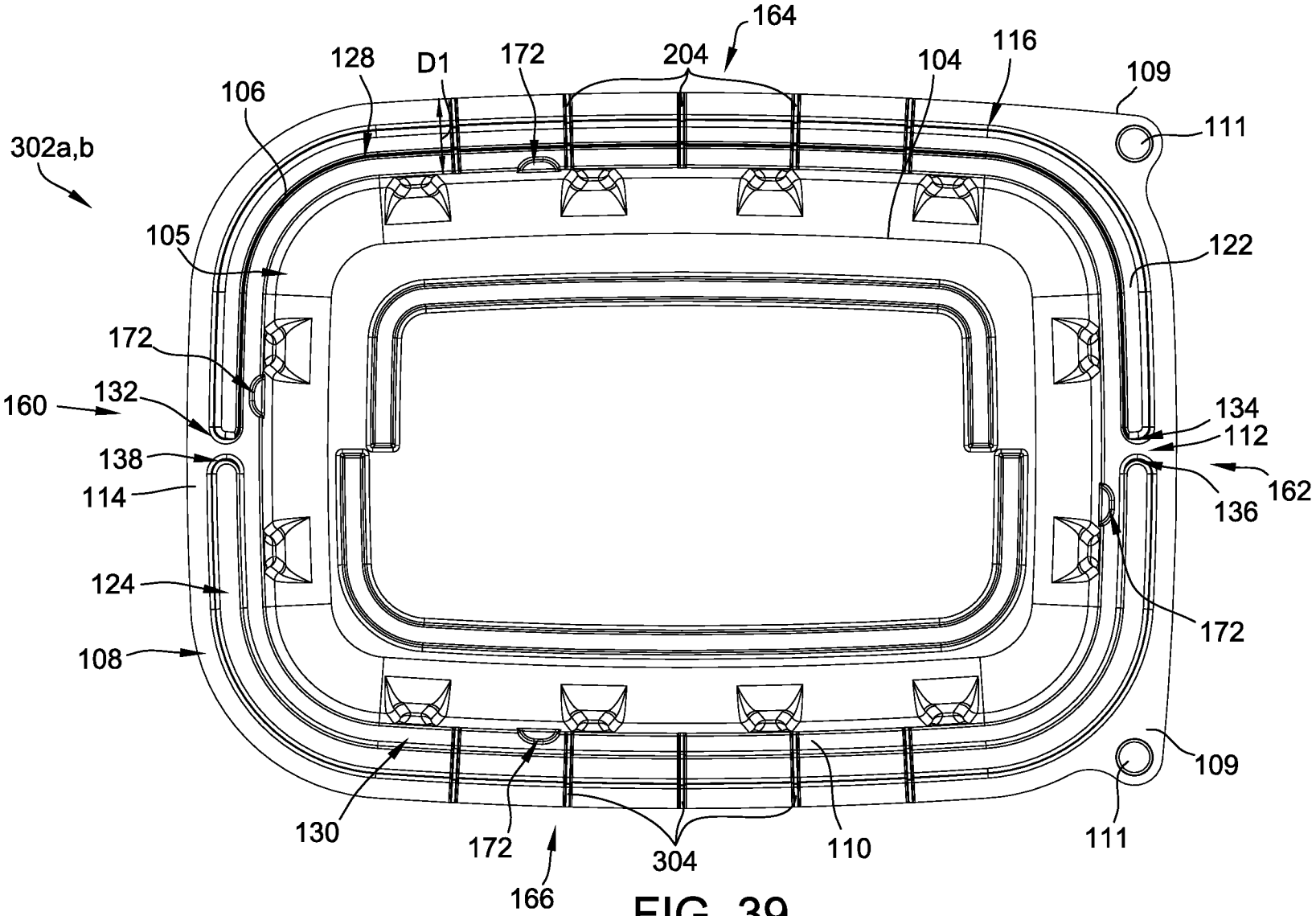
FIG. 39 is a top plan view of the tray of FIG. 38.
Figure 40:
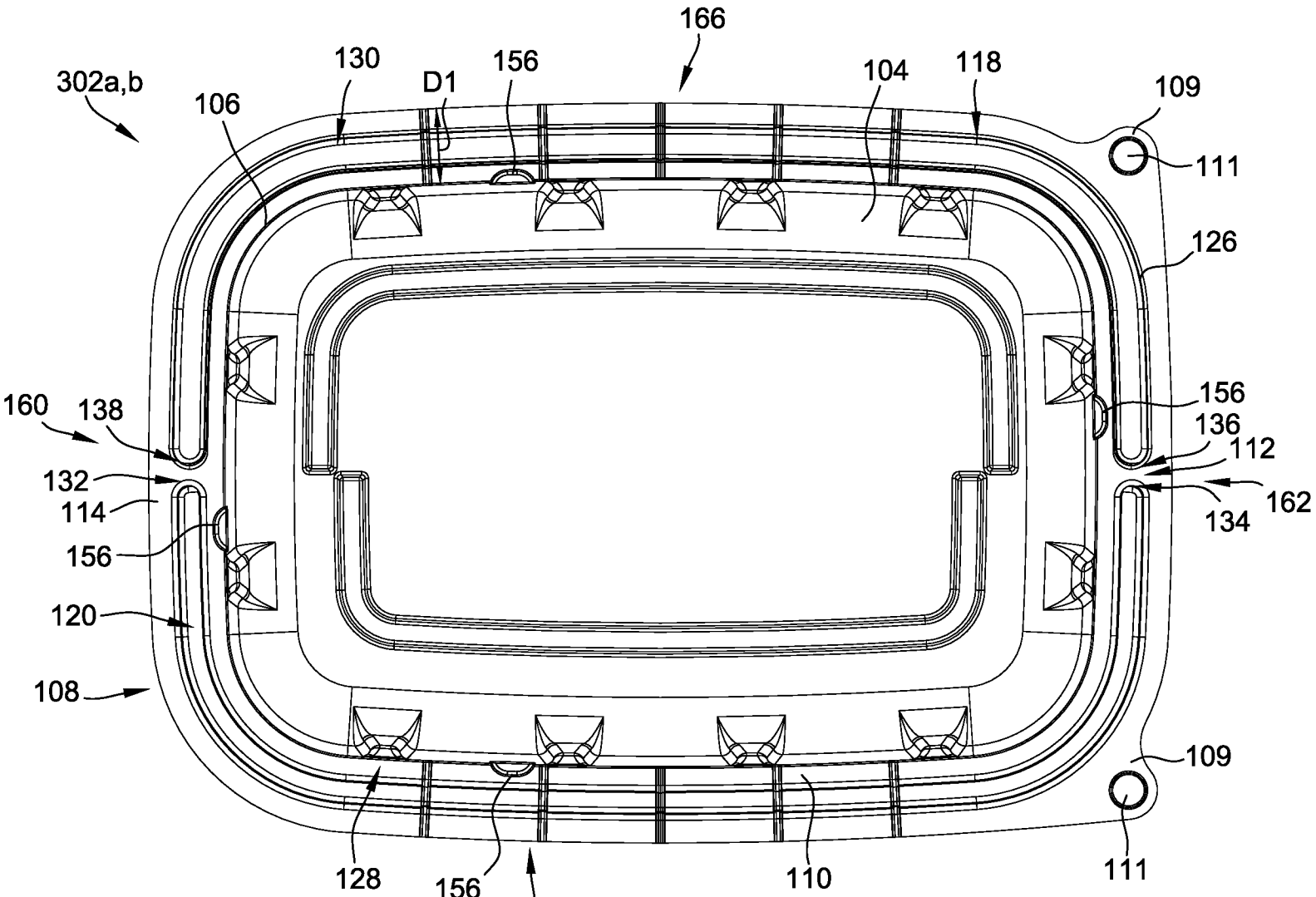
FIG. 40 is a bottom plan view of the tray of FIG. 38.

Referring now to FIGS. 35-37, another example container 300 is shown having vent channels formed at different locations than vent channels of the containers 100 and 200. The container 300, like the containers 100 and 200 described above, is formed from a pair of trays 302*a* and 302*b* having a substantially identical profile. The first tray 302*a* engages with the second tray 302*b* inverted relative to the first tray to form the container 300 in the closed configuration shown in FIGS. 35-37. FIGS. 38-40 depict various isolated views of the substantially identically-profiled trays 302*a* and 302*b*. For convenience, the first tray 302*a* and the second tray 302*b* will be referred to as the tray 302*a/b* where common features and elements are being described. The tray 302*a/b* has similar elements and components as described above for the tray 102*a/b* used to form the container 100 and the tray 202*a/b* used to form the container 200. Corresponding reference numerals are used to describe corresponding elements and features of the tray 202*a/b* and the container 200 that are included in the tray 102*a*/102*b* and the container 100 described above with reference to FIGS. 1-26 and the tray 202*a*/202*b* and the container 200 described above with references to FIGS. 27-34.

In this example, the tray 302*a/b* includes the vent channels 204 described above for the tray 202*a/b* and vent channels 304 defined in the rim 108 and located at the second side 166 of the tray 302*a/b*. Like the vent channels 142 and 204 described above, each vent channel 304 is defined by a radially-extending groove in an outer surface of the rim 108. In particular, the vent channels 304 are defined by grooves that extend from the sidewall 106 and radially along the rim 108. In the illustrated example, the vent channels 304 of the tray 302*a/b*, like the vent channels 204, extend the radial distance $D_1$ of the rim 108. The vent channels 304 extend across the proximal segment 110, the downwardly-extending member 118, and the distal segment 114. In some examples, the vent channels 304 may terminate prior to the peripheral edge of the rim 108. For example, the vent channels 304 may be defined in the proximal segment 110 and at least a portion of the downwardly-extending member 118, and terminate prior to the distal segment 114. In other examples, the vent channels 304 may be defined in the proximal segment 110, the downwardly-extending member 118, and a portion of the distal segment 114 radially inboard of the peripheral edge of the rim 108.

In the example tray 302*a/b*, five vent channels 204 and five vent channels 304 are included. Each of the five vent channels 204 is located at the first side 164 of the tray 302*a/b* and is defined in the proximal segment 110, the upwardly-extending member 116, and the distal segment 114, and each of the five vent channels 304 is located at the second side 166 of the tray 302*a/b* and is defined in the proximal segment 110, the downwardly-extending member 118, and the distal segment 114. More or fewer vent channels 204 and/or vent channels 304 may be included in the tray 202*a/b*. Additionally and/or alternatively, some of the vent channels 204 and/or 304 may be defined at other locations on the rim 108 (such as at the first end 160 or the second end 162 of the tray 202*a/b*, between ends of the upwardly-extending member 116 and the downwardly-extending member 118 as described above for the vent channels 142). While each of the vent channels 204 and 304 is coextensive in length, that is, each extends the radial distance $D_1$ of the rim 108, some of the vent channels 204 and/or 304 may be shorter in extent and terminate prior to the peripheral edge of the rim 108. In some examples, the vent channels 204 are not included in the tray 302*a/b*.

Figure 41:
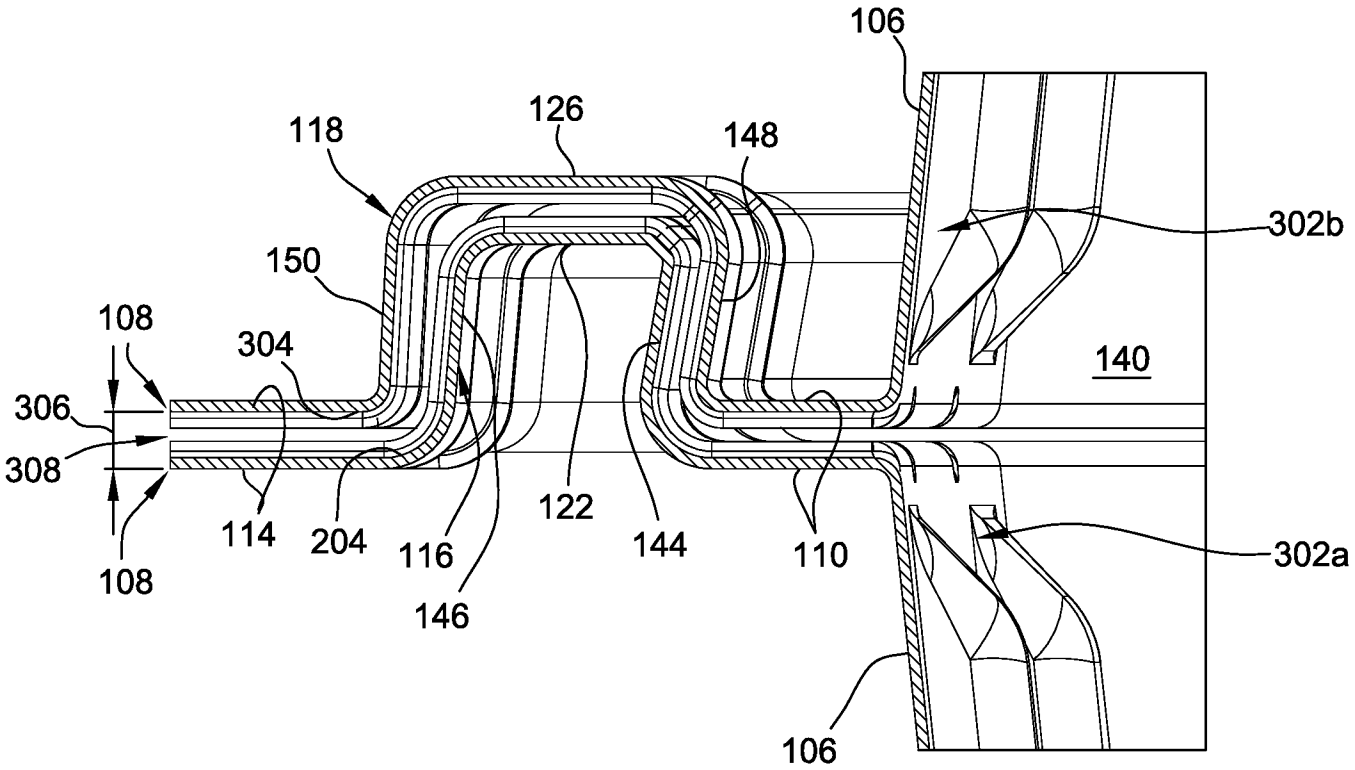
FIG. 41 is a cross-section of engaged rims of the trays to close the container of FIGS. 35-37, taken along line 41-41 in FIGS. 36 and 37.
Figure 42:
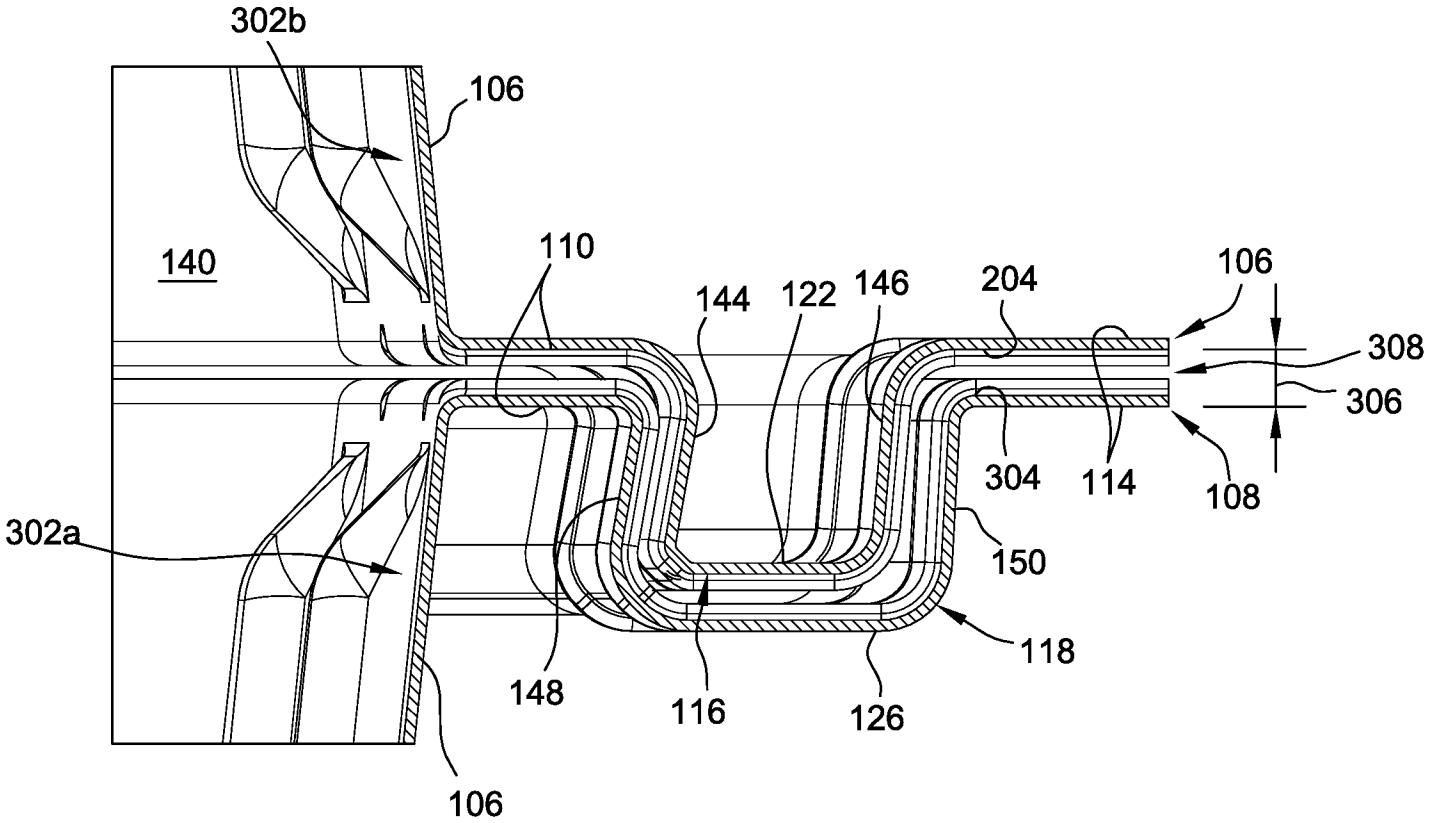
FIG. 42 is another cross-section of engaged rims of the trays to close the container of FIGS. 35-37, taken along line 42-42 in FIGS. 36 and 37.

When the first tray 302*a* engages the inverted second tray 302*b* to close the container 300 (shown in FIGS. 35-37), the vent channels 204 and 304 are in communication with the interior volume 140 of the container 300 (shown in FIGS. 41 and 42). Each of the vent channels 204 and 304, which extend the radial distance $D_1$ in the example tray 302*a/b*, creates a continuous path (shown in FIGS. 41 and 42) from the interior volume 140 that extends through the engaged rims 108 of the trays 302*a* and 302*b* to the periphery of the closed container 300. Further, when the container 300 is closed, each of the vent channels 204 defined in the rim 108 of the first tray 302*a* align with one of the vent channels 304 defined in the rim 108 of the second tray 302*b*. Similarly, when the container 300 is closed, each of the vent channels 204 defined in the rim 108 of the second tray 302*a* align with one of the vent channels 304 defined in the rim 108 of the first tray 302*a*. This is indicated in FIGS. 36 and 37, which show the ridges corresponding to grooves that define the vent channels 204 and 304 extending on both sides of the container 300 when viewed from the top and the bottom. In other examples, the vent channels 204 of the first tray 302*a* and/or the second tray 302*b* may not align (i.e., are offset) with the vent channels 304 of the second tray 302*b* and/or the first tray 302*a*, respectively, when the trays are engaged to close the container 200.

FIGS. 41 and 42 are cross-sections depicting the vent channels 204 and 304 extending the radial distance $D_1$ across the rims 108 and the continuous paths that the aligned vent channels 204 and 304 create through the rims 108 of the trays 302*a* and 302*b* when engaged. FIG. 41 is a cross-section of the rims 108 of the engaged trays 302*a* and 302*b*, taken along line 41-41 in FIGS. 36 and 37, and depicts a continuous path that a vent channel 204 of the first tray 302*a* aligned with a vent channel 304 of the second tray 302*b* create through the engaged rims 108. FIG. 42 is a cross-section of the rims 108 of the engaged trays 302*a* and 302*b*, taken along line 42-42 in FIGS. 36 and 37, and depicts a continuous path that a vent channel 204 of the second tray 302*b* aligned with a vent channel 304 of the first tray 302*a* create through the engaged rims 108. As shown in FIGS. 41 and 42, each aligned pair of vent channels 204 and 304 defines the continuous path from the interior volume 140 of the closed container 300 to the periphery of the engaged rims 108. In particular, the each aligned pair of vent channels 204 and 304 defines a gap distance 306 between the proximal segments 110, the upper and lower beads 122 and 126, and the distal segments 114 of the trays 302*a* and 302*b*. The gap distance 306 may be constant or may vary along the radial extent of the aligned pair of vent channels 204 and 304. The gap distance 306 may also vary between aligned pairs of vent channels 204 and 304. Suitably, for each aligned pair of vent channels 204 and 304, the gap distance 306 exists along the entire extent of the aligned pair of vent channels to create the continuous path from the interior volume, between the engaged rims 108, and to the periphery of the container 300 and enable heat and moisture to exit the closed container 300. The gap distance 306 may, in some examples, be greater than the gap distance 206 described above with reference to FIGS. 33 and 34. Alternatively, the gap distance 306 may be approximately the same as the gap distance 206. For example, providing the aligned pairs of vent channels 204 and 304 to create the gap distance 306, rather than a single vent channel 204 that creates the gap distance 206, may enable the vent channels 204 and 304 of the tray 302*a/b* to be shallower in depth than the vent channels 204 of the tray 202*a/b* while still providing approximately the same gap distance (i.e., venting area between the engaged rims).

Like the vent channels 204 described above for the tray 202*a/b*, the aligned pairs of vent channels 204 and 304 in the tray 302*a/b* may suitably extend the radial distance $D_1$ of the rim 108 and create the continuous paths between the rims 108 of the engaged trays 302*a* and 302*b* while also facilitating reducing or eliminating the propensity of liquid to leak out of the container 300 through these paths. As described above, each path created by an aligned pair of vent channels 204 and 304 is a tortuous path through which liquid must flow prior to reaching openings 308 at the periphery of the closed container 300 that are respectively formed by one of the aligned pair of vent channels. The tortuous paths through the engaged rims 108 created by the aligned pairs of vent channels 204 and 304 limit the ability of liquid to leak out of the container 300, while still enabling heat and moisture-entrained air (e.g., steam) to flow through these paths and thus enabling venting of the container 300.

Figure 20:
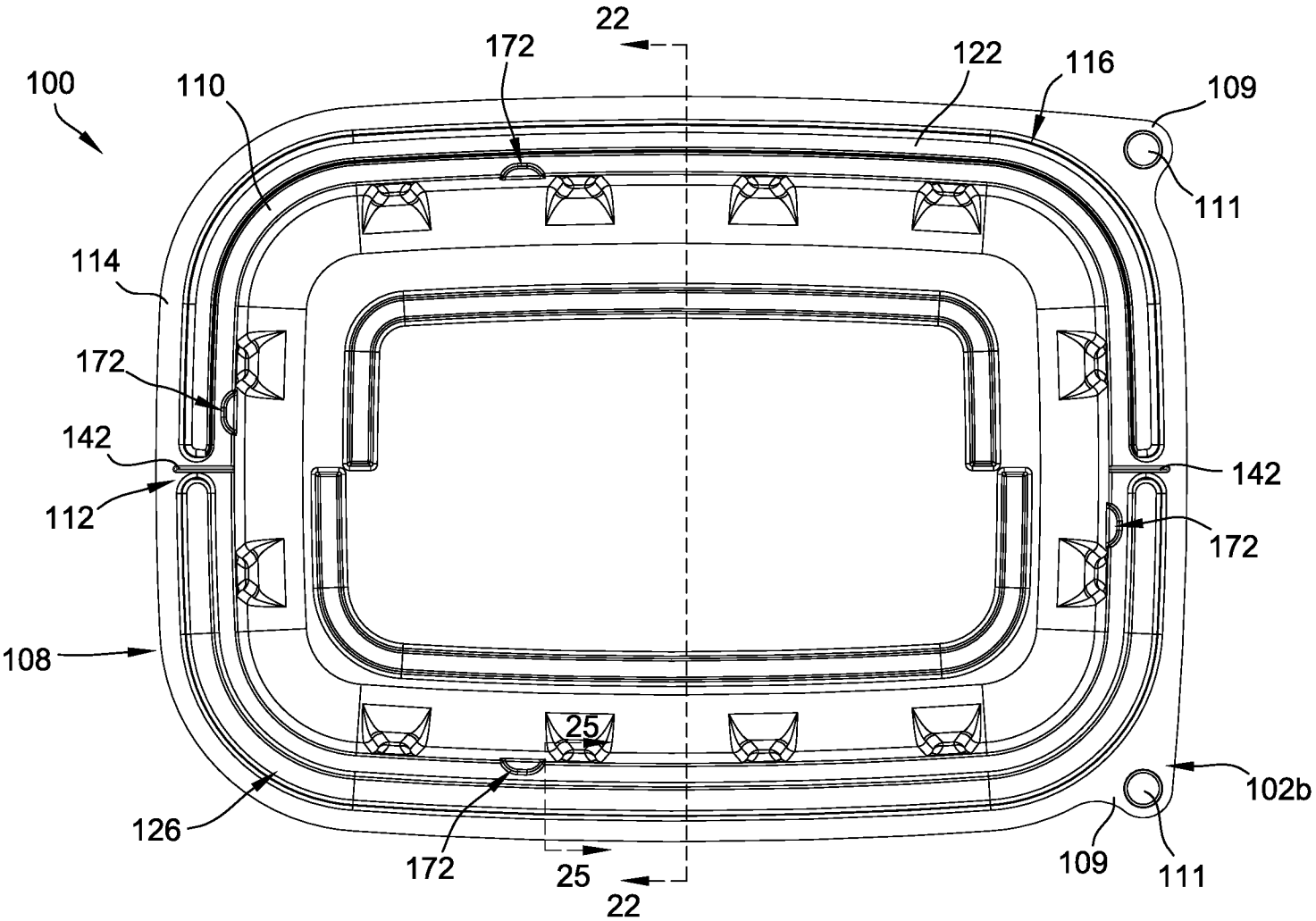
FIG. 20 is a top plan view of the trays of the container stacked in the same orientation.
Figure 21:
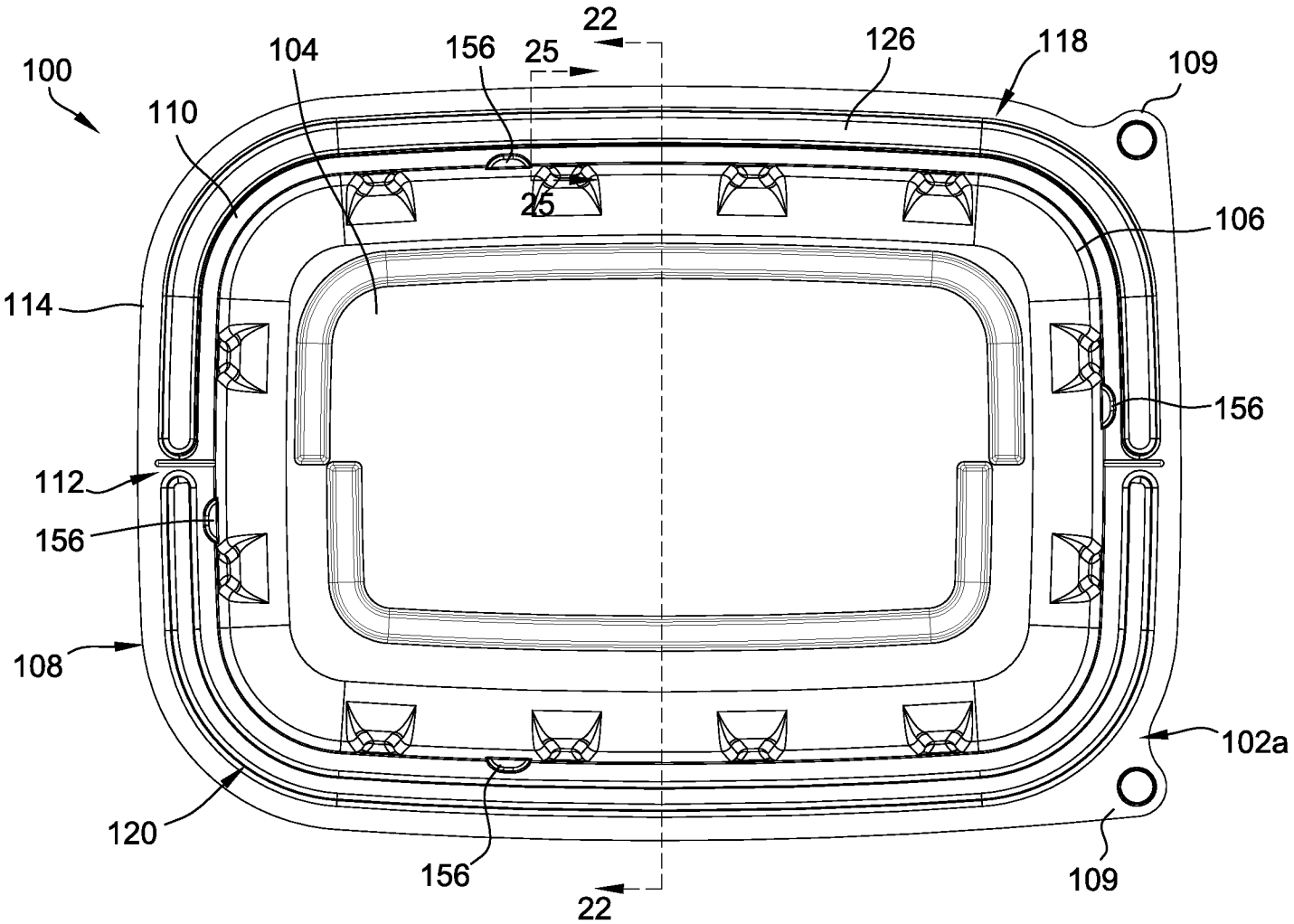
FIG. 21 is a bottom plan view of the trays of the container stacked in the same orientation.
Figure 22:
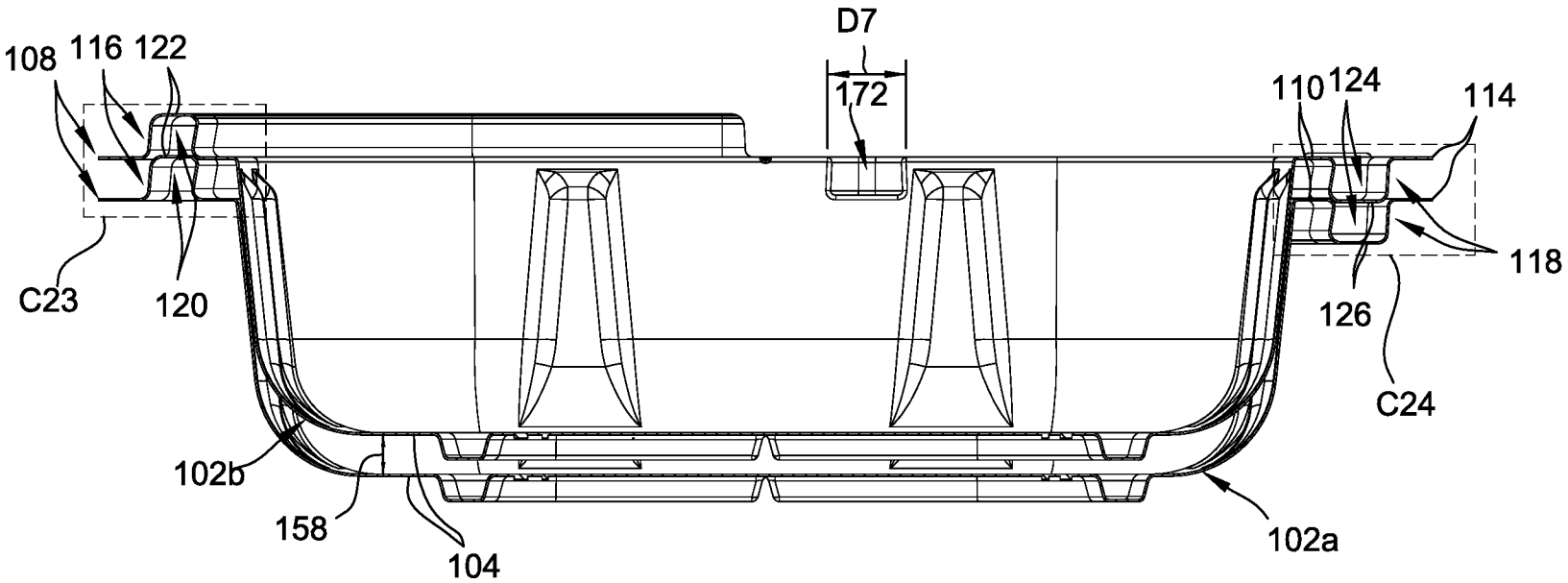
FIG. 22 is a cross-section of the trays of the container stacked in the same orientation, taken along line 22-22 in FIGS. 20 and 21.
Figure 24:
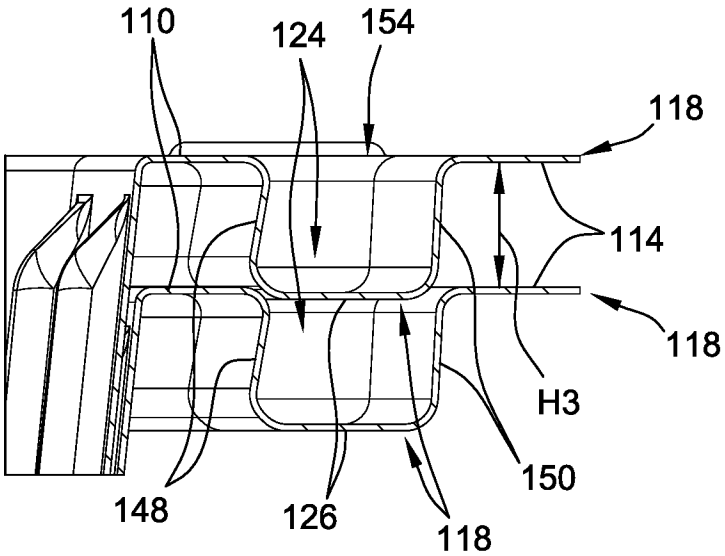
FIG. 24 is a magnified view of section $C_{24}$ in FIG. 22.
Figure 23:
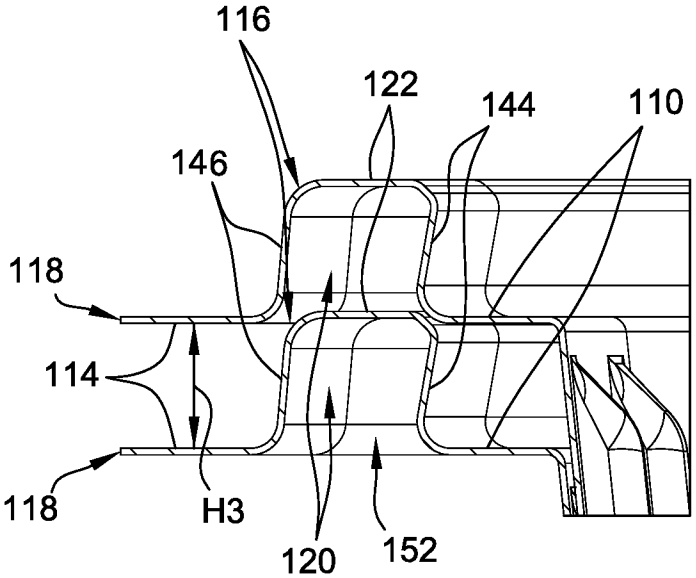
FIG. 23 is a magnified view of section $C_{23}$ in FIG. 22.

Referring now to FIGS. 16-25, denesting features included in the example tray 102*a/b* of the container 100 will now be described. The denesting features described for the tray 102*a/b* apply equally to the tray 202*a/b* and 302*a/b* described above, which include similar elements and components as the tray 102*a/b*. In the illustrated example, the upwardly-extending member 116 and the downwardly-extending member 118 of the tray 102*a/b* facilitate denesting when the first tray 102*a* and the second tray 102*b* are stacked in a same orientation. FIGS. 16-21 are various views of the container 100 that depict the trays 102*a* and 102*b* stacked in the same orientation. FIG. 22 is a cross-section depicting the trays 102*a* and 102*b* stacked in the same orientation, taken along line 22-22 in FIGS. 20 and 21. FIG. 23 is a magnified view of section $C_{23}$ in FIG. 22, and depicts, in greater detail, the engagement between the upwardly-extending member 116 of the first tray 102*a* and the rim 108 of the second tray 102*b* to limit movement of the first and second trays 102*a* and 102*b* relative to one another when stacked in the same orientation. FIG. 24 is a magnified view of section $C_{24}$ in FIG. 22, and depicts, in greater detail, the engagement between the downwardly-extending member 116 of the second tray 102*b* and the rim 108 of the first tray 102*a* to limit movement of the first and second trays 102*a* and 102*b* relative to one another when stacked in the same orientation.

As shown in FIGS. 16-22, when the trays 102*a* and 102*b* are stacked in the same orientation, the cover portion 104 and the sidewall 106 of the second tray 102*b* are received in the interior 105 of the first tray 102*a*. For each tray 102*a/b*, an opening to the interior 105 defined by the sidewall 106 and the rim 108 is suitably sized and shaped to enable the stacking arrangement of the trays 102*a* and 102*b* shown in FIGS. 16-22. In particular, the trays 102*a* and 102*b* are able to be stacked in the same orientation as shown in FIGS. 16-22 without the cover portion 104 or the sidewall 106 of the second tray 102*b* contacting the rim 108 of the first tray 102*a* which would otherwise limit downward movement of the second tray relative to the first tray and inhibit stacking. Additionally, the interior 105 and the sidewall 106 of the tray 102*a/b* are suitably sized and shaped to enable the sidewall 106 of the second tray 102*b* to be substantially received in the interior 105 of the first tray 102*a* a sufficient depth without limiting downward movement of the second tray relative to the first tray (e.g., by frictional engagement between the sidewalls of the trays). As such, when the first tray 102*a* and the second tray 102*b* are stacked in the same orientation, the cover portion 104 and the sidewall 106 of the second tray 102*b* are received in the interior 105 of the first tray 102*a* a depth at which the rims 108 of the trays contact one another (shown in FIG. 22). At or before this depth, some contact between the sidewalls 106 of the trays 102*a* and 102*b* may exist, but downward movement of the second tray 102*b* relative to the first tray 102*a* is suitably only substantially limited by engagement between the rims 108 of the stacked trays and/or other denesting features (e.g., denesting lugs 156) of the trays described below.

When the trays 102*a* and 102*b* are stacked in the same orientation, the upwardly-extending member 116 of the first tray 102*a* engages the rim 108 of the second tray 102*b* proximate the opening 152 to the first cavity 120 of the second tray. The downwardly-extending member 118 of the second tray 102*b* also engages the rim 108 of the first tray 102*a* proximate the opening 154 to the second cavity 124 of the first tray. In the illustrated example, downward movement of the second tray 102*b* relative to the first tray 102*a* is restricted (e.g., limited or inhibited) by the engagement between the upwardly-extending member 116 of the first tray 102*a* and the rim 108 of the second tray 102*b* and/or by the engagement between the downwardly-extending member 118 of the second tray 102*b* and the rim 108 of the first tray 102*a*. In particular, when the trays 102*a* and 102*b* are stacked in the same orientation, the upwardly-extending member 116 of the first tray 102*a* may be restricted (e.g., limited or inhibited) from being received in the first cavity 120 of the second tray 102*b* and/or the downwardly-extending member 118 of the second tray 102*b* may be restricted (e.g., limited or inhibited) from being received in the second cavity 124 of the first tray 102*a*.

As described above with reference to FIG. 14, the distance between the first inner wall 144 and the first outer wall 146 of the upwardly-extending member 116 of the tray 102*a/b* generally increases as the upwardly-extending member 116 extends toward the upper bead 122 and away from the opening 152 to the first cavity 120. As such, the maximum radial distance $D_2$ is defined between the first inner wall 144 and the first outer wall 146 proximate the upper bead 122 that is greater than the minimum radial distance $D_3$ defined proximate the opening 152 to the first cavity 120. When the trays 102*a* and 102*b* are stacked in the same orientation, the upper bead 122 of the upwardly-extending member 116 of the first tray 102*a* engages the rim 108 of the second tray 102*b* proximate the opening 152 to the first cavity 120 of the second tray, and may be restricted from being received in the first cavity of the second tray due to the difference between the maximum radial distance $D_2$ and the minimum radial distance $D_3$. Additionally and/or alternatively, the upper bead 122 of the first tray 102*a* may engage the proximal segment 110 and/or the distal segment 114 of the second tray 102*b* when the trays are stacked to restrict the upper bead of the first tray from being received in the first cavity of the second tray. For example, the first inner wall 144 may extend at the oblique angle $\alpha$ such that the upper bead 122 extends a sufficient distance over the proximal segment 110 and such that, when the trays 102*a* and 102*b* are stacked in the same orientation, sufficient engagement between the upper bead 122 of the first tray 102*a* and the proximal segment 110 of the second tray 102*b* occurs to limit downward movement of the second tray relative to the first tray. Additionally and/or alternatively, the first outer wall 146 may extend at the oblique angle $\beta$ such that the upper bead 122 extends a sufficient distance over the distal segment 114 and such that, when the trays 102*a* and 102*b* are stacked in the same orientation, sufficient engagement between the upper bead 122 of the first tray 102*a* and the distal segment 114 of the second tray 102*b* occurs to restrict (e.g., limit or inhibit) downward movement of the second tray relative to the first tray.

As described above with reference to FIG. 15, the distance between the second inner wall 148 and the second outer wall 150 of the downwardly-extending member 118 of the tray 102*a/b* generally increases as the downwardly-extending member 118 extends toward the lower bead 126 and away from the opening 154 to the second cavity 124. As such, the maximum radial distance $D_4$ is defined between the second inner wall 148 and the second outer wall 150 proximate the lower bead 126 that is greater than the minimum radial distance $D_5$ defined proximate the opening 154 to the second cavity 124. When the trays 102*a* and 102*b* are stacked in the same orientation, the lower bead 126 of the downwardly-extending member 118 of the second tray 102*b* engages the rim 108 of the first tray 102*a* proximate the opening 154 to the second cavity 124 of the first tray, and may be restricted from being received in the second cavity of the first tray due to the difference between the maximum radial distance $D_4$ and the minimum radial distance $D_5$. Additionally and/or alternatively, the lower bead 126 of the second tray 102*b* may engage the proximal segment 110 and/or the distal segment 114 of the first tray 102*a* when the trays are stacked to restrict the lower bead of the second tray from being received in the second cavity of the first tray. For example, the second inner wall 148 may extend at the oblique angle $\varphi$ such that the lower bead 126 extends a sufficient distance over the proximal segment 110 and such that, when the trays 102*a* and 102*b* are stacked in the same orientation, sufficient engagement between the lower bead 126 of the second tray 102*b* and the proximal segment 110 of the first tray 102*a* occurs to limit downward movement of the second tray relative to the first tray. Additionally and/or alternatively, the second outer wall 150 may extend at the oblique angle $\theta$ such that the lower bead 126 extends a sufficient distance over the distal segment 114 and such that, when the trays 102*a* and 102*b* are stacked in the same orientation, sufficient engagement between the lower bead 126 of the second tray 102*b* and the distal segment 114 of the first tray 102*a* occurs to restrict (e.g., limit or inhibit) downward movement of the second tray relative to the first tray.

The engagement between the upper bead 122 of the first tray 102*a* and the rim 108 of the second tray 102*b* and/or between the lower bead 122 of the second tray and the rim 108 of the first tray may be sufficient to restrict (e.g., limit or inhibit) downward movement of the second tray relative to the first tray even in response to a considerable amount of applied force exerted on the second tray in an attempt to move the second tray downward relative to the first tray when the trays are stacked in the same orientation. For example, the engagement between the upper bead 122 of the first tray 102*a* and the rim 108 of the second tray 102*b* and/or between the lower bead 122 of the second tray and the rim 108 of the first tray may be sufficient to restrict (e.g., limit or inhibit) downward movement of the second tray relative to the first tray even when a user exerts a pushing force on the second tray in an earnest attempt to move the second tray farther downward relative to the first tray. This may suitably restrict (e.g., limit or inhibit) downward movement of the second tray 102*b* relative to the first tray 102*a* even when multiple additional trays 102*a/b* are stacked in the same orientation on the second tray and the first tray, thereby maintaining the stacked trays in a denested state.

In the illustrated example, engagement between the upwardly-extending member 116 of the first tray 102*a* and the rim 108 of the second tray 102*b* and engagement between the downwardly-extending member 118 of the second tray 102*b* and the rim 108 of the first tray 102*a* both occur to restrict (e.g., limit or inhibit) downward movement of the second tray relative to the first tray when the trays are stacked in the same orientation. Such may be the case where the height $H_1$ of the upper bead 122 and the height $H_2$ of the lower bead 126 are approximately the same. In some examples, only engagement between the upwardly-extending member 116 of the first tray 102*a* and the rim 108 of the second tray 102*b* may occur to restrict downward movement of the second tray relative to the first tray when the trays are stacked in the same orientation. Such may be the case where the height $H_1$ of the upper bead 122 is greater than the height $H_2$ of the lower bead 126. In some examples, only engagement between the downwardly-extending member 118 of the second tray 102*b* and the rim 108 of the first tray 102*a* may occur to restrict downward movement of the second tray relative to the first tray when the trays are stacked in the same orientation. Such may be the case where the height $H_1$ of the upper bead 122 is shorter than the height $H_2$ of the lower bead 126.

Suitably, the restricted (e.g., limited or inhibited) downward movement of the second tray 102*b* relative to the first tray 102*a* when the trays are stacked in the same orientation facilitates maintaining the stacked trays in a denested state and enables easy separation of the stacked trays. As shown in FIGS. 23 and 24, the distal segments 114 of the stacked trays 102*a* and 102*b* are spaced apart a denested height $H_3$ at the point where downward movement of the second tray 102*b* relative to the first tray 102*a* is restricted by the engagement between the rims 108 of the stacked trays. The denested height $H_3$ may be approximately equal to the height $H_1$ of the upper bead 122 and/or the height $H_2$ of the lower bead 126. In some examples, the denested height $H_3$ may be slightly shorter than the height $H_1$ of the upper bead 122 and/or the height $H_2$ of the lower bead 126. For example, when the trays are stacked in the same orientation, the upper bead 122 of the first tray 102*a* may be received in the first cavity 120 of the second tray 102*b* a minimal (e.g., negligible) depth where there is a minimal (e.g., negligible) increase in distance from the minimum radial distance $D_3$ at the opening 152 to the first cavity of the second tray and/or the lower bead 126 of the second tray 102*b* may be slightly received in the second cavity 124 of the first tray 102*a* where there is a minimal (e.g., negligible) increase in the minimum radial distance $D_5$ at the opening 154 to the second cavity of the first tray.

The height $H_3$ that the distal segments 114 of the stacked trays 102*a* and 102*b* are spaced apart may be any suitable distance to enable a user to grasp the distal segments individually and separate the stacked trays. For example, the height $H_3$ may be a distance of between 0.01 inches to 2 inches, such as between 0.01 inches to 1 inch, between 0.01 inches to 0.5 inches, between 0.01 inches to 0.4 inches, between 0.01 inches to 0.3 inches, between 0.01 inches to 0.2 inches, between 0.05 inches to 2 inches, between 0.05 inches to 1 inch, between 0.05 inches to 0.5 inches, between 0.05 inches to 0.4 inches, between 0.05 inches to 0.3 inches, between 0.05 inches to 0.2 inches, between 0.075 inches to 2 inches, between 0.075 inches to 1 inch, between 0.075 inches to 0.5 inches, between 0.075 inches to 0.4 inches, between 0.075 inches to 0.3 inches, between 0.075 inches to 0.2 inches, between 0.1 inches to 2 inches, between 0.1 inches to 1 inch, between 0.1 inches to 0.5 inches, between 0.1 inches to 0.4 inches, between 0.1 inches to 0.3 inches, between 0.1 inches to 0.2 inches, between 0.15 inches to 2 inches, between 0.15 inches to 1 inch, between 0.15 inches to 0.5 inches, between 0.15 inches to 0.4 inches, between 0.15 inches to 0.3 inches, or between 0.15 inches to 0.2 inches. In various examples, the height $H_3$ may be a distance of about 0.01 inches, about 0.025 inches, about 0.05 inches, about 0.075 inches, about 0.1 inches, about 0.125 inches, about 0.15 inches, about 0.175 inches, about 0.2 inches, about 0.25 inches, about 0.3 inches, about 0.35 inches, about 0.4 inches, about 0.45 inches, about 0.5 inches, about 0.55 inches, about 0.6 inches, about 0.65 inches, about 0.7 inches, about 0.75 inches, about 0.8 inches, about 0.85 inches, about 0.9 inches, about 0.95 inches, or about 1 inch.

As shown in FIG. 22, the restricted (e.g., limited or inhibited) downward movement of the second tray 102*b* relative to the first tray 102*a* creates a stacking gap 158 between the cover portions 104 of the trays when stacked. The stacking gap 158 may enable easy separation of the stacked trays 102*a* and 102*b*. The stacking gap 158 suitably has a similar height as the denested height $H_3$ between the distal segments 114 of the stacked trays 102*a* and 102*b*. The existence of the stacking gap 158 increases the total height of the stacked trays 102*a* and 102*b* and, as a result, may increase the volume footprint of the stacked trays. The denested height $H_3$ may therefore be selected from the ranges and values described above to facilitate denesting of the stacked trays 102*a* and 102*b* while also facilitating minimizing the increase volume footprint of the stacked trays created by the stacking gap 158.

With additional reference to FIGS. 1-11, the tray 102*a/b* also includes denesting lugs 156 that facilitate limiting downward movement of the second tray 102*b* relative to the first tray 102*a* when the trays are stacked in the same orientation. Each denesting lug 156 is located at the intersection of the rim 108 and the sidewall 106, and extends outwardly from the sidewall 106 adjacent the proximal segment 110. When the first tray 102*a* and the second tray 102*b* are stacked in the same orientation, the denesting lugs 156 of the second tray 102*b* engage the rim 108 of the first tray 102*a* to restrict (e.g., to limit or inhibit) downward movement of the second tray relative to the first tray. The denesting lugs 156 may be included to restrict downward movement in addition to or in the alternative to the engagement between the upwardly-extending member 116 of the first tray 102*a* and/or the downwardly-extending member 118 of the second tray 102*b* as described above. That is, in some examples, the denesting lugs 156 may restrict downward movement of the second tray 102*b* relative to the first tray 102*a* when the trays are stacked such that the upwardly-extending member 116 of the first tray does not engage the rim 108 of the second tray and the downwardly-extending member 118 of the second tray does not engage the rim 108 of the first tray. In other examples, the denesting lugs 156 may restrict downward movement of the second tray 102*b* relative to the first tray 102*a* when the trays are stacked in conjunction with the upwardly-extending member 116 of the first tray engaging the rim 108 of the second tray and/or in conjunction with the downwardly-extending member 118 of the second tray engaging the rim 108 of the first tray.

Any suitable number of denesting lugs 156 may be included. In the illustrated example, the tray 102*a/b* includes four denesting lugs 156. Two of the denesting lugs 156 are located at opposite ends 160 and 162 of the tray 102*a/b*, and two of the denesting lugs 156 are located at opposite sides 164 and 166 of the tray 102*a/b*. In other examples, the tray 102*a/b* may include more or fewer denesting lugs 156, at any suitable location(s). The denesting lugs 156 are at the same relative locations on each tray 102*a* and 102*b* in this example. In other examples, the denesting lugs 156 of the first tray 102*a* may be at different relative locations on the trays 102*a* and 102*b*. In yet other examples, only one of the trays 102*a* and 102*b* may include the denesting lugs 156, for example, only the second tray 102*b* that is stacked on the first tray 102*a* may include the denesting lugs 156. In some examples, the denesting lugs 156 may not be included in either tray 102*a/b*.

Figure 25:
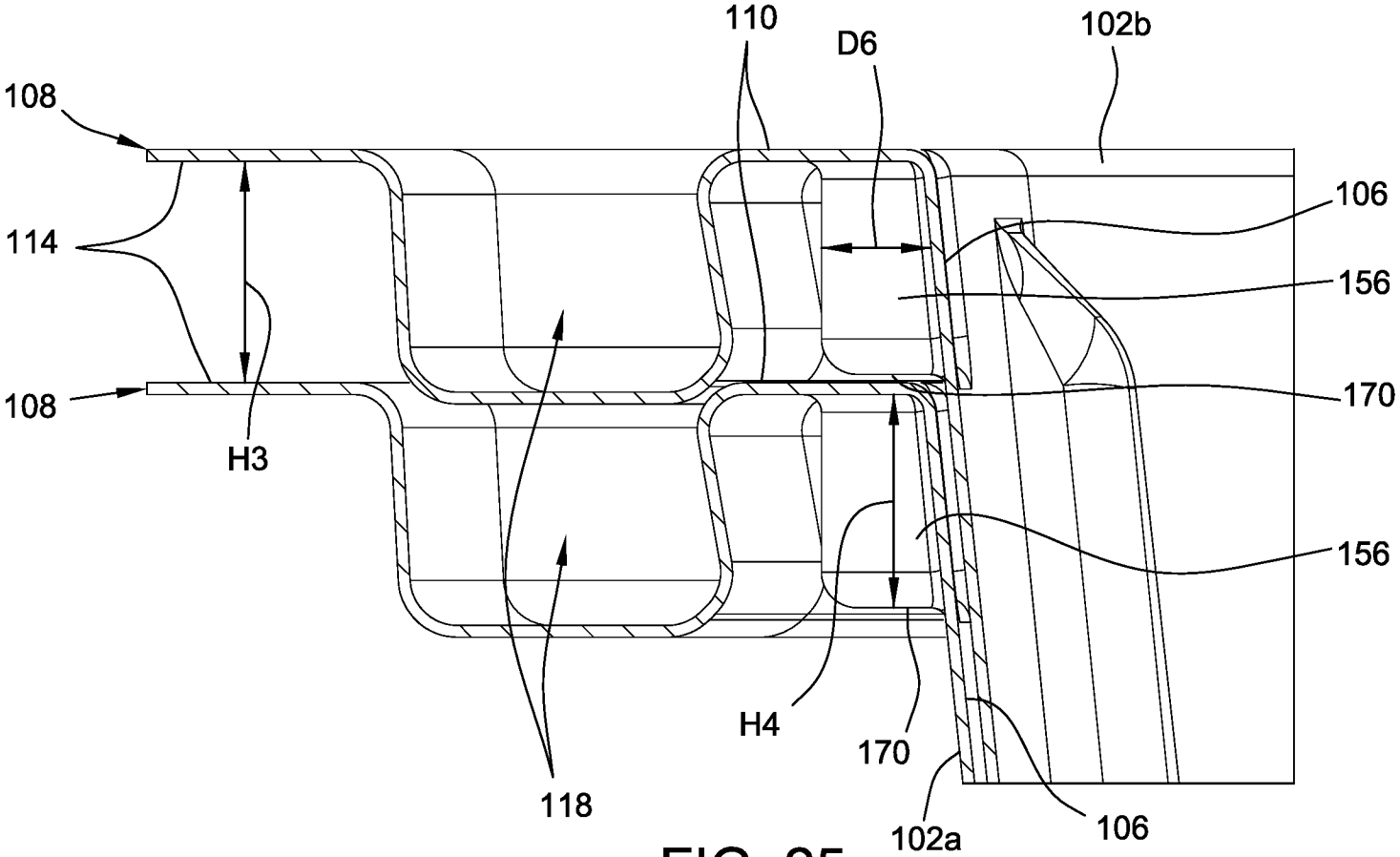
FIG. 25 is a cross-section of the rims of the trays of the container stacked in the same orientation, taken along line 25-25 in FIGS. 20 and 21.

FIG. 25 is a cross-section of the first tray 102*a* and the second tray 102*b* when stacked in the same orientation, taken along the line 25-25 in FIGS. 20 and 21, and depicts the engagement between a denesting lug 156 of the second tray 102*b* and the rim 108 of the first tray 102*a*. A denesting lug 156 of the first tray 102*a* and the second tray 102*b* are each shown in FIG. 25. The denesting lugs 156 of the trays 102*a* and 102*b* suitably have the same dimensions, and description of the denesting lugs with reference to FIG. 25 is equally applicable to the other denesting lugs not shown in FIG. 25. The denesting lugs 156 extend downwardly from the respective proximal segment 110 to a lug bottom 170. As shown in FIG. 25, the lug bottom 170 of the denesting lug 156 of the second tray 102*b* engages the proximal segment 110 of the first tray 102*a* to limit downward movement of the second tray relative to the first tray when the trays are stacked.

As shown, e.g., in FIG. 10, the denesting lugs 156 define corresponding recesses 172 in the proximal segment 110 of the tray 102*a/b* at the locations of the denesting lugs. The denesting lugs 156 and corresponding recesses 172 are suitably dimensioned to restrict the denesting lugs 156 of the second tray 102*b* from being received in the corresponding recesses 172 of the first tray 102*a* when the trays are stacked. As shown in FIG. 25, each denesting lug 156 has a radial lug distance $D_6$, measured as a distance that the denesting lug 156 extends outwardly from the sidewall 106, that gradually increases as the denesting lug 156 extends downwardly toward the lug bottom 170. As such, the radial lug distance $D_6$ is greater proximate the lug bottom 170 than proximate the proximal segment 110. The greater radial lug distance $D_6$ proximate the lug bottom 170 may enable the denesting lugs 156 of the second tray 102*b* to protrude outward beyond the corresponding recesses 172 in the first tray 102*a* and engage the proximal segment 110 without being substantially received in the corresponding recess 172. Additionally and/or alternatively, the denesting lug 156 may define a diameter, or distance $D_7$ (shown, e.g., in FIGS. 17 and 19) measured perpendicular to the radial distance $D_6$ of the denesting lug and perpendicular to the downward extent of the denesting lug, proximate the lug bottom 170 that enables engagement between the lug bottom 170 of the denesting lugs 156 of the second tray 102*b* and the proximal segment 110 of the first tray 102*a*. In particular, the distance $D_7$ may be greater proximate the lug bottom 170 than proximate the proximal segment 110, which may enable the denesting lug 156 to engage the proximal segment 110 without being substantially received in the corresponding recess 172.

Each denesting lug 156 also has a denesting lug height $H_4$ measured as the distance that the denesting lug extends downwardly from the proximal segment 110 to the lug bottom 170. The denesting lug height $H_4$ corresponds to the denesting height $H_3$ defined between the distal segments 114 of the stacked trays 102*a* and 102*b* as described above. In this regard, the denesting lug height $H_4$ is suitably approximately equal to or greater than the height $H_1$ of the upper bead 122 and approximately equal to or greater than the height $H_2$ of the lower bead 126. In examples where the denesting lugs 156 alone restrict (e.g., limit or inhibit) downward movement of the second tray 102*b* relative to the first tray 102*a* when the trays are stacked in the same orientation, that is, such that the upwardly-extending member 116 of the first tray does not engage the rim 108 of the second tray and the downwardly-extending member 118 of the second tray does not engage the rim 108 of the first tray, the denesting lug height $H_4$ is suitably greater than the height $H_1$ of the upper bead 122 and the height $H_2$ of the lower bead 126. In examples where the denesting lugs 156 restrict downward movement of the second tray 102*b* relative to the first tray 102*a* in conjunction with the upwardly-extending member 116 of the first tray engaging the rim 108 of the second tray and/or in conjunction with the downwardly-extending member 118 of the second tray engaging the rim 108 of the first tray, the denesting lug height $H_4$ is suitably approximately equal to the height $H_1$ of the upper bead 122 and/or approximately equal to the height $H_2$ of the lower bead 126. The denesting lug height $H_4$ may be approximately equal to the denesting height $H_3$, or the denesting lug height $H_4$ may be slightly greater than the denesting height $H_3$. In the latter case, the lug bottom 170 and the opening of the corresponding recess 172 at the proximal segment 110 may be contoured or curved, such that the lug bottom may be received into the corresponding recess a minimal depth prior to being restricted (e.g., limited or inhibited) from moving further downward into the recess by the greater radial lug distance $D_6$ proximate the lug bottom 170.

Referring to FIGS. 1-3, 11, 43 and 44, stacking features included in the example tray 102*a/b* for stacking the second tray inverted relative to the first stray and/or for stacking multiple containers 100 will now be described. The stacking features described for the tray 102*a/b* apply equally to the tray 202*a/b* and 302*a/b* described above, which include similar elements and components as the tray 102*a/b*. The tray 102*a/b* includes a first stacking member 176 and a second stacking member 178 located on the cover portion 104. The first and second stacking members 176 and 178 facilitate limiting lateral movement of the trays 102*a* and 102*b* when the second tray 102*b* is inverted relative to the first tray 102*a* and the cover portion 104 of the second tray is stacked on the cover portion 104 of the first tray, for example, and/or when two containers 100 formed from a pair of the trays 102*a* and 102*b* are stacked (shown in FIG. 43). Each of the first stacking member 176 and the second stacking member 178 is a stacking bar that extends outwardly from the outer surface 107 of the cover portion 104. The stacking bars 176 and 178 extend along the cover portion 104 proximate an outer edge of the cover portion 104, that is, proximate to the intersection between the cover portion 104 and the sidewall 106. The stacking bars 176 and 178 each have a "U-shape" profile in respectively extending proximate the outer edge of the cover portion 104. In particular, the U-shape profile for each stacking bar 176 and 178 extends along three adjacent sides of the tray 102*a/b*.

The first stacking bar 176 includes a first stacking bar segment 180*a*, a second stacking bar segment 180*b*, and a third stacking bar segment 180*c*. The stacking bar segments 180*a*-180*c* may also be referred to as bar segments 180*a*-180*c*. The first bar segment 180*a*, the second bar segment 180*b*, and the third bar segment 180*c* extend continuously (e.g., uninterrupted) from a first end 182 of the first stacking bar 176 to a second end 184 of the first stacking bar 176 and define the U-shape profile of the first stacking bar 176. The first bar segment 180*a* extends proximate a first outer edge end 186 of the cover portion 104. The first bar segment 180*a* extends from the first end 182 to the second bar segment 180*b*. The first bar segment 180*a* and the second bar segment 180*b* are coupled at an arcuate junction. The second bar segment 180*b* extends proximate a first outer edge side 188 of the cover portion 104. The second bar segment 180*b* extends from the first bar segment 180*a* to the third bar segment 180*c*. The second bar segment 180*b* and the third bar segment 180*c* are coupled at an arcuate junction. The third bar segment 180*c* extends proximate a second outer edge end 190 of the cover portion 104. The third bar segment 180*c* extends from the second bar segment 180*b* to the second end 184 of the first stacking bar 176.

The second stacking bar 178 includes a first stacking bar segment 194*a*, a second stacking bar segment 194*b*, and a third stacking bar segment 194*c*. The stacking bar segments 194*a*-194*c* may also be referred to as bar segments 194*a*-194*c*. The first bar segment 194*a*, the second bar segment 194*b*, and the third bar segment 194*c* extend continuously (e.g., uninterrupted) from a first end 196 of the second stacking bar 178 to a second end 198 of the second stacking bar 178 and define the U-shape profile of the second stacking bar 178. The first end 196 of the second stacking bar 178 is adjacent and outwardly offset from the first end 182 of the first stacking bar 176, and the second end 198 of the second stacking bar 178 is adjacent and outwardly offset from the second end 184 of the first stacking bar 176. The first bar segment 194*a* extends proximate the first outer edge end 186 of the cover portion 104. The first bar segment 194*a* extends from the first end 196 to the second bar segment 194*b*. The first bar segment 194*a* and the second bar segment 194*b* are coupled at an arcuate junction. The second bar segment 194*b* extends proximate a second outer edge side 192 of the cover portion 104. The second bar segment 194*b* extends from the first bar segment 194*a* to the third bar segment 194*c*. The second bar segment 194*b* and the third bar segment 194*c* are coupled at an arcuate junction. The third bar segment 194*c* extends proximate the second outer edge end 190 of the cover portion 104. The third bar segment 194*c* extends from the second bar segment 194*b* to the second end 198 of the second stacking bar 178.

The second stacking bar 178 is located outwardly offset from the first stacking bar 176. That is, each of the bar segments 194*a*-194*c* of the second stacking bar 178 is located in closer proximity to the outer edge of the cover portion 104, and farther from the central axis $A_1$ of the container 100, than the bar segments 180*a*-180*c*, respectively, of the first stacking bar 176. When the second tray 102*b* is inverted relative to the first tray 102*a* and the cover portion 104 of the second tray is stacked on the cover portion 104 of the first tray, the second stacking bar 178 of the second tray 102*b* envelops the first stacking bar 176 of the first tray 102*a* and the second stacking bar 178 of the first tray envelops the first stacking bar 176 of the second tray. As such, the first stacking bar 176 of the first tray 102*a* is engageable with the second stacking bar 178 of the second tray 102*b* and the first stacking bar 176 of the second tray is engageable with the second stacking bar 178 of the first tray, which limits lateral movement of the first tray and the second tray relative to one another when stacked in such an orientation. This also facilitates alignment of the second tray 102*b* on the first tray 102*a* in this stacking orientation. The U-shape profile of the stacking bars 176 and 178 and the location of the stacking bars 176 and 178 proximate the outer edge of the cover portion 104 also facilitate balancing the tray 102*a/b* and/or the container 100 formed from the trays 102*a* and 102*b* on a surface when used.

Figure 43:
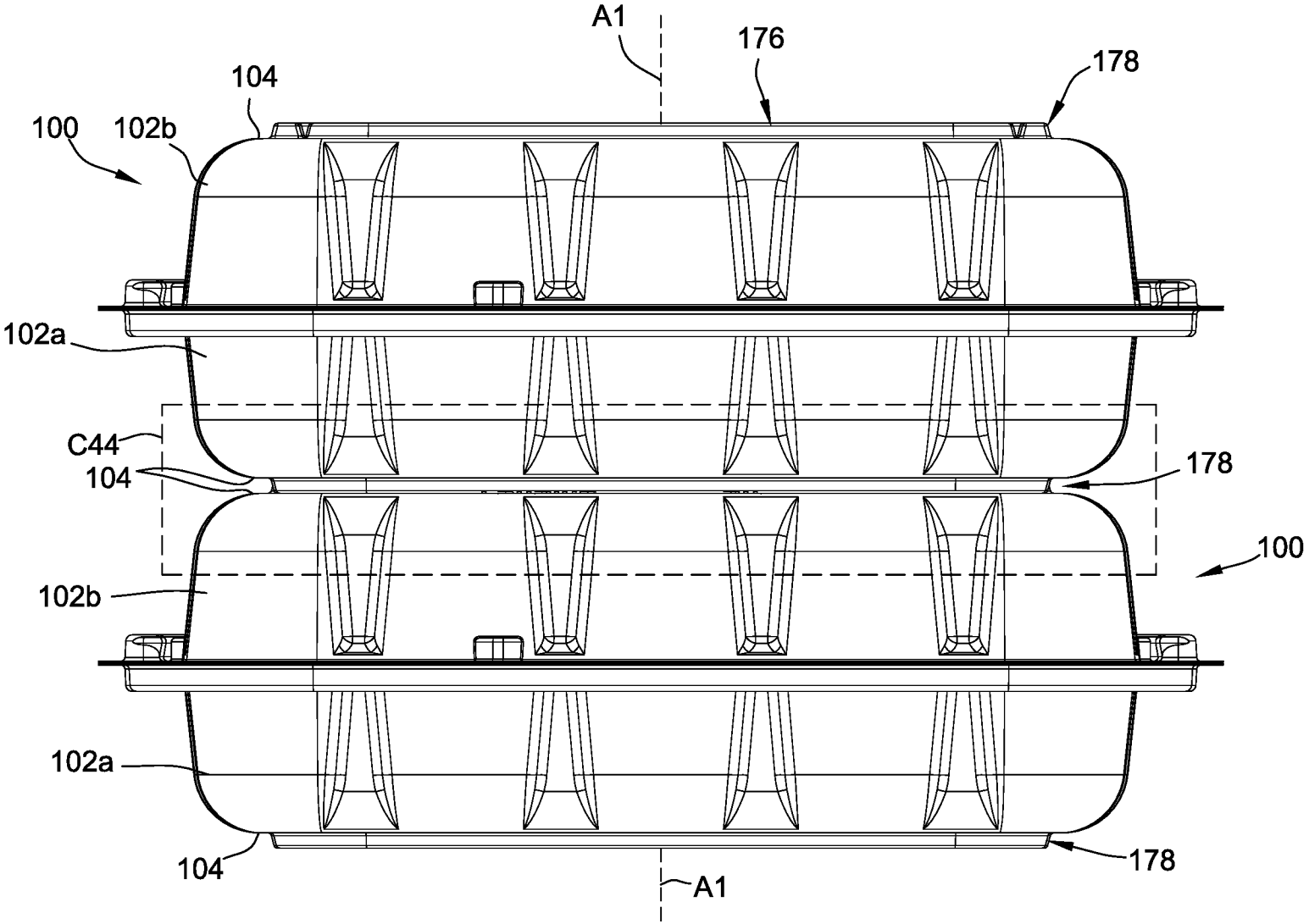
FIG. 43 is a side elevation of two containers as shown in FIGS. 1-8 stacked on top of one another.
Figure 44:
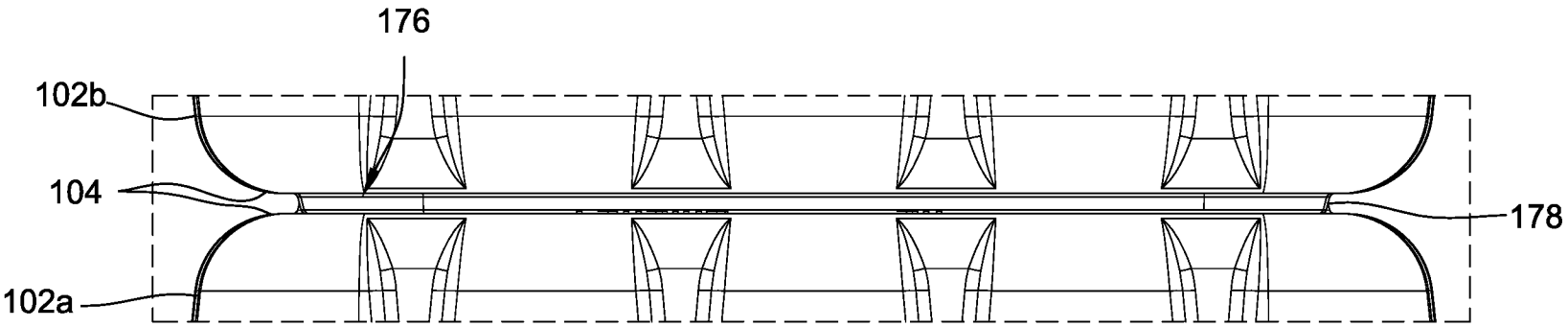
FIG. 44 is a cross-section of the section indicated at $C_{44}$ in FIG. 43.

Referring to FIGS. 43 and 44, the stacking bars 176 and 178 enable stacking multiple containers 100 while limiting the propensity of the containers 100 to move laterally relative to one another, that is, relative to the central axes $A_1$ of the containers 100. FIG. 43 is a side elevation view of two containers 100, one of the containers 100 stacked on the other of the containers 100. FIG. 44 depicts a magnified cross-section of the section $C_{44}$ in FIG. 43. As shown, when the containers 100 are stacked, the first tray 102*a* of a second (top) container 100 is inverted relative to the second tray 102*b* of a first (bottom) container 100, and the cover portion 104 of the first tray of the top container is stacked on the cover portion 104 of the second tray of the bottom container. The second stacking bar 178 of the first tray 102*a* of the top container 100 envelops the first stacking bar 176 of the second tray 102*b* of the bottom container 100, and the second stacking bar 178 of the second tray of the bottom container envelops the first stacking bar 176 of the first tray of the top container. As such, the first stacking bar 176 of the second tray 102*b* of the bottom container 100 is engageable with the second stacking bar 178 of the first tray 102*a* of the top container 100 and the first stacking bar 176 of the first tray of the top container is engageable with the second stacking bar 178 of the second tray of the bottom container. Engagement between the first stacking bars 176 and the respectively enveloping second stacking bars 178 limits lateral movement of the bottom container 100 and the top container 100 relative to one another and relative to the central axes $A_1$ of the containers when stacked, facilitates aligning the top container on the bottom container for stacking. The U-shape profile of the stacking bars 176 and 178 and the location of the stacking bars 176 and 178 proximate the outer edge of the cover portion 104 also facilitate balancing the stacked the containers 100 on a surface, as well as the individual containers on a surface when used.

Figure 45:
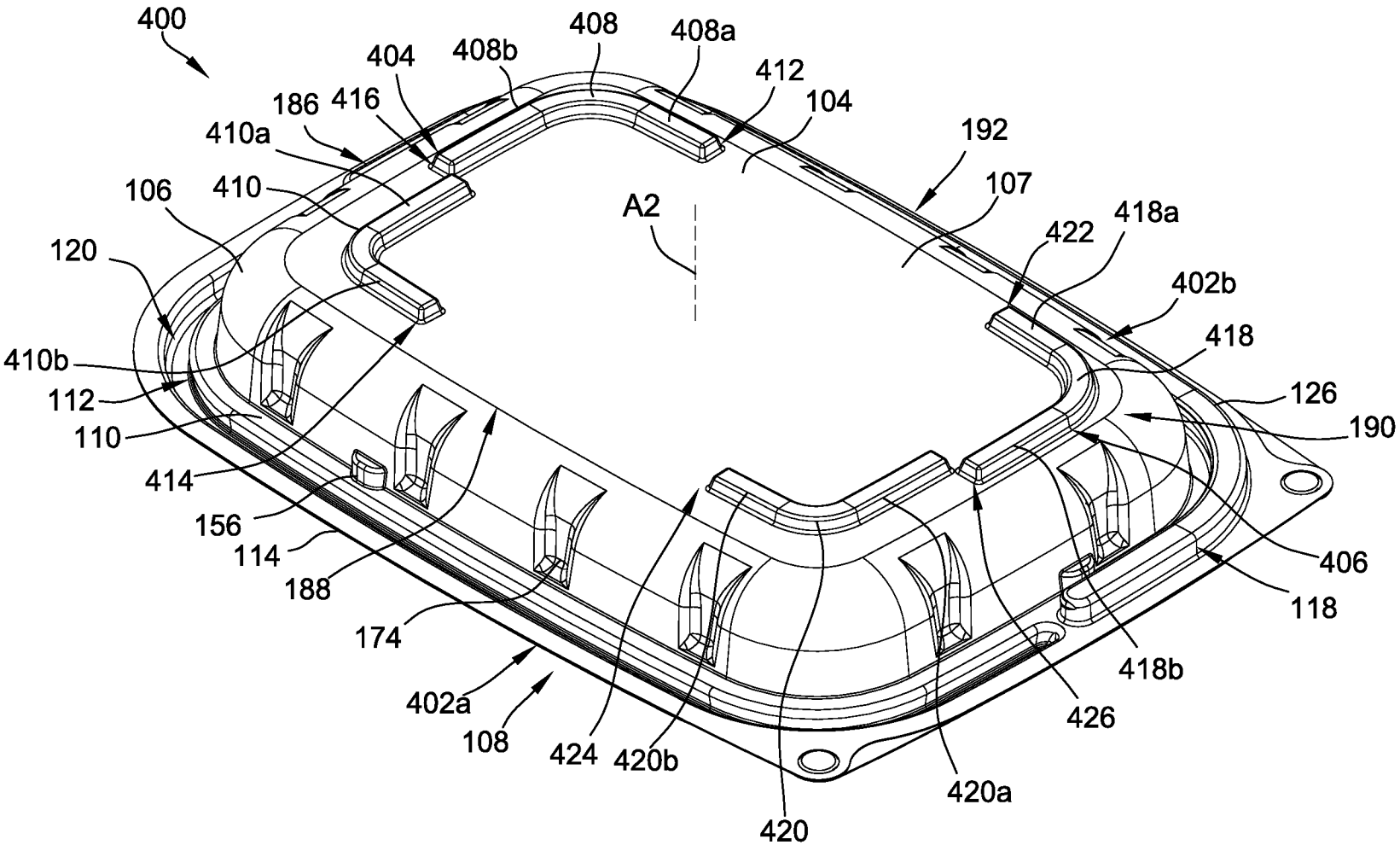
FIG. 45 is a perspective view of another example container formed of trays having a substantially identical profile, shown in a closed configuration.
Figure 46:
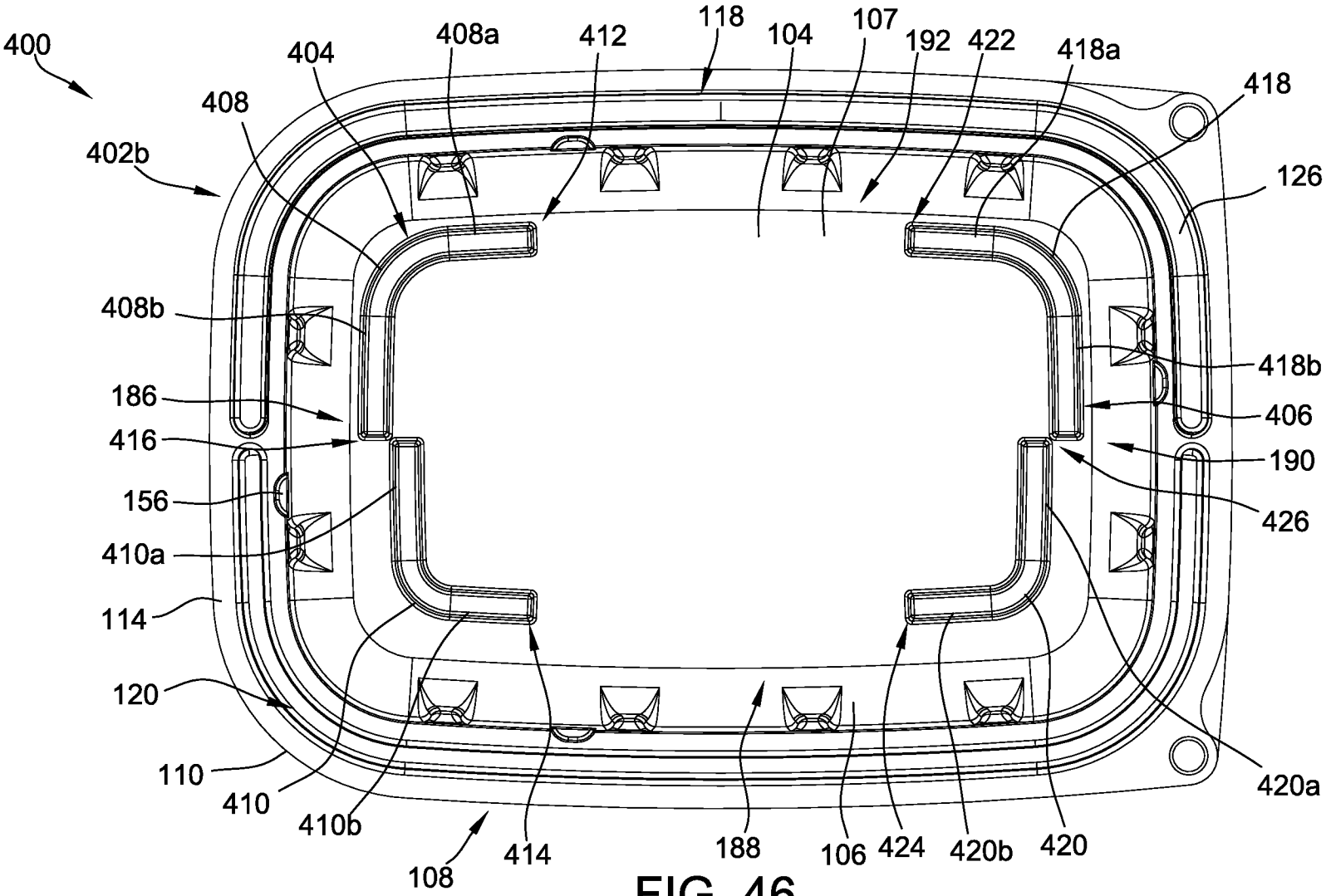
FIG. 46 is a top plan view of the container of FIG. 45.
Figure 47:
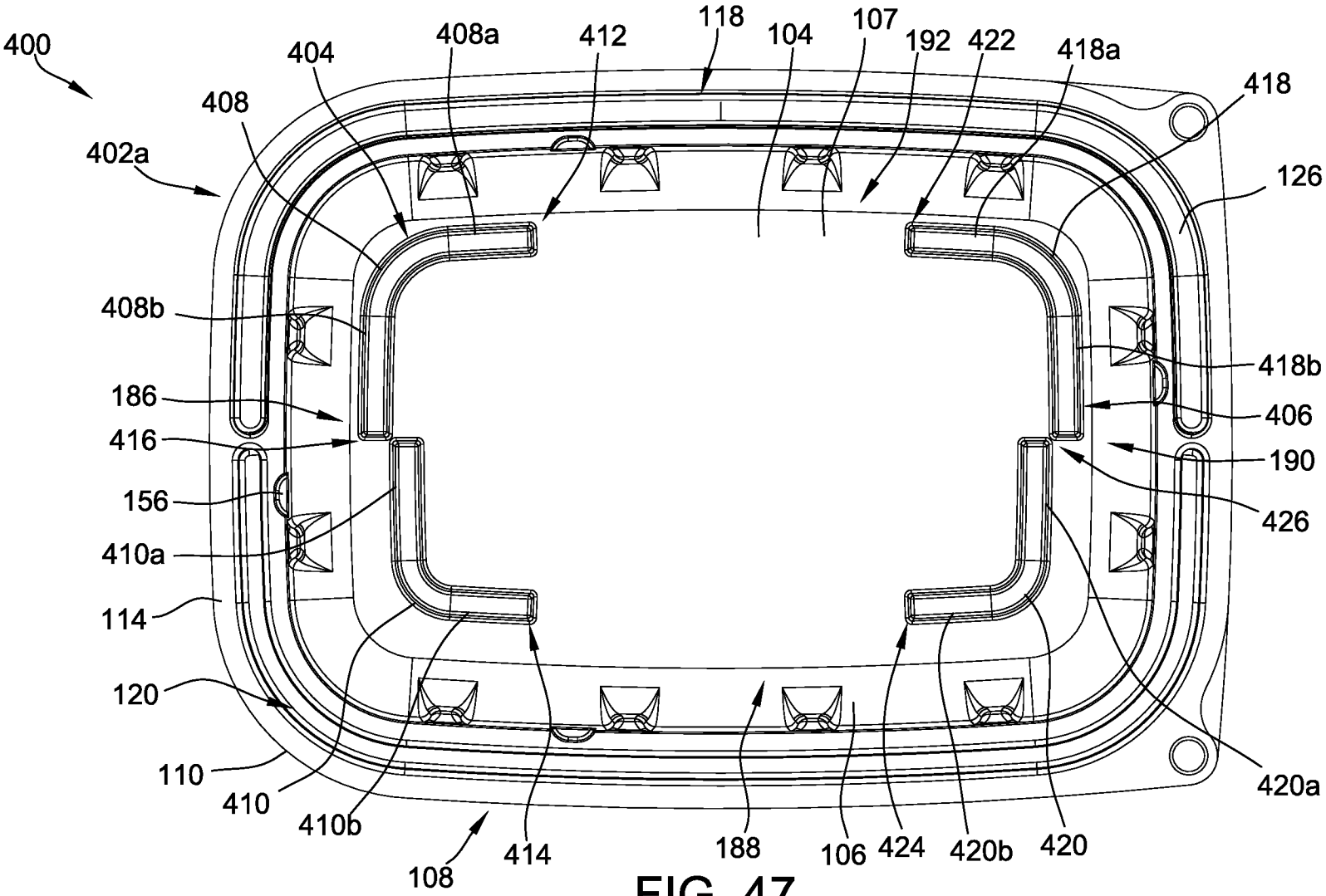
FIG. 47 is a bottom plan view of the container of FIG. 45.

FIGS. 45-47 are various view of another example container 400 that is formed from a pair of trays 402*a* and 402*b* having a substantially identical profile. The trays 402*a* and 402*b* may have the same elements and components as described above for the trays 102*a* and 102*b* that form the container 100, the trays 202*a* and 202*b* that form the container 200, and/or the trays 302*a* and 302*b* that form the container 300. Corresponding reference numerals are used to describe corresponding elements and features of the trays 402*a* and 202*b* that are included in the trays 102*a/b*, 202*a/b*, and/or 302*a/b* described above. In this example, the trays 402*a* and 402*b* each include a first stacking member 404 and a second stacking member 406 located on the cover portion 104. The stacking members 404 and 406 are included in lieu of the stacking members 176 and 178 described above for the trays 102*a* and 102*b*. Like the stacking members 176 and 178, the stacking members 402 and 404 facilitate limiting lateral movement of the trays 402*a* and 402*b* when the second tray 402*b* is inverted relative to the first tray 402*a* and the cover portion 104 of the second tray is stacked on the cover portion 104 of the first tray, and/or when two containers 400 formed from a pair of the trays 402*a* and 402*b* are stacked (shown in FIG. 48).

For each tray 402*a* and 402*b* of the example container 400, each of the first stacking member 404 and the second stacking member 406 are stacking bars that extend outwardly from the outer surface 107 of the cover portion 104 and that extend proximate the outer edge of the cover portion 104. The stacking bars 404 and 406 each have a "U-shape" profile in respectively extending proximate the outer edge of the cover portion 104. The U-shape profile of each stacking bar 404 and 406 is defined by discontinuous bar segments that are offset along the respective U-shape profile. The offset U-shape profile for each stacking bar 404 and 406 extends along three adjacent sides of the tray 402*a/b*.

The first stacking bar 404 includes a first stacking bar segment 408 and a second stacking bar segment 410. The stacking bar segments 408 and 410 may also be referred to as bar segments 408 and 410. Each bar segment 408 and 410 extends arcuately and has an "L-shape" profile. The L-shape profile of each bar segment 408 and 410 extends along two adjacent sides of the tray 402*a/b*. The first bar segment 408 and the second bar segment 410 are offset, and define a discontinuous U-shape profile of the first stacking bar 404 that extends from a first end 412 to a second end 414 along three adjacent sides of the tray 402*a/b*. The U-shaped extent of the first stacking bar 404 between the first end 412 and the second end 414 is interrupted at an offset junction 416 between the first and second bar segments 408 and 410. The first bar segment 408 has a first section 408*a* and a second section 408*b* coupled at an arcuate junction. The first section 408*a* extends proximate the second outer edge side 192 of the cover portion 104, from the first end 412 of the first stacking bar 404 to the second section 408*b*. The second section 408*b* extends proximate the first outer edge end 186 of the cover portion 104, from the first section 208*a* to the offset junction 416. The second bar segment 410 has a first section 410*a* and a second section 410*b* coupled at an arcuate junction. The first section 410*a* extends proximate the first outer edge end 186 of the cover portion 104, from the offset junction 416 to the second section 410*b*. The second section 410*b* extends proximate the first outer edge side 188 of the cover portion 104, from the first section 410*a* to the second end 414 of the first stacking bar 404. The first bar segment 408 of the first stacking bar 404 is located outwardly offset from the second bar segment 410. That is, each of the sections 408*a* and 408*b* of the first bar segment 408 is located in closer proximity to the outer edge of the cover portion 104, and farther from a central axis $A_2$ of the container 400, than the sections 410*a* and 410*b*, respectively, of the second bar segment 410.

The second stacking bar 406 includes a first stacking bar segment 418 and a second stacking bar segment 420. The stacking bar segments 418 and 420 may also be referred to as bar segments 418 and 420. Each bar segment 418 and 420 extends arcuately and has an "L-shape" profile. The L-shape profile of each bar segment 418 and 420 extends along two adjacent sides of the tray 402*a/b*. The first bar segment 418 and the second bar segment 420 are offset, and define a discontinuous U-shape profile of the second stacking bar 406 that extends from a first end 422 to a second end 424 along three adjacent sides of the tray 402*a/b*. The U-shaped extent of the first stacking bar 406 between the first end 422 and the second end 424 is interrupted at an offset junction 426 between the first and second bar segments 418 and 420. The first bar segment 418 has a first section 418*a* and a second section 418*b* coupled at an arcuate junction. The first section 418*a* extends proximate the second outer edge side 192 of the cover portion 104, from the first end 422 of the second stacking bar 406 to the second section 418*b*. The second section 418*b* extends proximate the second outer edge end 190 of the cover portion 104, from the first section 418*a* to the offset junction 426. The second bar segment 420 has a first section 420*a* and a second section 420*b* coupled at an arcuate junction. The first section 420*a* extends proximate the second outer edge end 190 of the cover portion 104, from the offset junction 426 to the second section 420*b*. The second section 420*b* extends proximate the first outer edge side 188 of the cover portion 104, from the first section 420*a* to the second end 424 of the second stacking bar 406. The first bar segment 418 of the second stacking bar 406 is located outwardly offset from the second bar segment 420. That is, each of the sections 418*a* and 418*b* of the first bar segment 418 is located in closer proximity to the outer edge of the cover portion 104, and farther from a central axis $A_2$ of the container 400, than the sections 420*a* and 420*b*, respectively, of the second bar segment 420.

Figure 48:
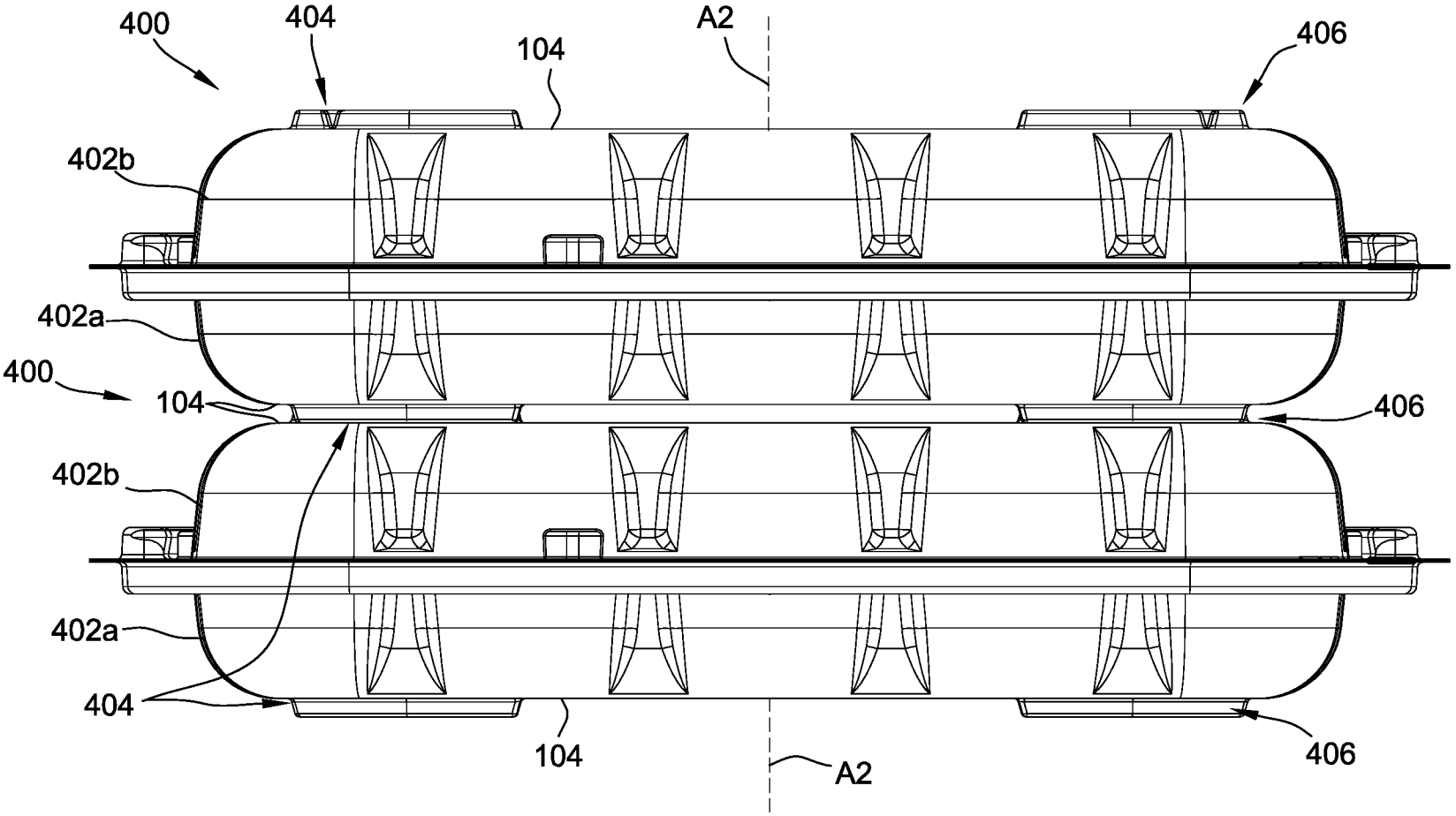
FIG. 48 is a side elevation of two containers as shown in FIGS. 45-47 stacked on top of one another.

In the container 400 of FIGS. 45-47, when the second tray 402*b* is inverted relative to the first tray 402*a* and the cover portion 104 of the second tray is stacked on the cover portion 104 of the first tray, the first stacking bar segments 408 and 418 of the first and second stacking bars 404 and 406 of the second tray 402*b* respectively envelop the second stacking bar segments 410 and 420 of the first and second stacking bars 404 and 408 of the first tray 402*a*. Similarly, the first stacking bar segments 408 and 418 of the first and second stacking bars 404 and 406 of the first tray 402*a* respectively envelop the second stacking bar segments 410 and 420 of the first and second stacking bars 404 and 408 of the second tray 402*b*. As such, the first stacking bar 404 of the first tray 402*a* is engageable with the second stacking bar 406 of the second tray 402*b* and the first stacking bar 404 of the second tray is engageable with the second stacking bar 406 of the first tray, which limits lateral movement of the first tray and the second tray relative to one another when stacked in such an orientation. This also facilitates alignment of the second tray 402*b* on the first tray 402*a* in this stacking orientation. Similarly, as shown in FIG. 48, the stacking bars 404 and 406 enable stacking and aligning multiple containers 400 on top of one another while limiting the propensity of the containers 400 to move laterally relative to one another, that is, relative to the central axes $A_2$ of the containers 400. The U-shape profile of the stacking bars 404 and 406 and the location of the stacking bars proximate the outer edge of the cover portion 104 also facilitate balancing the tray 402*a/b* and/or the container 400 formed from the trays 402*a* and 402*b* on a surface when used.

In the tray 402*a/b*, the stacking bars 404 and 406 are spaced a distance from each other. The spaced distanced between the stacking bars 404 and 406 extends along the opposing outer edge sides 188 and 192 of the cover portion 104. In particular, the first end 412 of the first stacking bar 404 is spaced a distance from the first end 422 of the second stacking bar 406 along the second outer edge side 192, and the second end 414 of the first stacking bar 404 is spaced a distance from the second end 424 of the second stacking bar 406 along the first outer edge side 188. As shown in FIG. 48, the spacing between the stacking bars 404 and 406 creates a gap between stacked trays 402a/b and/or stacked containers 400.

Figure 49:
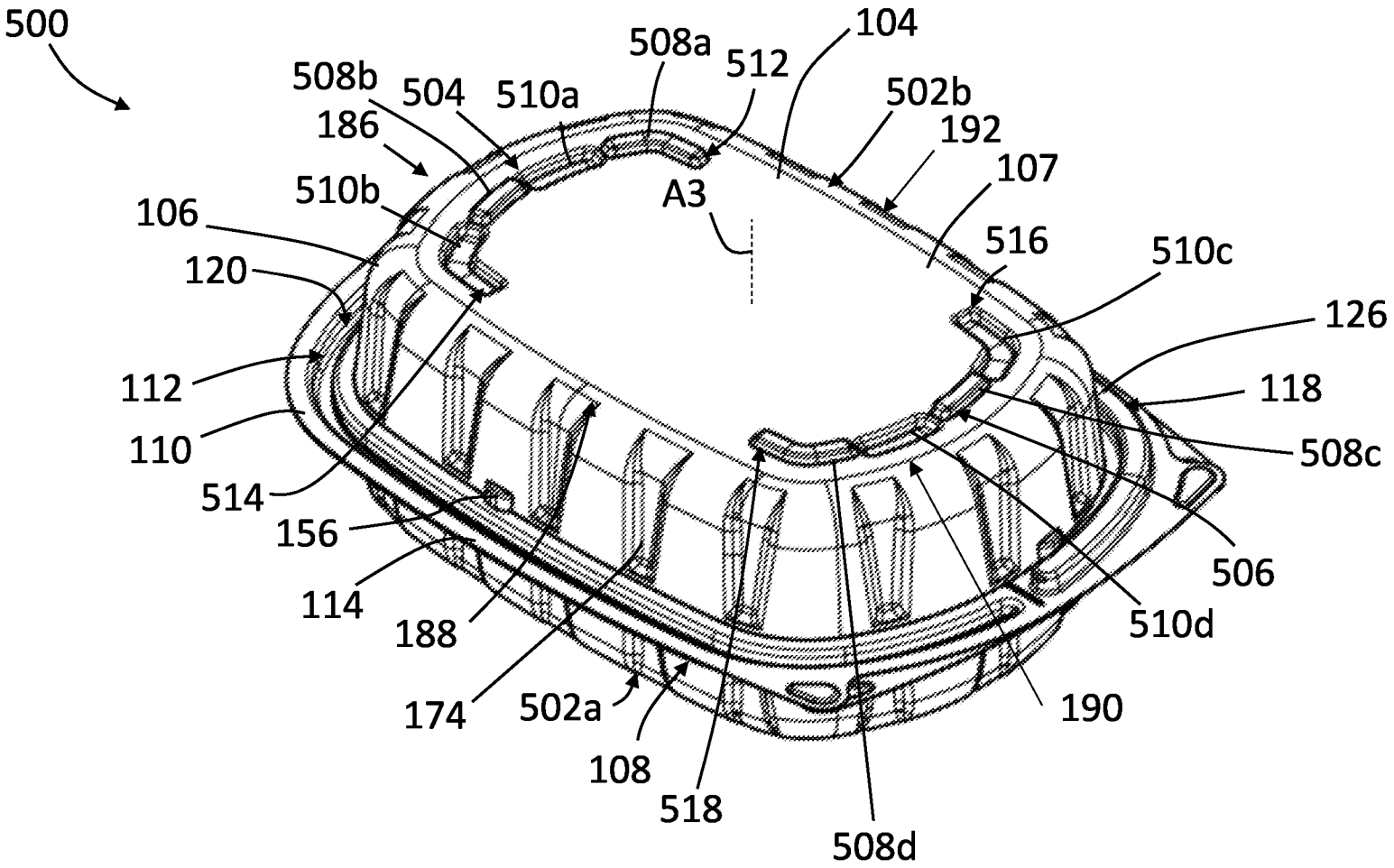
FIG. 49 is a perspective view of another example container formed of trays having a substantially identical profile, shown in a closed configuration.
Figure 50:
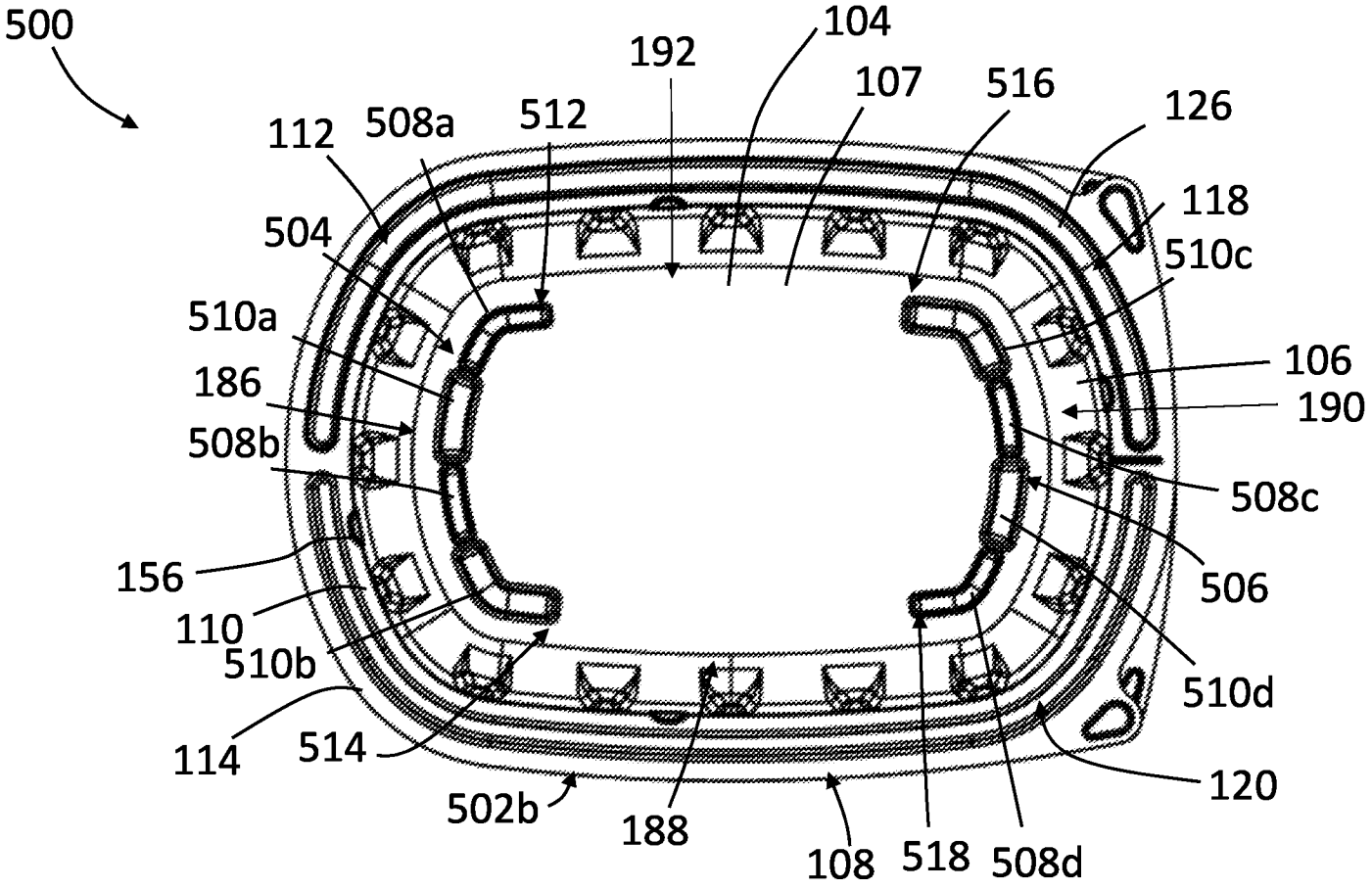
FIG. 50 is a top plan view of the container of FIG. 49.
Figure 51:
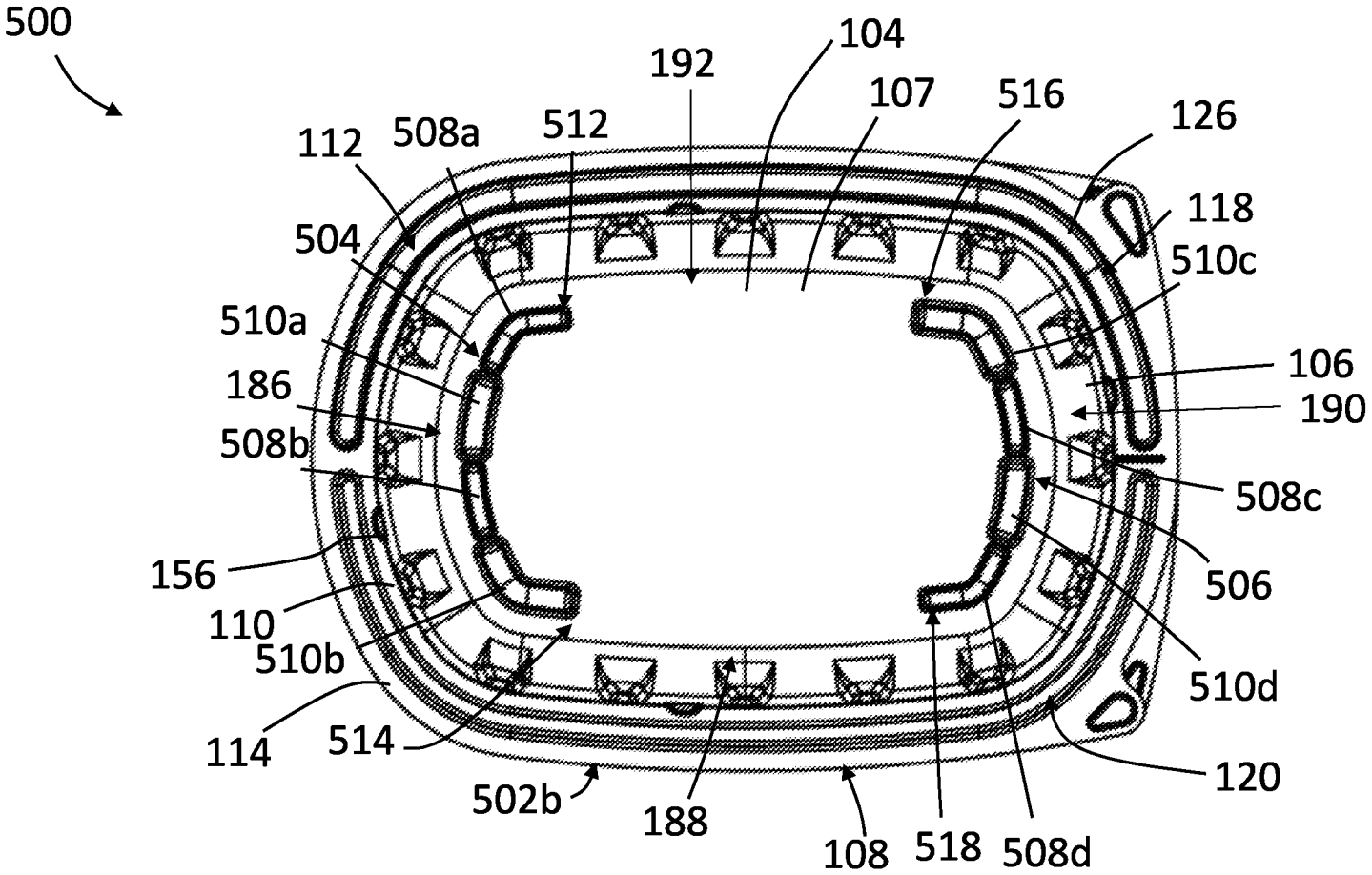
FIG. 51 is a bottom plan view of the container of FIG. 49.

FIGS. 49-51 are various view of another example container 500 that is formed from a pair of trays 502a and 502b having a substantially identical profile. The trays 502a and 502b may have the same elements and components as described above for the trays 102a and 102b that form the container 100, the trays 202a and 202b that form the container 200, the trays 302a and 302b that form the container 300, and/or the trays 402a and 402b that form the container 400. Corresponding reference numerals are used to describe corresponding elements and features of the trays 502a and 502b that are included in the trays 102a/b, 202a/b, 302a/b, and/or 402a/b described above. In this example, the trays 502a and 502b each include a first stacking member 504 and a second stacking member 506 located on the cover portion 104. The stacking members 504 and 506 are included in lieu of the stacking members 176 and 178 described above for the trays 102a and 102b and the stacking members 404 and 406 described above for the trays 402a and 402b. Like the stacking members 176 and 178 and the stacking members 404 and 406, the stacking members 502 and 504 facilitate limiting lateral movement of the trays 502a and 502b when the second tray 502b is inverted relative to the first tray 502a and the cover portion 104 of the second tray is stacked on the cover portion 104 of the first tray, and/or when two containers 500 formed from a pair of the trays 502a and 502b are stacked (shown in FIG. 52).

Each of the first stacking member 504 and the second stacking member 506 extends proximate the outer edge of the cover portion 104 and has a "U-shape" profile. The U-shape profile of each stacking member 504 and 506 is defined by an alternating series of stacking lugs 508 that extend outwardly from the outer surface 107 of the cover portion 104 and stacking indents 310 that extend inwardly from the outer surface of the cover portion. The U-shape profile for each stacking member 504 and 506 extends along three adjacent sides of the tray 502a/b.

The first stacking member 504 extends in a U-shape from a first end 512 to a second end 514. The first stacking member 504 has a first stacking lug 508a, a first stacking indent 510a, a second stacking lug 508b, and a second stacking indent 510b. The first stacking lug 508a extends arcuately at a corner of the cover portion 104, located at the intersection of the first outer edge end 186 and the second outer edge side 192, from the first end 512 of the first stacking member 504 to the first stacking indent 510a. The first stacking indent 510a extends proximate to the first outer edge end 186 of the cover portion 104 from the first stacking lug 508a to the second stacking lug 508b. The second stacking lug 508b extends proximate to the first outer edge end 186 from the first stacking indent 510a to the second stacking indent 510b. The second stacking indent 510b extends arcuately at a corner of the cover portion 104, located at the intersection of the first outer edge end 186 and the first outer edge side 188, from the second stacking lug 508b to the second end 514 of the first stacking member 504. As shown in FIGS. 49-51, the size and shape of the first stacking lug 508a complements the size and shape of the second stacking indent 510b, and the size and shape of the first stacking indent 510a complements the size and shape of the second stacking lug 508b.

The second stacking member 506 extends in a U-shape from a first end 516 to a second end 518. The first stacking member 506 has a first stacking indent 510c, a first stacking lug 508c, a second stacking indent 510d, and a second stacking lug 508d. The first stacking indent 510c extends arcuately at a corner of the cover portion 104, located at the intersection of the second outer edge end 190 and the second outer edge side 192, from the first end 516 of the second stacking member 506 to the first stacking lug 508c. The first stacking lug 508c extends proximate to the second outer edge end 192 of the cover portion 104 from the first stacking indent 510c to the second stacking indent 510d. The second stacking indent 510d extends proximate to the second outer edge end 192 from the first stacking lug 508c to the second stacking lug 508d. The second stacking lug 508d extends arcuately at a corner of the cover portion 104, located at the intersection of the second outer edge end 192 and the first outer edge side 188, from the second stacking indent 510d to the second end 518 of the second stacking member 506. As shown in FIGS. 49-51, the size and shape of the first stacking indent 510c complements the size and shape of the second stacking lug 508d, and the size and shape of the second stacking indent 510d complements the size and shape of the first stacking lug 508c.

In the illustrated example, the stacking lugs 508 and stacking indents 510 of the first and second stacking members 504 invertedly complement each other, that is, have the same size, shape, and corresponding position when the container 500 is rotated 180° about the center axis $A_3$. In particular, the first stacking lug 508a of the first stacking member 504 and the second stacking lug 508d of the second stacking member 506 invertedly complement each other, the second stacking lug 508b of the first stacking member 504 and the first stacking lug 508c of the second stacking member 506 invertedly complement each other, the first stacking indent 510a of the first stacking member 504 and the second stacking indent 510d of the second stacking member 506 invertedly complement each other, and the second stacking indent 510b of the first stacking member 504 and the first stacking indent 510c of the second stacking member 506 invertedly complement each other. In other examples, the first and second stacking members 504 and 506 may have stacking lugs 508 and stacking indents 510 of different sizes and/or shaped. Moreover, although each stacking member 504 and 506 includes two stacking lugs 508 and two stacking indents 510 in the illustrated example, any suitable number of stacking lugs and stacking indents may be included, and the number of stacking lugs may be different from the number of stacking indents.

In the tray 502a/b, the stacking members 504 and 506 are spaced a distance from each other. The spaced distanced between the stacking members 504 and 506 extends along the opposing outer edge sides 188 and 192 of the cover portion 104. In particular, the first end 512 of the first stacking member 504 is spaced a distance from the first end 516 of the second stacking member 506 along the second outer edge side 192, and the second end 514 of the first stacking member 504 is spaced a distance from the second end 518 of the second stacking member 506 along the first outer edge side 188. In other examples, the first ends 512 and 516 and/or the second ends 514 and 518 of the stacking members 504 and 506 may be adjacent one another on the respective outer edge side 192 and 188. For example, the first ends 512 and 516 and the second ends 514 and 518 may be adjacent one another such that the stacking members 504 and 506 form a unitary stacking member with alternating stacking lugs 508 and stacking indents 510 that extends entirely along the outer edge of the cover portion 104.

Figure 52:
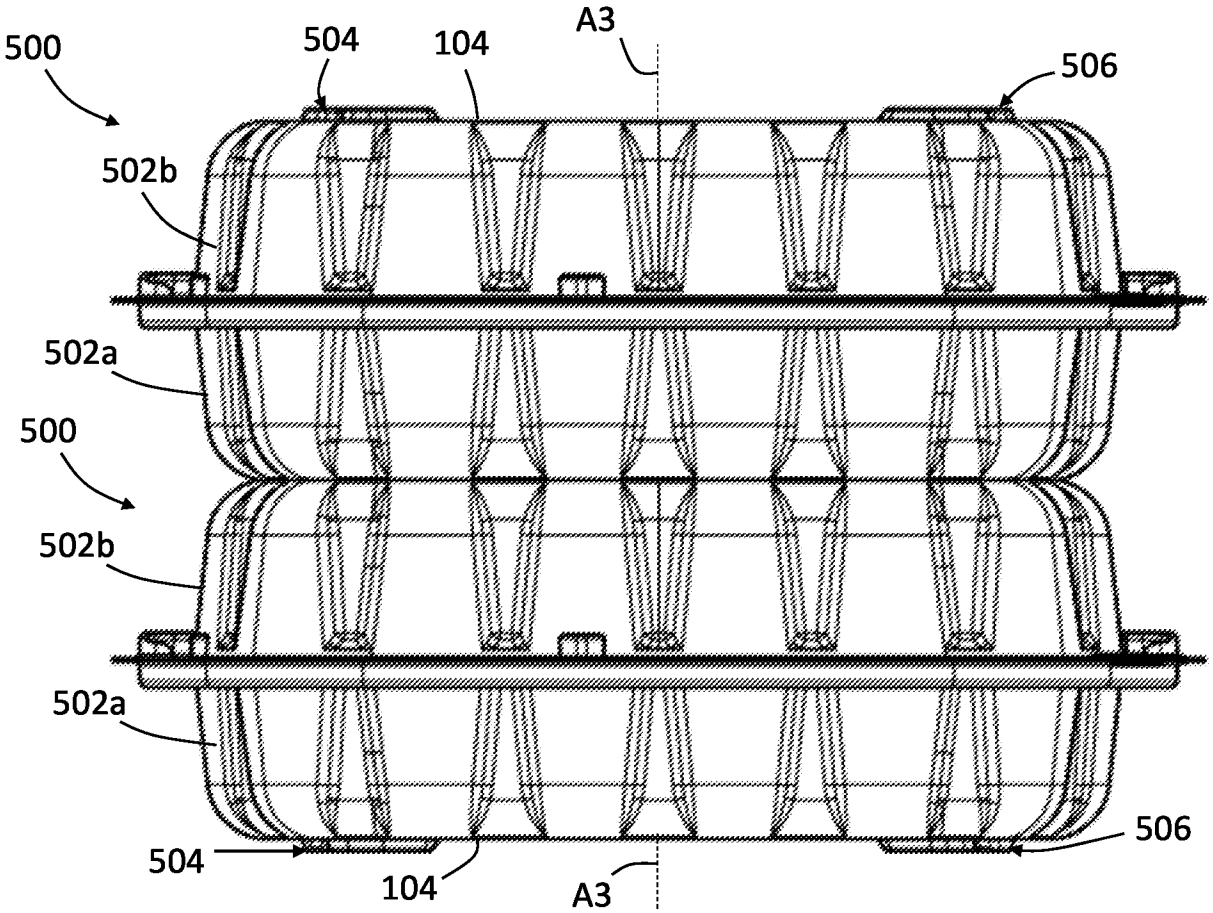
FIG. 52 is a side elevation of two containers as shown in FIGS. 49-51 stacked on top of one another.

When the second tray 502b is inverted relative to the first tray 502a and the cover portion 104 of the second tray is stacked on the cover portion 104 of the first tray, the stacking indents 510 of the second tray 502*b* receive the complementing stacking lugs 508 of the first tray 502*a*, and the stacking indents 510 of the first tray receive the complementing stacking lugs 508 of the second tray. As such, the first stacking member 504 of the first tray 502*a* is engageable with the second stacking member 506 of the second tray 502*b* and the first stacking member 504 of the second tray is engageable with the second stacking member 506 of the first tray, which limits lateral movement of the first tray and the second tray relative to one another when stacked in such an orientation. This also facilitates alignment of the second tray 502*b* on the first tray 502*a* in this stacking orientation. As shown in FIG. 52, when two containers 500 are stacked on top of one another, the stacking indents 510 of the second tray 502*b* of a first (bottom) container 500 receive the complementing stacking lugs 508 of the first tray 502*a* of a second (top) container 500, and the stacking indents 510 of the first tray of the top container receive the complementing stacking lugs 508 of the second tray of the bottom container.

As used herein, an element or step recited in the singular and preceded by the word "a" or "an" should be understood as not excluding plural elements or steps, unless such exclusion is explicitly recited. Furthermore, references to "example embodiment" or "one embodiment" of the present disclosure are not intended to be interpreted as excluding the existence of additional embodiments that also incorporate the recited features.

Unless otherwise indicated, approximating language, such as "generally," "substantially," "approximately," and "about," as used herein indicates that the term so modified may apply to only an approximate degree, as would be recognized by one of ordinary skill in the art, rather than to an absolute or perfect degree. Accordingly, a value modified by a term or terms such as "about," "approximately," and "substantially" is not to be limited to the precise value specified. In at least some instances, the approximating language may correspond to the precision of an instrument for measuring the value.

Unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

The patent claims at the end of this document are not intended to be construed under 35 U.S.C. § 112(f) unless traditional means-plus-function language is expressly recited, such as "means for" or "step for" language being expressly recited in the claim(s).

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container comprising a first tray and a second tray, the first tray being releasably engageable with the second tray when the second tray is inverted relative to the first tray, each tray having a substantially identical profile, for each tray:

the tray comprising a cover portion, a peripheral rim, and a sidewall extending between and coupling the cover portion and the rim;

the rim comprising a proximal segment and a bead segment, wherein the proximal segment extends outwardly from the sidewall to the bead segment, and wherein the rim includes at least one vent channel defined in the proximal segment; and the bead segment has an upwardly-extending member and a downwardly-extending member, wherein the upwardly-extending member defines a first cavity, and wherein the downwardly-extending member defines a second cavity;

wherein, when the first tray engages the second tray inverted relative to the first tray:

the upwardly-extending member of the bead segment of the first tray is received in the second cavity of the bead segment of the second tray and engages the downwardly-extending member of the bead segment of the second tray;

the upwardly-extending member of the bead segment of the second tray is received in the second cavity of the bead segment of the first tray and engages the downwardly-extending member of the bead segment of the first tray;

the sidewalls and the cover portions of the first and second trays define an interior volume of the container;

the proximal segments of the rims of the first and second trays are in face-to-face contact to substantially seal the interior volume;

each of the at least one vent channels of the first and second trays is in communication with the interior volume; and a first vent channel of the first tray is aligned with a second vent channel of the second tray to form a continuous vent path defined by the first vent channel and the second vent channel.

2. The container of claim 1, wherein, for each tray, the rim comprises a distal segment extending outwardly from the bead segment opposite the proximal segment, the distal segment defines a peripheral edge of the rim, wherein the at least one vent channel is defined in the proximal segment, the bead segment, and the distal segment, and wherein the at least one vent channel terminates prior to the peripheral edge of the rim.

3. The container of claim 1, wherein, for each tray, the rim comprises a distal segment extending outwardly from the bead segment opposite the proximal segment, the distal segment defines a peripheral edge of the rim, wherein the at least one vent channel is defined in the proximal segment, the bead segment, and the distal segment, and wherein the at least one vent channel extends to the peripheral edge of the rim such that, when the first tray engages the second tray inverted relative to the first tray, the at least one vent channel creates a continuous path extending between the rims of the trays.

4. The container of claim 1, wherein the first vent channel is defined in the upwardly-extending member of the bead segment of the first tray and the second vent channel is defined in the downwardly-extending member of the bead segment of the second tray.

5. The container of claim 1, wherein, for each tray, the upwardly-extending member extends between first and second ends and the downwardly-extending member extends between first and second ends, the first end of the downwardly-extending member being located proximate the second end of the upwardly-extending member, the second end of the downwardly-extending member being located proximate the first end of the upwardly-extending member, and wherein the at least one vent channel is defined in the bead segment and extends between the first end of the downwardly-extending member and the second end of the upwardly-extending member or between the second end of the downwardly-extending member and the first end of the upwardly-extending member.

6. The container of claim 1, wherein, for each tray, the rim includes vent channels each defined in the proximal segment, wherein the vent channels include a first subset of vent channels positioned on a first side of the tray and a second subset of vent channels positioned on a second side of the tray opposite the first subset of vent channels.

7. The container of claim 6, wherein, for each tray, the vent channels are coextensive in length.

8. The container of claim 6, wherein, for each tray, each of the vent channels is defined in one of the upwardly-extending member and the downwardly-extending member and extends to a peripheral edge of the rim such that, when the first tray engages the second tray inverted relative to the first tray, each of the vent channels creates a continuous path extending between the rims of the trays.

9. The container of claim 1, wherein, for each tray, the cover portion comprises a first stacking member and a second stacking member each located proximate an outer edge of the cover portion, wherein, when the second tray is inverted relative to the first tray and the cover portion of the second tray is stacked on the cover portion of the first tray, the first stacking member of the first tray is engageable with the second stacking member of the first tray and the first stacking member of the first tray is engageable with the second stacking member of the second tray to limit movement of the first tray and the second tray relative to one another.

10. The container of claim 9, wherein the first stacking member is a first stacking bar and the second stacking member is a second stacking bar, each of the first and second stacking bars having a U-shape profile and extending outwardly from a surface of the cover portion.

11. The container of claim 10, wherein the first stacking bar and the second stacking bar each comprise stacking bar segments that are offset along the respective U-shape profile.

12. The container of claim 10, wherein the first stacking bar and the second stacking bar each comprise stacking bar segments that extend continuously along the respective U-shape profile.

13. The container of claim 9, wherein the first stacking member and the second stacking member each comprise stacking lugs and stacking indents in alternating arrangement along a U-shape profile of the respective stacking member, wherein, when the second tray is inverted relative to the first tray and the cover portion of the second tray is stacked on the cover portion of the first tray, the stacking indents of the second tray receive the stacking lugs of the first tray and the stacking indents of the first tray receive the stacking lugs of the second tray to limit movement of the first tray and the second tray relative to one another.

14. A container comprising a first tray and a second tray, the first tray being releasably engageable with the second tray when the second tray is inverted relative to the first tray, each tray having a substantially identical profile, for each tray:

the tray comprising a cover portion, a peripheral rim, and a sidewall extending between and coupling the cover portion and the rim;

the cover portion comprising a first stacking member and a second stacking member each located proximate an outer edge of the cover portion, the first and second stacking members each having a U-shape profile;

the rim comprising a proximal segment and a bead segment, wherein the proximal segment extends outwardly from the sidewall to the bead segment, and wherein the rim includes at least one vent channel defined in the proximal segment; and the bead segment has an upwardly-extending member and a downwardly-extending member, wherein the upwardly-extending member defines a first cavity, and wherein the downwardly-extending member defines a second cavity;

wherein, when the first tray engages the second tray inverted relative to the first tray:

the upwardly-extending member of the bead segment of the first tray is received in the second cavity of the bead segment of the second tray and engages the downwardly-extending member of the bead segment of the second tray;

the upwardly-extending member of the bead segment of the second tray is received in the second cavity of the bead segment of the first tray and engages the downwardly-extending member of the bead segment of the first tray; and each of the at least one vent channels of the first and second trays is in communication with an interior volume of the container; and a first vent channel of the first tray is aligned with a second vent channel of the second tray to form a continuous vent path defined by the first vent channel and the second vent channel; and wherein, when the second tray is inverted relative to the first tray and the cover portion of the second tray is stacked on the cover portion of the first tray, the first stacking member of the second tray is engageable with the second stacking member of the first tray and the first stacking member of the first tray is engageable with the second stacking member of the second tray to limit movement of the first tray and the second tray relative to one another.

15. The container of claim 14, wherein the first stacking member is a first stacking bar and the second stacking member is a second stacking bar, each of the first and second stacking bars extending outwardly from a surface of the cover portion.

16. The container of claim 15, wherein the first stacking bar and the second stacking bar each comprise stacking bar segments that are offset along the respective U-shape profile.

17. The container of claim 15, wherein the first stacking bar and the second stacking bar each comprise stacking bar segments that extend continuously along the respective U-shape profile.

18. The container of claim 14, wherein the first stacking member and the second stacking member each comprise stacking lugs and stacking indents in alternating arrangement along the U-shape profile of the respective stacking member, wherein, when the second tray is inverted relative to the first tray and the cover portion of the second tray is stacked on the cover portion of the first tray, the stacking indents of the second tray receive the stacking lugs of the first tray and the stacking indents of the first tray receive the stacking lugs of the second tray to limit movement of the first tray and the second tray relative to one another.

19. A pair of containers, each container comprising a first tray and a second tray, the first tray being releasably engageable with the second tray when the second tray is inverted relative to the first tray, each tray having a substantially identical profile, for each tray:

the tray comprising a cover portion, a peripheral rim, and a sidewall extending between and coupling the cover portion and the rim;

the cover portion comprising a first stacking member and a second stacking member each located proximate an outer edge of the cover portion, the first and second stacking members each having a U-shape profile;

the rim comprising a proximal segment and a bead segment, wherein the proximal segment extends outwardly from the sidewall to the bead segment, and wherein the rim includes at least one vent channel defined in the proximal segment; and the bead segment has an upwardly-extending member and a downwardly-extending member, wherein the upwardly-extending member defines a first cavity, and wherein the downwardly-extending member defines a second cavity;

wherein, for each container, when the first tray engages the second tray inverted relative to the first tray:

the upwardly-extending member of the bead segment of the first tray is received in the second cavity of the bead segment of the second tray and engages the downwardly-extending member of the bead segment of the second tray;

the upwardly-extending member of the bead segment of the second tray is received in the second cavity of the bead segment of the first tray and engages the downwardly-extending member of the bead segment of the first tray; and each of the at least one vent channels of the first and second trays is in communication with an interior volume of the container; and a first vent channel of the first tray is aligned with a second vent channel of the second tray to form a continuous vent path defined by the first vent channel and the second vent channel; and wherein, when a first container of the pair of containers is stacked on a second container of the pair of containers, the first stacking member of the first tray of the first container is engageable with the second stacking member of the second tray of the second container and the first stacking member of the second tray of the second container is engageable with the second stacking member of the first tray of the first container to limit movement of the first container and the second container relative to one another.

20. The pair of containers of claim 19, wherein, for each tray, the first stacking member is a first stacking bar and the second stacking member is a second stacking bar, each of the first and second stacking bars extending outwardly from a surface of the cover portion.

* * * * *